US007162399B2

(12) United States Patent
Zhang et al.

(10) Patent No.: US 7,162,399 B2
(45) Date of Patent: Jan. 9, 2007

(54) SYSTEM FOR AND METHOD OF SELECTING PNEUMATIC DEVICE, AND RECORDING MEDIUM

(75) Inventors: Huping Zhang, Toride (JP); Mitsuru Senoo, Moriya (JP); Naotake Oneyama, Kashiwa (JP)

(73) Assignee: SMC Kabushiki Kaisha, Tokyo (JP)

( * ) Notice: Subject to any disclaimer, the term of this patent is extended or adjusted under 35 U.S.C. 154(b) by 700 days.

(21) Appl. No.: 10/263,078

(22) Filed: Oct. 3, 2002

(65) Prior Publication Data

US 2003/0069720 A1 Apr. 10, 2003

(30) Foreign Application Priority Data

Oct. 5, 2001 (JP) ..... 2001-310779
Oct. 5, 2001 (JP) ..... 2001-310786
Oct. 5, 2001 (JP) ..... 2001-310788

(51) Int. Cl.
*G06G 7/48* (2006.01)

(52) U.S. Cl. ..... 703/7; 73/11.04; 73/11.05; 73/11.07; 73/11.09; 267/75; 267/141; 267/183; 267/294; 267/23; 267/74

(58) Field of Classification Search ..... 280/6.159, 280/283; 188/170, 374; 701/38, 37; 702/50; 700/262; 716/5; 703/26
See application file for complete search history.

(56) References Cited

U.S. PATENT DOCUMENTS 3,799,297 A * 3/1974 Ryburn et al. ..... 188/170
5,144,558 A * 9/1992 Fukushima et al. ..... 701/38
5,405,159 A * 4/1995 Klein et al. ..... 280/283
6,135,252 A * 10/2000 Knotts ..... 188/374
6,282,463 B1 * 8/2001 Oneyama et al. ..... 700/262
6,507,792 B1 * 1/2003 Senoo et al. ..... 702/50
2002/0035423 A1 * 3/2002 Shank et al. ..... 701/37
2002/0053278 A1 * 5/2002 Hayes et al. ..... 89/1.34
2002/0096841 A1 * 7/2002 Hedenberg ..... 280/6.159
2004/0030473 A1 * 2/2004 Lu et al. ..... 701/36
2004/0128120 A1 * 7/2004 Coburn et al. ..... 703/26
2004/0243483 A1 * 12/2004 Baumann et al. ..... 705/27
2005/0278670 A1 * 12/2005 Brooks et al. ..... 716/5

FOREIGN PATENT DOCUMENTS

EP 1 011 038 6/2000

(Continued)

OTHER PUBLICATIONS

Japan Fluid Power Association, "Air Pressure in Practice," pp. 20-24 of 3rd Edition, issued by The Nikkan Kogyo Shimbun, Ltd., Sep. 30, 1996.

(Continued)

*Primary Examiner*—Kamini Shah
*Assistant Examiner*—Cuong Van Luu
(74) *Attorney, Agent, or Firm*—Paul A. Guss

(57) ABSTRACT

A pneumatic device selection system has a computer, first through sixth databases connected to the computer and storing data of at least pneumatic devices, a coordinate input unit and a keyboard connected to the computer, for entering input data based on an input action of an operator into the computer, and a display unit connected to the computer, for displaying information from the computer. The pneumatic device selection system functionally has a first selection processor for selecting a cylinder operating system based on input data from the coordinate input unit or the like, and a second selection processor for selecting a shock absorber based on input data from the coordinate input unit or the like and/or a selection result from the first selection processor.

37 Claims, 63 Drawing Sheets

FOREIGN PATENT DOCUMENTS

| | | |
|---|---|---|
| JP | 53-21320 | 7/1978 |
| JP | 7-56966 | 3/1995 |
| JP | 8-83294 | 3/1996 |
| JP | 2000-179503 | 6/2000 |
| JP | 2000-215218 | 8/2000 |
| JP | 2000-298688 | 10/2000 |
| JP | 2000-305963 | 11/2000 |
| JP | 2002-169854 | 6/2002 |
| WO | WO 01/09742 | 2/2001 |

OTHER PUBLICATIONS

Shunichi Kutsumi, "Air Pressure Equipment and Applied Circuit," pp. 7-10 of 2nd Edition, issued by The Nikkan Kogyo Shimbun, Ltd., Apr. 30, 1969.

* cited by examiner

FIG. 2

52

1. SELECTION OF CYLINDER OPERATING SYSTEM

2. SELECTION OF SHOCK ABSORBER

3. VARIOUS SETTINGS (GENERAL-PURPOSE MASTER, UNIT MASTER)

MAIN ROUTINE (PART 1)

MAIN ROUTINE (PART 2)

CIRCUIT SETTING PROCESS
(PART 1)

CIRCUIT SETTING PROCESS
(PART 2)

CYLINDER SELECTION PROCESS

FIG. 28A

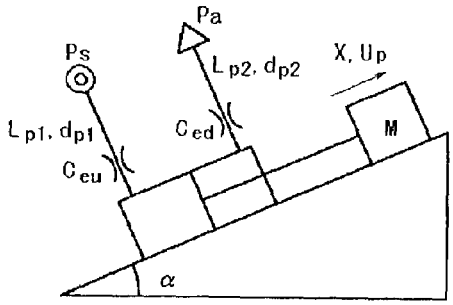

FIG. 28B $$q_m = Cp_1\rho_0\sqrt{\frac{T_0}{T_1}} \tag{1a}$$

$$q_m = Cp_1\rho_0\sqrt{\frac{T_0}{T_1}}\sqrt{1-\left(\frac{\frac{p_2}{p_1}-b}{1-b}\right)^2} \tag{1b}$$

FIG. 28C

EQUATION OF STATE $PV = wR\theta$ (2)

↓ DIFFERENTIATED

DISCHARGE CHAMBER $\frac{dD_d}{dt} = \frac{1}{V_d}\left(\frac{P_dV_d}{\theta_d}\frac{d\theta_d}{dt} + R\theta_dG_d - P_d\frac{dV_d}{dt}\right)$ (3)

FILLING CHAMBER $\frac{dD_u}{dt} = \frac{1}{V_u}\left(\frac{P_uV_u}{\theta_u}\frac{d\theta_u}{dt} + R\theta_uG_u - P_u\frac{dV_u}{dt}\right)$ (4)

EQUATION OF ENERGY $\frac{t}{dt}(C_vw\theta) = Q + CpG\theta_1 + P\frac{dV}{dt}$ (5)

↓

DISCHARGE CHAMBER $\frac{d\theta_d}{dt} = \frac{1}{C_vw_d}\left(S_{hd}h_d(\theta_a - \theta_d) + RG_d\theta_d - P_d\frac{dV_d}{dt}\right)$ (6)

FILLING CHAMBER $\frac{d\theta_u}{dt} = \frac{1}{C_vw_u}\left(S_{hu}h_u(\theta_a - \theta_u) + C_pG_u\theta_1 - C_vG_u\theta_u - P_u\frac{dV_u}{dt}\right)$ (7)

KINETIC EQUATION $M = \frac{dU_p}{dt} = P_uS_u - P_dS_d + P_a(S_d - S_u) - Mgsig\alpha - cu_p - Fq$ (8)

$$\alpha = \frac{C_1}{C_1 \cdot b_1} \tag{1}$$

$$\alpha \le 1 \Rightarrow C_{1,2} = C_1$$

$$\alpha > 1 \Rightarrow C_{1,2} = C_2 \cdot \alpha \cdot \frac{\alpha \cdot b_1 + (1 - b_1) \cdot \sqrt{\alpha^2 + \left(\frac{1 - b_1}{b_1}\right)^2 - 1}}{\alpha^2 + \left(\frac{1 - b_1}{b_1}\right)^2} \tag{2}$$

$$b_{1,2} = 1 - C_{1,2}^2 \cdot \left[\left(\frac{1 - b_1}{C_1^2}\right) + \left(\frac{1 - b_2}{C_2^2}\right)\right] \tag{3}$$

SOLENOID VALVE SELECTING PROCESS

TUBE SELECTING PROCESS

FIG. 34A

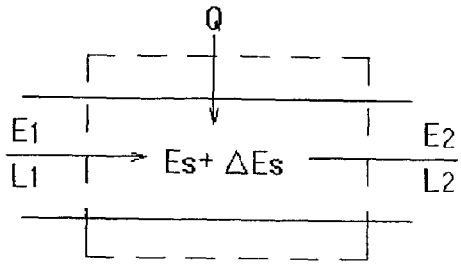

FIG. 34B

BASIC EQUATIONS OF TUBE

EQUATION OF CONTINUITY $$\frac{\partial p}{\alpha t}+\rho\frac{\partial u}{\partial z}+u\frac{\partial \rho}{\partial z}=0 \quad (9)$$

EQUATION OF STATE $$V\frac{dP}{dt}=R\theta\frac{dW}{dt}+wR\frac{d\theta}{dt} \quad (10)$$

EQUATION OF MOTION $$\frac{\partial u}{dt}+u\frac{\partial u}{dz}+\frac{1}{\rho}\frac{\partial \rho}{dz}+f=0 \quad (11)$$

$$f=\frac{\lambda}{2dp}u|u| \qquad \lambda=\frac{64}{Re} \quad Re<2.5\times10^3$$

$$\lambda=0.3164Re^{-0.25} \quad Re\geq 2.5\times10^3$$

EQUATION OF ENERGY $$\Delta E_S=E_1-E_2+L_1-L_2+Q$$

FIG. 34C

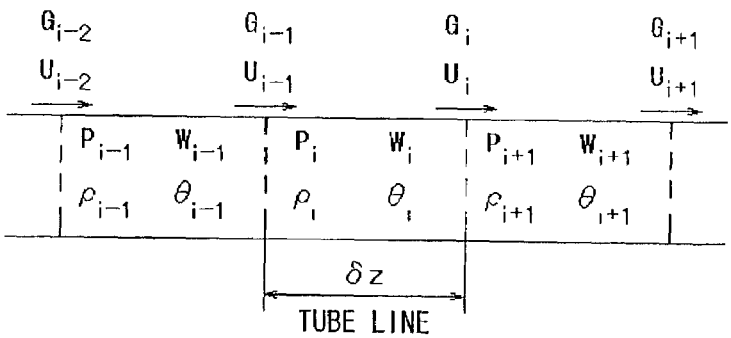

TUBE LINE DISCRETE MODEL

FIG. 34D

BASIC EQUATIONS MADE DISCRETE

EQUATION OF CONTINUITY $$\frac{\partial w_i}{\alpha t}=G_{i-1}-G_i \qquad G=\rho Au \quad (13)$$

EQUATION OF STATE $$\frac{dP_i}{dt}=\frac{R\theta_i}{V}(G_{i-1}-G_i)+\frac{Rw_i}{V}\frac{d\theta_i}{dt} \quad (14)$$

EQUATION OF MOTION $$\frac{\partial u}{\alpha t}=\frac{P_i-P_{i+1}}{\hat{\rho}\partial z}-\frac{\lambda}{2d}u_i|u_i|-|u_i|\frac{\partial u_i}{\partial z} \quad (15)$$

$$\hat{\rho}=-\frac{\rho_i+\rho_{i+1}}{2} \qquad \frac{\partial u_i}{\partial z}=\frac{u_{i-1}-u_{i+1}}{2\partial z}$$

EQUATION OF ENERGY $$\frac{d\theta_i}{dt}=\frac{1}{C_v w_i}\left\{E_1-E_2+L_1-L_2+Q-\frac{d}{dt}\left[\frac{1}{2}C_i w_i\left(\frac{u_{i-1}-u_i}{2}\right)^2\right]\right\} \quad (16)$$

FIG. 35

| [SYMBOLS] | |
|---|---|
| C | VISCOUS FRICTION FACTOR |
| Cv | CONSTANT VOLUME RATIO |
| d | TUBE INSIDE DIAMETER |
| Fq | MAXIMUM STATIC FRICTIONAL FORCE |
| G | MASS FLOW RATE |
| h | HEAT TRANSFER COEFFICIENT |
| M | LOAD MASS |
| P | PRESSURE |
| Pa | ATMOSPHERIC PRESSURE |
| Ps | SUPPLY PRESSURE |
| $S_h$ | HEAT TRANSFER AREA |
| t | TIME |
| u | FLOW VELOCITY IN TUBE |
| V | VOLUME |
| w | AIR MASS |
| z | TUBE COORDINATE |
| $\theta$ | TEMPERATURE |
| $\theta a$ | ATMOSPHERIC TEMPERATURE |
| $\kappa$ | SPECIFIC HEAT RATIO |
| $\Delta Es$ | ENERGY NEWLY ACCUMULATED IN SYSTEM |
| E1, E2 | TOTAL ENERGY BROUGHT IN AND OUT WITH FLUID |
| L1, L2 | FLOW WORK DONE IN AND OUT OF SYSTEM BY FLUID |
| Q | ENERGY FLOWING IN BY HEAT TRANSFER |
| L | LENGTH OF TUBE, FLOW WORK DONE IN AND OUT OF SYSTEM BY FLUID |
| P1 | PRESSURE DOWNSTREAM OF RESTRICTION |
| Ph | PRESSURE UPSTREAM OF RESTRICTION |
| $t_{req}$ | SPECIFIED RESPONSE TIME |
| A | EFFECTIVE TUBE AREA |
| b | CRITICAL PRESSURE RATIO |
| C | SOUND VELOCITY CONDUCTANCE |
| p | ABSOLUTE STATIC PRESSURE |
| $q_m$ | MASS FLOW RATE |
| $q_v$ | VOLUMETRIC FLOW RATE CONVERTED AT STANDARD STATE |
| R | GAS CONSTANT |
| s | COMPRESSION EFFECT COEFFICIENT |
| T | ABSOLUTE TEMPERATURE |
| $\Delta p$ | PRESSURE DROP $(p_1-p_2)$ |
| $\rho$ | DENSITY |

| [SUFFIX] | |
|---|---|
| d | DISCHARGE SIDE |
| u | FILLING SIDE |
| p | TUBE |

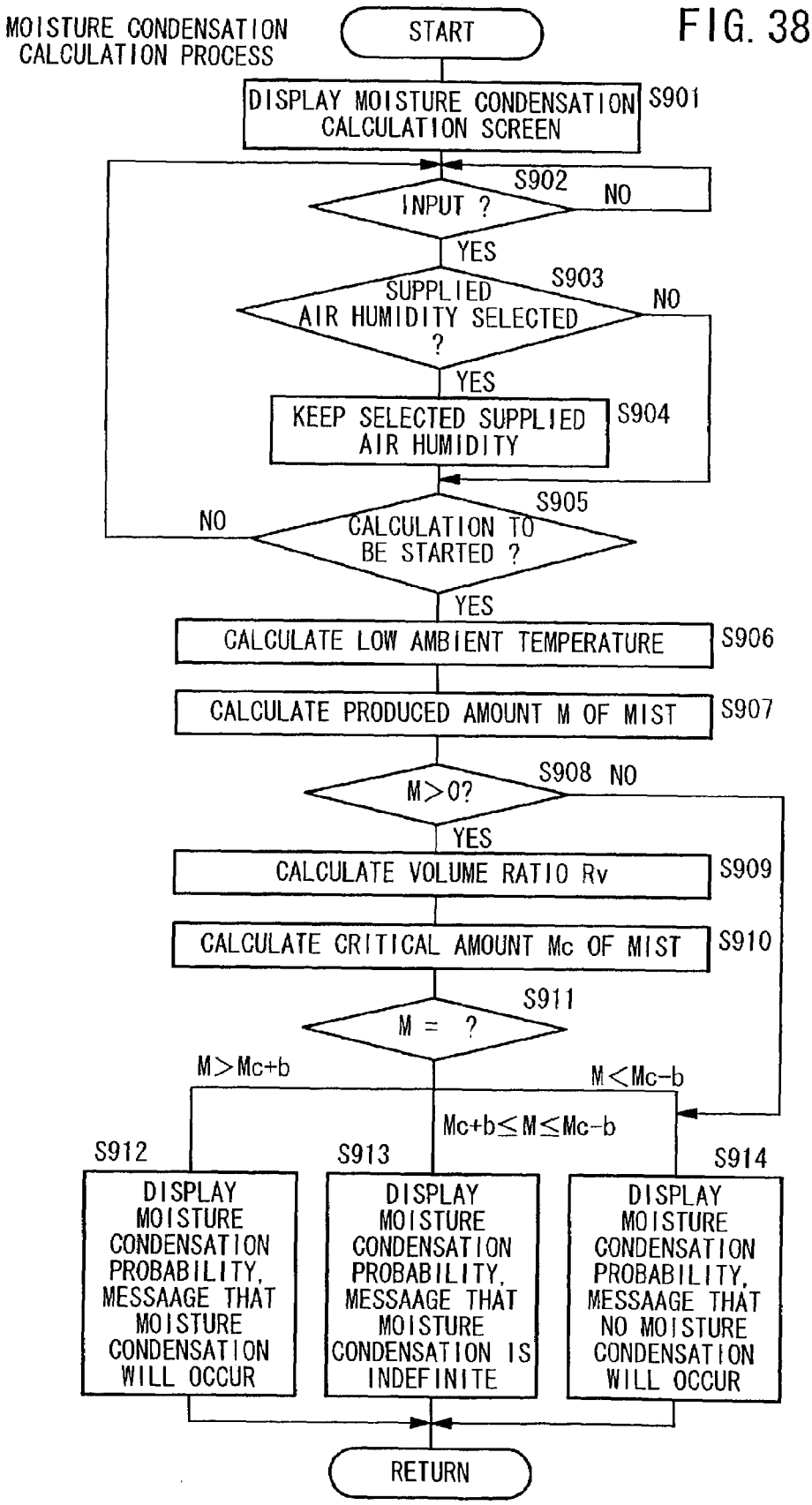
MOISTURE CONDENSATION CALCULATION PROCESS
START
FIG. 38
DISPLAY MOISTURE CONDENSATION CALCULATION SCREEN
S901
S902
INPUT ?
NO
YES
S903
SUPPLIED AIR HUMIDITY SELECTED ?
NO
YES
KEEP SELECTED SUPPLIED AIR HUMIDITY
S904
S905
NO
CALCULATION TO BE STARTED ?
YES
CALCULATE LOW AMBIENT TEMPERATURE
S906
CALCULATE PRODUCED AMOUNT M OF MIST
S907
S908
M>0?
NO
YES
CALCULATE VOLUME RATIO Rv
S909
CALCULATE CRITICAL AMOUNT Mc OF MIST
S910
S911
M = ?
M>Mc+b
M<Mc-b
Mc+b≤M≤Mc-b
S912
S913
S914
DISPLAY MOISTURE CONDENSATION PROBABILITY, MESSAAGE THAT MOISTURE CONDENSATION WILL OCCUR
DISPLAY MOISTURE CONDENSATION PROBABILITY, MESSAAGE THAT MOISTURE CONDENSATION IS INDEFINITE
DISPLAY MOISTURE CONDENSATION PROBABILITY, MESSAAGE THAT NO MOISTURE CONDENSATION WILL OCCUR
RETURN

SECOND SELECTION PROCESS

CONDITION INPUT PROCESS

FIG. 47

| IMPACT STYLE | MOUNTING | THRUST TYPE | CALCULATION FORMULAS |
|---|---|---|---|
| LINEAR IMPACT | FREE | CYLINDER DRIVE | FIG. 48 |
| | | MOTOR DRIVE | FIG. 49 |
| | | SLOPE DROPPING | FIG. 50 |
| | | OTHER THRUST | FIG. 51 |
| | VERTICAL-UPWARD | CYLINDER DRIVE | MOUNTING ANGLE a IS - 90° IN FIG. 48 |
| | | MOTOR DRIVE | MOUNTING ANGLE a IS - 90° IN FIG. 49 |
| | | OTHER THRUST | MOUNTING ANGLE a IS - 90° IN FIG. 51 |
| | HORIZONTAL | CYLINDER DRIVE | MOUNTING ANGLE a IS 0° IN FIG. 48 |
| | | MOTOR DRIVE | MOUNTING ANGLE a IS 0° IN FIG. 49 |
| | | OTHER THRUST | MOUNTING ANGLE a IS 0° IN FIG. 51 |
| | VERTICAL-DOWNWARD | CYLINDER DRIVE | MOUNTING ANGLE a IS 90° IN FIG. 48 |
| | | MOTOR DRIVE | MOUNTING ANGLE a IS 90° IN FIG. 49 |
| | | FREE DROP | MOUNTING ANGLE a IS 90° IN FIG. 50 |
| | | OTHER THRUST | MOUNTING ANGLE a IS 90° N FIG. 51 |
| ROTATIONAL IMPACT | | CYLINDER DRIVE | FIG. 52 |
| | | MOTOR DRIVE | FIG. 53 |
| | | SLOPE DROPPING | FIG. 54 |
| | | FREE DROP | MOUNTING ANGLE b IS 90° IN FIG. 54 |
| | | OTHER THRUST | FIG. 55 |

FIG. 48

| IMPACT STYLE | MOUNTING | TYPE OF THRUST |
|---|---|---|
| LINEAR IMPACT | FREE | CYLINDER DRIVE |

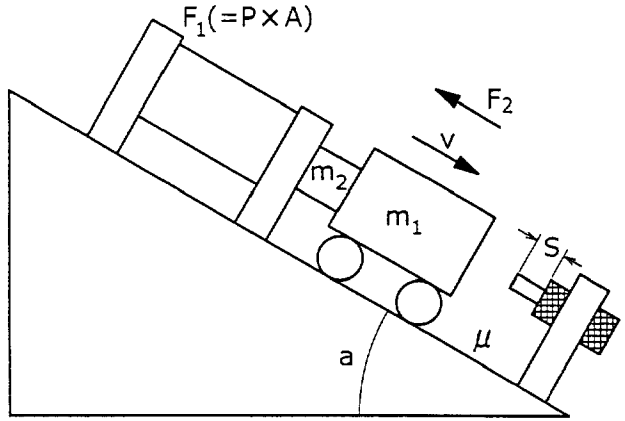

| SYMBOL | NAME | UNIT |
|---|---|---|
| $m_1$ | LOAD MASS | kg |
| $m_2$ | OTHER MASS(PISTON, ROD, ETC.) | kg |
| $\mu$ | FRICTION FACTOR | - |
| v | IMPACT VELOCITY | m/s |
| $F_2$ | RESISTING FORCE | N |
| $F_1$ | THRUST | N |
| P | SUPPLY PRESSURE | MPa |
| A | PISTON AREA OF CYLINDER | $mm^2$ |
| St | STROKE | mm |
| a | MOUNTING ANGLE(0:HORIZONTAL, 90:VERTICAL-UPWARD, -90:VERTICAL-DOWNWARD) | deg |
| N | QUANTITY | - |
| n | OPERATING CYCLE | cycle/min |
| t | AMBIENT TEMPERATURE | degC |
| g | GRAVITY(9.8) | $m/s^2$ |
| S | SHOCK ABSORBER STROKE | m |
| $E_1$ | KINETIC ENERGY | J |
| $E_2$ | THRUST ENERGY | J |
| E | ABSORPTION ENERGY | J |
| Me | EQUIVALENT MASS | kg |

| FORMULA | |
|---|---|
| | $E_1=1/2\cdot(m_1+m_2)\cdot v^2$ |
| | $E_2=(F_1+(m_1+m_2)\cdot g\cdot \sin a)\cdot S - ((m_1+m_2)\cdot g\cdot \mu\cdot \cos a+F_2)\cdot S$ |
| | $E=E_1+E_2$ |
| | $Me=2\cdot E/(v^2\cdot N)$ |

FIG. 49

| IMPACT STYLE | MOUNTING | TYPE OF THRUST | SYMBOL | NAME | UNIT |
|---|---|---|---|---|---|
| LINEAR IMPACT | FREE | MOTOR DRIVE | $m_1$ | LOAD MASS | kg |
| | | | $\mu$ | FRICTION FACTOR | – |
| | | | v | IMPACT VELOCITY | m/s |
| | | | $F_2$ | RESISTING FORCE | N |
| | | | Pw | MOTOR OUTPUT | W |
| | | | a | MOUNTING ANGLE (0:HORIZONTAL, 90:VERTICAL-UPWARD, -90:VERTICAL-DOWNWARD) | deg |
| | | | N | QUANTITY | – |
| | | | n | OPERATING CYCLE | cycle/min |
| | | | t | AMBIENT TEMPERATURE | degC |
| | | | g | GRAVITY (9.8) | $m/s^2$ |
| | | | S | SHOCK ABSORBER STROKE | m |
| | | | | | |
| | | | | | |
| | | | | | |
| FORMULA | $E_1=1/2\cdot m_1\cdot v^2$ | | $E_1$ | KINETIC ENERGY | J |
| | $E_2=(Pw/v+m_1\cdot g\cdot \sin a)\cdot S-(m_1\cdot g\cdot \mu\cdot \cos a+F_2)\cdot S$ | | $E_2$ | THRUST ENERGY | J |
| | $E=E_1+E_2$ | | E | ABSORPTION ENERGY | J |
| | $Me=2\cdot E/(v^2\cdot N)$ | | Me | EQUIVALENT MASS | kg |

FIG. 50

| IMPACT STYLE | MOUNTING | TYPE OF THRUST | SYMBOL | NAME | UNIT |
|---|---|---|---|---|---|
| LINEAR IMPACT | FREE | SLOPE DROPPING | $m_1$ | LOAD MASS | kg |
| | | | $\mu$ | FRICTION FACTOR | – |
| | | | h | DROP HEIGHT | m |
| | | | v | IMPACT VELOCITY | m/s |
| | | | $F_2$ | RESISTING FORCE | N |
| | | | Pw | MOTOR OUTPUT | W |
| | | | a | MOUNTING ANGLE(90:FREE DROPPING) | deg |
| | | | N | QUANTITY | – |
| | | | n | OPERATING CYCLE | cycle/min |
| | | | t | AMBIENT TEMPERATURE | degC |
| | | | g | GRAVITY(9.8) | $m/s^2$ |
| | | | S | SHOCK ABSORBER STROKE | m |
| | | | | | |
| | | | | | |
| | | | | | |
| FORMULA | $v=(2(g\cdot\sin a-\mu\cdot g\cdot\cos a-F_2/m_1)\cdot h)^{1/2}$ | | | | |
| | $E_1=1/2\cdot m_1\cdot v^2$ | | $E_1$ | KINETIC ENERGY | J |
| | $E_2=(Pw/v+m_1\cdot g\cdot\sin a)\cdot S-(m_1\cdot g\cdot\mu\cdot\cos a+F_2)\cdot S$ | | $E_2$ | THRUST ENERGY | J |
| | $E=E_1+E_2$ | | E | ABSORPTION ENERGY | J |
| | $Me=2\cdot E/(v^2\cdot N)$ | | Me | EQUIVALENT MASS | kg |

FIG. 51

| IMPACT STYLE | MOUNTING | TYPE OF THRUST |
|---|---|---|
| LINEAR IMPACT | FREE | OTHER THRUST |

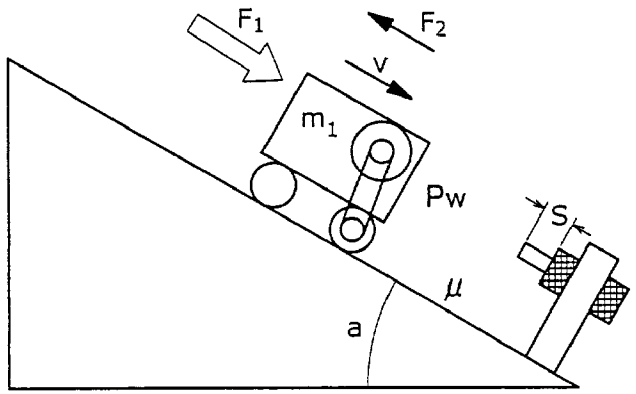

| SYMBOL | NAME | UNIT |
|---|---|---|
| $m_1$ | LOAD MASS | kg |
| $\mu$ | FRICTION FACTOR | – |
| v | IMPACT VELOCITY | m/s |
| $F_2$ | RESISTING FORCE | N |
| $F_1$ | THRUST | N |
| a | MOUNTING ANGLE (0:HORIZONTAL, 90:VERTICAL-UPWARD, -90:VERTICAL-DOWNWARD) | deg |
| N | QUANTITY | – |
| n | OPERATING CYCLE | cycle/min |
| t | AMBIENT TEMPERATURE | degC |
| g | GRAVITY (9.8) | $m/s^2$ |
| S | SHOCK ABSORBER STROKE | m |
| | | |
| | | |
| | | |

| FORMULA | | SYMBOL | NAME | UNIT |
|---|---|---|---|---|
| | $E_1=1/2\cdot m_1\cdot v^2$ | $E_1$ | KINETIC ENERGY | J |
| | $E_2=(F_1+m_1\cdot g\cdot \sin a)\cdot S-(m_1\cdot g\cdot \mu\cdot \cos a+F_2)\cdot S$ | $E_2$ | THRUST ENERGY | J |
| | $E=E_1+E_2$ | E | ABSORPTION ENERGY | J |
| | $Me=2\cdot E/(v^2\cdot N)$ | Me | EQUIVALENT MASS | kg |

FIG. 52

| IMPACT STYLE | MOUNTING | THRUST TYPE | SYMBOL | NAME | UNIT |
|---|---|---|---|---|---|
| ROTATIONAL IMPACT | - | CYLINDER DRIVE | I | INERTIA MOMENT ($=m_1*L1^2$) | $kg \cdot m^2$ |
| | | | $m_1$ | LOAD MASS | kg |
| | | | L1 | LOAD ROTATION RADIUS | kg |
| | | | v | IMPACT VELOCITY | m/s |
| | | | $T_1$ | RESISTING FORCE | N·m |
| | | | L2 | THRUST ACTING RADIUS | m |
| | | | $F_1$ | THRUST | N |
| | | | P | SUPPLY PRESSURE | MPa |
| | | | A | PISTON AREA OF CYLINDER | $mm^2$ |
| | | | St | STROKE | mm |
| | | | L3 | MOUNTING DISTANCE FROM ROTATION AXIS | m |
| | | | N | QUANTITY | - |
| | | | n | OPERATING CYCLE | cycle/min |
| | | | t | AMBIENT TEMPERATURE | degC |
| | | | g | GRAVITY (9.8) | $m/s^2$ |
| | | | S | SHOCK ABSORBER STROKE | m |
| FORMULA | $E_1=1/2 \cdot I \cdot (v/L3)^2$ | | $E_1$ | KINETIC ENERGY | J |
| | $E_2=(F_1 \cdot L2/L3-T_1/L3) \cdot S$ | | $E_2$ | THRUST ENERGY | J |
| | $E=E_1+E_2$ | | E | ABSORPTION ENERGY | J |
| | $Me=2 \cdot E/(v^2 \cdot N)$ | | Me | EQUIVALENT MASS | kg |

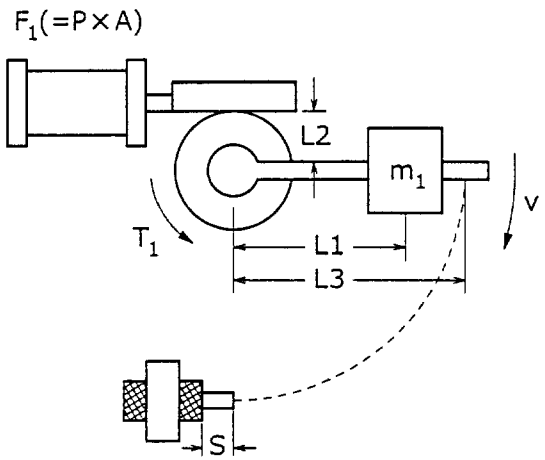

FIG. 53

| IMPACT STYLE | MOUNTING | THRUST TYPE | SYMBOL | NAME | UNIT |
|---|---|---|---|---|---|
| ROTATIONAL IMPACT | - | MOTOR DRIVE | I | INERTIA MOMENT ($=m_1*L1^2$) | $kg \cdot m^2$ |
| | | | $m_1$ | LOAD MASS | kg |
| | | | L1 | LOAD ROTATION RADIUS | kg |
| | | | v | IMPACT VELOCITY | m/s |
| | | | $T_1$ | RESISTING TORQUE | N·m |
| | | | L2 | THRUST ACTING RADIUS | m |
| | | | Pw | MOTOR OUTPUT | W |
| | | | $T_2$ | MOTOR TORQUE ($Pw/v \times L2$) | N·m |
| | | | L3 | MOUNTING DISTANCE FROM ROTATION AXIS | m |
| | | | N | QUANTITY | - |
| | | | n | OPERATING CYCLE | cycle/min |
| | | | t | AMBIENT TEMPERATURE | degC |
| | | | g | GRAVITY (9.8) | $m/s^2$ |
| | | | S | SHOCK ABSORBER STROKE | m |
| | | | | | |
| | | | | | |
| FORMULA | $E_1=1/2 \cdot I \cdot (v/L3)^2$ | | $E_1$ | KINETIC ENERGY | J |
| | $E_2=(F_1 \cdot L2/L3-T_1/L3) \cdot S$ | | $E_2$ | THRUST ENERGY | J |
| | $E=E_1+E_2$ | | E | ABSORPTION ENERGY | J |
| | $Me=2 \cdot E/(v^2 \cdot N)$ | | Me | EQUIVALENT MASS | kg |

FIG. 54

| IMPACT STYLE | MOUNTING | THRUST TYPE | SYMBOL | NAME | UNIT |
|---|---|---|---|---|---|
| ROTATIONAL IMPACT | - | OTHER THRUST | I | INERTIA MOMENT ($=m_1*L1^2$) | $kg \cdot m^2$ |
| | | | $m_1$ | LOAD MASS | kg |
| | | | L1 | LOAD ROTATION RADIUS | kg |
| | | | v | IMPACT VELOCITY | m/s |
| | | | $T_1$ | RESISTING TORQUE | N·m |
| | | | L2 | THRUST ACTING RADIUS | m |
| | | | $F_1$ | THRUST | N |
| | | | L3 | MOUNTING DISTANCE FROM ROTATION AXIS | m |
| | | | N | QUANTITY | - |
| | | | n | OPERATING CYCLE | cycle/min |
| | | | t | AMBIENT TEMPERATURE | degC |
| | | | g | GRAVITY (9.8) | $m/s^2$ |
| | | | S | SHOCK ABSORBER STROKE | m |
| | | | | | |
| | | | | | |
| | | | | | |
| FORMULA | $E_1=1/2 \cdot I \cdot (v/L3)^2$ | | $E_1$ | KINETIC ENERGY | J |
| | $E_2=(F_1 \cdot L2/L3-T_1/L3) \cdot S$ | | $E_2$ | THRUST ENERGY | J |
| | $E=E_1+E_2$ | | E | ABSORPTION ENERGY | J |
| | $Me=2 \cdot E/(v^2 \cdot N)$ | | Me | EQUIVALENT MASS | kg |

FIG. 55

| IMPACT STYLE | MOUNTING | THRUST TYPE | SYMBOL | NAME | UNIT |
|---|---|---|---|---|---|
| ROTATIONAL IMPACT | - | SLOPE DROPPING | I | INERTIA MOMENT ($=m_1*L1^2$) | $kg\cdot m^2$ |
| | | | $m_1$ | LOAD MASS | kg |
| | | | L1 | LOAD ROTATION RADIUS | kg |
| | | | a | MOUNTING ANGLE | deg |
| | | | b | MOUNTING ANGLE (90: FREE DROPPING) | deg |
| | | | v | IMPACT VELOCITY | m/s |
| | | | $T_1$ | RESISTING TORQUE | N·m |
| | | | c | MOUNTING ANGLE | deg |
| | | | L3 | MOUNTING DISTANCE FROM ROTATION AXIS | m |
| | | | N | QUANTITY | - |
| | | | n | OPERATING CYCLE | cycle/min |
| | | | t | AMBIENT TEMPERATURE | degC |
| | | | g | GRAVITY (9.8) | $m/s^2$ |
| | | | S | SHOCK ABSORBER STROKE | m |
| | | | | | |
| | | | | | |
| FORMULA | $v=(2\cdot g\cdot L1\cdot(\sin a+\cos c)\cdot\sin b)^{1/2}$ | | | | |
| | $E_1=1/2\cdot I\cdot(v/L3)^2$ | | $E_1$ | KINETIC ENERGY | J |
| | $E_2=m_1\cdot g\cdot\sin b\cdot\sin c\cdot L1/L3\cdot S-T_1/L3\cdot S$ | | $E_2$ | THRUST ENERGY | J |
| | $E=E_1+E_2$ | | E | ABSORPTION ENERGY | J |
| | $Me=2\cdot E/(v^2\cdot N)$ | | Me | EQUIVALENT MASS | kg |

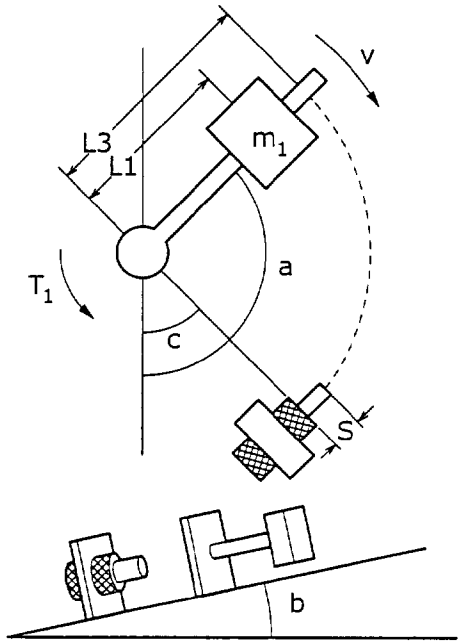

LOAD TYPE SELECTION PROCESS

FIG. 59

| CLASSIFICATION | SMALL CLASSIFICATION | DESCRIPTION |
|---|---|---|
| BAR | CASE 1 | LOCATION OF ROTATION AXIS: PASSES THE CENTER OF THE BAR |
| | CASE 2 | LOCATION OF ROTATION AXIS: PASSES THE END OF THE BAR |
| RECTANGULAR BOARD | CASE 1 | LOCATION OF ROTATION AXIS: PASSES THE CENTER OF GRAVITY OF THE BOARD |
| | CASE 2 | LOCATION OF ROTATION AXIS: PASSES THE END OF THE BOARD |
| | CASE 3 | LOCATION OF ROTATION AXIS: PASSES THE CENTER OF GRAVITY OF THE BOARD AND PERPENDICULAR TO THE BOARD |
| ISOSCEIES TRIANGLE | CASE 1 | LOCATION OF ROTATION AXIS: PASSES THE CENTER OF GRAVITY OF THE TRIANGLE AND PARALLEL TO THE SURFACE |
| | CASE 2 | LOCATION OF ROTATION AXIS: PASSES THE VERTEX OF THE TRIANGLE AND PARALLEL TO THE BASE |
| | CASE 3 | LOCATION OF ROTATION AXIS: PASSES THE VERTEX OF THE TRIANGLE AND THE CENTER OF THE BASE |
| | CASE 4 | LOCATION OF ROTATION AXIS: PASSES THE CENTER OF GRAVITY OF THE TRIANGLE AND THE PERPENDICULAR TO THE SURFACE |
| DISK | CASE 1 | LOCATION OF ROTATION AXIS: PASSES THE CENTER OF THE DISK AND PARALLEL TO THE SURFACE |
| | CASE 2 | LOCATION OF ROTATION AXIS: PASSES THE CENTER OF THE DISK AND THE PERPENDICULAR TO THE SURFACE |
| RING PLATE | CASE 1 | LOCATION OF ROTATION AXIS: PASSES THE CENTER OF THE RING AND THE PARALLEL TO THE SURFACE |
| | CASE 2 | LOCATION OF ROTATION AXIS: PASSES THE CENTER OF THE RING AND THE PERPENDICULAR TO THE SURFACE |
| CIRCULAR SECTOR | CASE 1 | LOCATION OF ROTATION AXIS: PASSES THE CENTER OF GRAVITY OF THE CIRCULAR SECTOR AND THE PARALLEL TO THE SURFACE |
| | CASE 2 | LOCATION OF ROTATION AXIS: PASSES THE VERTEX OF THE CIRCULAR SECTOR ANDTHE PARALLEL TO THE SURFACE |
| RIGHT HEXAHEDRON | CASE 1 | LOCATION OF ROTATION AXIS: PASSES THE CENTER OF GRAVITY OF THE RIGHT HEXAHEDRON |
| RIGHT CIRCULAR COLUMN | CASE 1 | LOCATION OF ROTATION AXIS: PASSES THE CENTER OF TOP AND THE CENTER OF BOTTOM |
| | CASE 2 | LOCATION OF ROTATION AXIS: PASSES THE CENTER OF GRAVITY OF RIGHT CIRCULAR COLUMN AND PARALLEL TO THE TOP AND BOTTOM |
| RIGHT CONE | CASE 1 | LOCATION OF ROTATION AXIS: PASSES THE CENTER OF GRAVITY OF RIGHT CONE AND PARALLEL TO THE BASE |
| | CASE 2 | LOCATION OF ROTATION AXIS: PASSES THE VERTEX OF RIGHT CONE AND THE CENTER OF THE BASE |
| SPHERE/ SPHERICAL SURFACE | CASE 1 | LOCATION OF ROTATION AXIS: PASSES THE CENTER OF SPHERE |
| | CASE 2 | LOCATION OF ROTATION AXIS: PASSES THE CENTER OF SPHERE SURFACE |
| SPHERE SECTOR | CASE 1 | LOCATION OF ROTATION AXIS: PASSES THE CENTER OF GRAVITY OF SPHERICAL SECTOR AND THE VERTEX OF SPHERICAL SECTOR |
| TORUS | CASE 1 | LOCATION OF ROTATION AXIS: PASSES THE CENTER OF TORUS |

SHOCK ABSORBER SELECTION PROCESS

SYSTEM FOR AND METHOD OF SELECTING PNEUMATIC DEVICE, AND RECORDING MEDIUM

BACKGROUND OF THE INVENTION

1. Field of the Invention

The present invention relates to a system for and a method of selecting a pneumatic device, and a recording medium, and more particularly to a system for and a method of selecting an optimum pneumatic device which satisfies specified conditions, and a recording medium which stores a program for selecting such a pneumatic device.

2. Description of the Related Art

In order to construct a pneumatic system, i.e., a terminal system including components from a directional control valve to an air cylinder, which is specified by a user, there has been devised a slide rule for designing a pneumatic pressure control system, as disclosed in Japanese patent publication No. 53-21320.

The disclosed slide rule has fixed and slidable scales marked on face and back sides of the slide rule with graduations to satisfy a formula for determining a stroke time, a formula for determining a cylinder output, a formula for determining an amount of air consumed by the cylinder and a tube connected thereto, and other formulas. In combination with cursor operations, the slide rule can quickly calculate specifications required for designing the pneumatic pressure control system.

Heretofore, it has been customary to select pneumatic devices according to approximate simple calculations on the slide rule because accurate dynamic simulations of a desired pneumatic pressure control system have not been possible. Therefore, the results of a conventional process of selecting pneumatic devices satisfy required values with considerably low probability, making it impossible to construct a desired pneumatic pressure control system of a minimum group of pneumatic devices and to achieve a minimum energy consumption and a minimum cost.

For the above reasons, there has been a demand for a process of quickly selecting a group of optimum pneumatic devices which satisfy conditions specified by the user, using highly accurate and reliable calculating methods. For selecting a pneumatic device, it is necessary to satisfy (1) a load condition (a dynamic condition for a selected system to operate sufficiently under input conditions, such as a load mass and thrust, an application, and a supplied air pressure, of a specified operating unit (pneumatic actuator)), (2) a velocity condition (a condition for a selected system to reach a stroke end of an output member (e.g., the piston of a cylinder) of a pneumatic actuator within a specified full stroke time), (3) a strength condition (a condition for a selected system to satisfy the specified load condition while preventing the pneumatic actuator from being buckled, deformed, or broken), and (4) a connecting condition (a condition for devices making a selected system to be connected normally).

The applicant of the present application has proposed a method of selecting a pneumatic device in order to satisfy the above conditions (e.g., see Japanese laid-open patent publication No. 2000-179503). The proposed method is advantageous in that it can select a pneumatic device highly accurately by using a dynamic characteristic analyzing process, unlike a conventional effective cross-sectional area method.

Usually, moisture condensation in a cylinder operating system refers to moisture condensation which is caused by compressed air adjusted in humidity while the cylinder is in operation. The moisture condensation occurs in two different phenomena, i.e., internal moisture condensation and external moisture condensation. The internal moisture condensation is a phenomenon in which humidity in the air is condensed within pneumatic devices or tubes due to a drop in the temperature of the air. The external moisture condensation is a phenomenon in which the air at a low temperature cools pneumatic devices which it contacts, condensing humidity contained in the air on outer surfaces of the pneumatic devices.

It is generally known that moisture condensation is basically caused by a reduction in the temperature of the air due to an adiabatic change of the air. In addition to the different phenomena of internal moisture condensation and external moisture condensation, the moisture condensation also occurs as moisture condensation on smaller-size cylinders and moisture condensation on larger-size cylinders.

It has been customary in the art to consider only a supply pressure, the size of a cylinder, and the size of a tube connected to the cylinder as elements that are involved in moisture condensation. Specifically, the volume of the tube is selected to be smaller than the volume of the cylinder for sufficiently mixing the remaining air in the cylinder and the tube with supplied fresh air and discharging the remaining air. Generally, the volumes of the cylinder and the tube are selected to satisfy the following formula:

$$\text{Volume of the air in the cylinder as converted under the atmospheric pressure} \times 0.7 \geqq \text{internal volume of the tube}$$

As shown in FIG. 21 of the accompanying drawings, it is judged that moisture condensation will take place if the volume ratio is smaller than 1/0.7, and no moisture condensation will take place if the volume ratio is greater than 1/0.7.

The above formula takes into account only the supply pressure, the size of the cylinder, and the size of the tube.

Since it has been the conventional practice to determine whether moisture condensation will occur or not solely based on the volume ratio of 1/0.7, moisture condensation may possibly be expected to occur even if it will not actually take place.

Accordingly, the user needs to determine whether moisture condensation will occur or not based on their experience after predictions have been made based on the above formula.

Generally, when the user selects a shock absorber to be used, the user establishes physical equations depending on the style of the impact that is expected, determines an impact velocity and a thrust force according to the physical equations, determines kinetic energy, thrust energy, and absorption energy based on the impact velocity and the thrust force, calculates an impact object equivalent mass from the absorption energy, compares the calculated impact object equivalent mass with an impact object equivalent mass calculated from data inherent in each candidate device, and determines whether the impact object equivalent mass is in an allowable range or not, and selects a shock absorber based on the decision.

According to the above process, the various data need to be calculated again when the style of the impact and conditions in use of a shock absorber are changed even slightly.

Since the data have to be determined based on complex and cumbersome calculations, it takes a long period of time to select a shock absorber. Sometimes, the user has relied on empirical selection of shock absorbers in order to avoid the above tedious and time-consuming selecting procedure.

SUMMARY OF THE INVENTION

An object of the present invention is to provide a system for and a method of selecting a pneumatic device, and a recording medium, utilizing functions for effectively improving the accuracy of the selection, and an improved user interface for selecting various devices.

Another object of the present invention is to provide a system for and a method of selecting a pneumatic device, and a recording medium, which are capable of automatically and individually performing the prediction of an occurrence of moisture condensation that has been carried out empirically.

Still another object of the present invention is to provide a system for and a method of selecting a pneumatic device, and a recording medium, which are capable of automatically and easily performing the selection of a shock absorber that has been carried out empirically, thereby greatly reducing the time required to select a shock absorber.

According to the present invention, there is provided a system for selecting a pneumatic device, comprising a computer, a database connected to the computer and storing data of at least pneumatic devices, an input unit connected to the computer, for entering input data based on an input action of an operator into the computer, a display unit connected to the computer, for displaying information from the computer, a first selection processor for selecting a cylinder operating system based on input data from the input unit, and a second selection processor for selecting a shock absorber based on input data from the input unit and/or a selection result from the first selection processor.

The above arrangement provides more functions than the proposed method of selecting a pneumatic device (see Japanese laid-open patent publication No. 2000-179503), improves calculation processes, and increases the accuracy with which to select a pneumatic device.

The first selection processor may comprise a circuit setting processor for setting a pneumatic circuit based on input data from the input unit, a device selection processor for automatically selecting a device which is related to the pneumatic circuit and satisfies usage conditions entered through the input unit, based on information about devices registered in the database, and a characteristic calculation processor for calculating characteristics of the cylinder operating system based on a device selected through the input unit and the pneumatic circuit.

The first selection processor may have a display processor for displaying a first setting area for setting pneumatic circuit and a second setting area for entering the usage conditions. The operator can enter usage conditions in the second setting area while viewing circuit settings in the first setting area. Therefore, the operator can make settings with improved efficiency.

The first selection processor may have a display processor for displaying, in graphs, characteristic values obtained by the characteristic calculation processor. The operator can thus visually recognize characteristic values as an image, and easily make a comparison between those characteristic values and characteristic values of other settings.

The first selection processor may have a display processor for displaying at least the pneumatic circuit, information of the selected device, the entered usage conditions, and characteristic values obtained by the characteristic calculation processor. Since the pneumatic circuit, the information of selected devices, the entered usage conditions, and the characteristic values obtained by the characteristic calculation processor are displayed as the results determined by the first selection processor, the operator can confirm the set information at a glance, and quickly verify the information for circuit design.

The circuit setting processor may have a display processor for displaying a list of information related to devices which satisfy the usage conditions based on a circuit configuration request, together with a circuit configuration diagram. Usually, because a circuit designing process empirically sets circuits which satisfy usage conditions, it takes a very long period of time to achieve an optimum circuit through the circuit designing process. However, inasmuch as the circuit setting processor according to the above arrangement automatically selects various devices which satisfy usage conditions and displays a list of those devices, the period of time required to select an optimum device is shortened because the operator can select one from a list of devices while viewing a circuit configuration diagram.

The first selection processor may have a display processor for displaying a selection area for selecting devices related to the pneumatic circuit according to guidance instructions, and input area for entering the usage conditions in a sequence specified by the operator.

Thus, even in a setting process with complex procedures, the operator can easily and efficiently perform a setting process simply by selecting items, for example, according to guidance instructions.

The device selection processor may have a display processor for displaying a list of devices which are related to the pneumatic circuit and satisfy the entered usage conditions, and displaying at least outer profile images and specifications of devices selected from the displayed list of devices.

Usually, a process of selecting a device recognizes and empirically extracts various data of various devices, and has been problematic in that it takes a long period of time to select a device. However, since the above device selection processor automatically selects and displays a list of devices which satisfy usage conditions, and also displays at least outer profile images and specifications of devices selected from the displayed list of devices, the time required to select devices is reduced because the operator can select optimum devices from the displayed list of devices while viewing outer profile images and specifications thereof.

The various display processors described above allow the operator to select various devices simply and efficiently based on a GUI (Graphical User Interface) while viewing displayed images.

The first selection processor may have an independent characteristic calculation processor for calculating characteristics of the cylinder operating system based on a pneumatic circuit based on input data from the input unit and calculating characteristics of the cylinder operating system based on the pneumatic circuit, a device selected in relation to the pneumatic circuit, and usage conditions entered through the input unit.

In the process of selecting devices for a cylinder operating system which satisfy entered conditions, if the usage conditions are changed or desired usage conditions are set, the set data in the process of selecting devices do not need to be reset, but the independent characteristic calculation processor can independently select devices which satisfy the new usage conditions. Therefore, unnecessary operations such as resetting data may be eliminated.

The usage conditions may include a needle opening of an adjustable flow control equipment such as a speed controller, a speed exhaust controller, or the like. The operator can thus easily check if a full stroke time and a cushioning capability satisfy a demand while adjusting the opening, as is the case with the adjustment of an actual device.

The independent characteristic calculation processor may have a display processor for displaying a third setting area for setting the pneumatic circuit, a fourth setting area for entering the usage conditions, and a fifth setting area for entering an identification number of a device to be used. Alternatively, the independent characteristic calculation processor may have a display processor for displaying at least the pneumatic circuit, information of the selected device, the entered usage conditions, and obtained characteristic values. Further alternatively, the independent characteristic calculation processor may have a display processor for displaying a list of information related to devices which satisfy the usage conditions based on a request of a circuit configuration, together with a circuit configuration diagram.

The various display processors described above allow the operator to select various devices simply and efficiently with the independent characteristic calculation processor.

The system may comprise a cushion calculation processor for calculating an energy to be absorbed by a cylinder based on the calculated characteristics of the cylinder operating system. Thus, it is possible to judge the cushioning capability of the cylinder operating system which is constructed of the various selected devices.

The system may further comprise a moisture condensation calculation processor for calculating the probability of moisture condensation produced in the cylinder operating system based on the calculated characteristics of the cylinder operating system and humidity information entered through the input unit.

Usually, moisture condensation in a cylinder operating system refers to moisture condensation which is caused by compressed air that has been adjusted in humidity while the cylinder is in operation. The moisture condensation occurs in two different phenomena, i.e., internal moisture condensation and external moisture condensation. The internal moisture condensation is a phenomenon in which humidity in the air is condensed within pneumatic devices or tubes due to a drop in the temperature of the air. The external moisture condensation is a phenomenon in which the air at a low temperature cools pneumatic devices which it contacts, condensing humidity contained in the air on outer surfaces of the pneumatic devices.

The probability of moisture condensation produced in the cylinder operating system is calculated by the moisture condensation calculation processor. Since a countermeasure against moisture condensation can be reviewed based on the calculated results, the reliability of the selected cylinder operating system in use can be increased.

The second selection processor may comprise a type setting processor for setting a type of shock absorbers based on input data from the input unit, a condition setting processor for setting at least an impact style and usage conditions based on input data from the input unit, and a shock absorber selection processor for selecting a shock absorber of optimum size from the type of shock absorbers based on at least the impact style and the usage conditions.

The condition setting processor may automatically set at least an impact condition set by the first selection processor.

The system may further comprise a list registration processor for registering, in advance, input values that are used highly frequently in a reference list which corresponds to input items used to select the cylinder operating system and the shock absorber with the first and second selection processors. The reference list may be used to refer to values that are used highly frequently for entering settings, so that the time required to enter data can be shortened efficiently.

The system may further comprise a selection processor for selecting a list of the system of units based on input data from the input unit among a plurality of lists for which the system of units to be used are registered in advance. Thus, the system of units may be selected at the time of entering data, thus permitting entered numerical values to be used as they are without the need for converting units.

According to the present invention, there is also provided a system for selecting a pneumatic device, comprising a computer, an input unit connected to the computer, for entering input data based on an input action of an operator into the computer, a display unit connected to the computer, for displaying information from the computer, and a moisture condensation calculation processor for calculating the probability of moisture condensation produced in a cylinder operating system based on characteristics of the cylinder operating system and humidity information entered through the input unit.

With the above arrangement, moisture condensation in a cylinder operating system can automatically be predicted individually specifically, rather than being empirically as is the case with the conventional process. Accordingly, moisture condensation can be predicted depending on a selected cylinder operating system, and the reliability of the selected cylinder operating system in use can be increased.

The moisture condensation calculation processor may calculate the probability of moisture condensation using sizes of a cylinder and a tube of the cylinder operating system, and the humidity, temperature, and pressure of air supplied to the cylinder operating system.

Alternatively, the moisture condensation calculation processor may calculate the probability of moisture condensation by calculating an amount of mist produced in the cylinder operating system and a volume ratio between the cylinder and the tube (a ratio between the volume of the cylinder and the volume of the tube) from selected devices or calculated characteristics of the cylinder operating system. Alternatively, the moisture condensation calculation processor may judge that no moisture condensation occurs in the cylinder operating system if the volume of the air in the cylinder as converted under the atmospheric pressure≧internal volume of the tubexa critical amount of mist. These processes make it possible to determine moisture condensation with greater accuracy.

The system may further comprise a display processor for displaying at least a moisture selection area for selecting an air humidity based on input data from the input unit, and an area for displaying the value of the probability of moisture condensation.

The operator is thus capable of efficiently selecting an air humidity while confirming the probability of moisture condensation.

According to the present invention, there is further provided a system for selecting a pneumatic device, comprising a computer, a database connected to the computer and storing data of at least pneumatic devices, an input unit connected to the computer, for entering input data based on an input action of an operator into the computer, a display unit connected to the computer, for displaying information from the computer, a type setting processor for setting a type of shock absorbers based on input data from the input unit, a condition setting processor for setting at least an impact style and usage conditions based on input data from the input unit, and a shock absorber selection processor for selecting a shock absorber of optimum size from the type of shock absorbers based on at least the impact style and the usage conditions.

Usually, a shock absorber is empirically selected by recognizing various data of various devices, and such a process takes a very long period of time to select a shock absorber. However, the above system for selecting a pneumatic device can automatically and easily select a shock absorber of minimum size which matches any desired cylinder operating system, and also a shock absorber of minimum size which matches a cylinder operating system that has been selected otherwise. Consequently, the time required to select a shock absorber is greatly reduced.

The condition setting processor may automatically set at least an impact condition set in selecting devices of a cylinder operating system. The system may thus be linked with the cylinder operating system, so that the time required to enter data can greatly be reduced.

The system may further comprise a display processor for displaying a condition setting area for setting at least the impact style and the usage conditions, and an image display area for displaying an image of a selected shock absorber.

The above display processor allows the operator to enter an impact style and a thrust type easily while viewing an image of a shock absorber. The time required to enter an impact style and a thrust type is therefore reduced.

The image display area may comprise a first area for displaying an image of an appearance of the selected shock absorbers, and a second area for displaying an impact image in animation. Since an impact image is displayed in animation for each impact style, the operator can easily recognize the impact image, finding it easy to enter items.

The condition setting processor may have a moment calculation processor for calculating an inertial moment based on input data from the input unit if a set impact style is a rotational impact mode. Therefore, a shock absorber which matches a rotational impact can be selected with accuracy.

The moment calculation processor may have a load type selection processor for selecting a load type based on input data from the input unit. The load type selection processor may have a display processor for displaying a list of shapes of load types and a setting area for selecting a rotational axis. Since data can easily be entered for calculating a moment in relation to a rotational impact, the time required to select a shock absorber can efficiently be reduced.

The system may further comprise a display processor for displaying calculation results including an absorption energy and an impact object equivalent mass, a list of model numbers of selected shock absorbers according to a sequence of maximum absorption energies, and a mounting dimension diagram and major specifications of a shock absorber selected from the list of model numbers. The selection processor allows the operator to confirm, at a glance, the dimensions, specifications, and various characteristics of the selected shock absorber, and to easily verify the selected shock absorber.

The system may further comprise a list registration processor for registering, in advance, input values that are used in a reference list which corresponds to input items used to select the shock absorber. The reference list may be used to refer to values that are used for entering settings, so that the time required to enter data can be shortened efficiently.

The system may further comprise a selection processor for selecting a list of the system of units based on input data from the input unit among a plurality of lists for which the system of units to be used are registered in advance. At the time of entering numerical values, the system of units is selected, dispensing with the need for converting units, and the numerical values that have been entered can be used as they are. Therefore, the trouble of unit conversions at the time of entering numerical value is eliminated.

The above and other objects, features, and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 2 is a diagram showing a menu screen;

FIG. 28A is a diagram showing a physical model of a cylinder operating system;

FIG. 28B is a diagram showing basic equations for a restriction;

FIG. 28C is a diagram showing basic equations for an air cylinder;

FIG. 34A is a diagram showing a tube line model used in characteristic calculations;

FIG. 34B is a diagram showing basic equations for a tube line;

FIG. 34C is a diagram of a tube line discrete model of an ith element of divided n elements of the tube line;

FIG. 34D is a diagram showing basic equations for the ith element of the tube line;

FIG. 35 is a diagram showing explanations of symbols and suffixes in the basic equations shown in FIGS. 28A through 28C and FIGS. 34A through 34D;

FIG. 38 is a flowchart of a processing sequence of a moisture condensation calculation processor;

FIG. 47 is a diagram showing the relationship between impact styles and thrust types to be selected and calculation formulas;

FIG. 48 is a diagram showing calculation formulas for linear impact, free mounting, and cylinder drive;

FIG. 49 is a diagram showing calculation formulas for linear impact, free mounting, and motor drive;

FIG. 50 is a diagram showing calculation formulas for linear impact, free mounting, and slope dropping;

FIG. 51 is a diagram showing calculation formulas for linear impact, free mounting, and other thrust;

FIG. 52 is a diagram showing calculation formulas for rotation impact and cylinder drive;

FIG. 53 is a diagram showing calculation formulas for rotation impact and motor drive;

FIG. 54 is a diagram showing calculation formulas for rotation impact and other thrust;

FIG. 55 is a diagram showing calculation formulas for rotation impact and slope dropping;

FIG. 59 is a table of load configurations and rotational patterns;

DESCRIPTION OF THE PREFERRED EMBODIMENT

Figure 1:
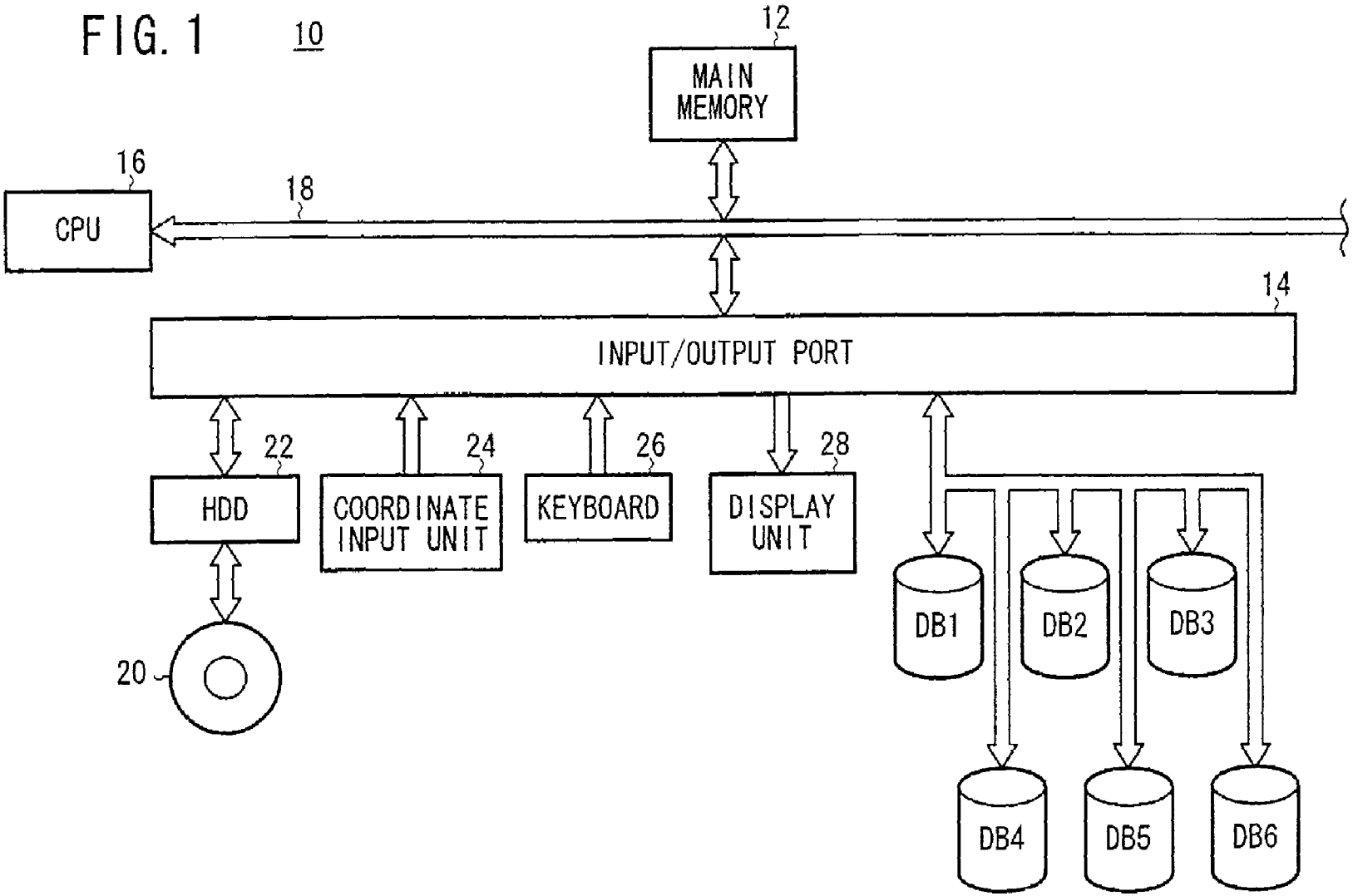
FIG. 1 is a block diagram of a pneumatic device selecting system according to the present invention.

As shown in FIG. 1, a pneumatic device selecting system 10 according to the present invention has a main memory 12 for storing a program and transferring data, an input/output port 14 for exchanging data with external devices, and a CPU 16 for executing the program. The main memory 12, the input/output port 14, and the CPU 16 are connected to each other by a system bus 18.

To the input/output port 14, there are connected at least a hard disk drive (HDD) 22 for accessing a hard disk 20 based on instructions from the CPU 16, a coordinate input unit (e.g., a mouse) 24 operable by the user, a keyboard 26 operable by the user to enter data, a display unit 28 for displaying images generated by the program and images recorded on the hard disk 20, and a plurality of databases DB1 through DB6.

The databases DB1 through DB6 include a first database DB1 storing information about cylinders, a second database DB2 storing information about solenoid valves and silencers, a third database DB3 storing information about drive devices, a fourth database DB4 storing information about tubes, a fifth database DB5 storing information about fittings, and a sixth database DB6 storing information about shock absorbers.

The hard disk 20 records thereon an OS, application programs, and various data. The application programs include an existing document generating program, an existing table calculation program, and a pneumatic device selecting program 50 (see FIG. 3) for carrying out a pneumatic device selecting method according to the present invention.

When the program 50 is activated, it displays a menu screen 52 shown in FIG. 2 on the display unit 28. The menu screen 52 includes at least three items, i.e., "SELECTION OF CYLINDER OPERATING SYSTEM", "SELECTION OF SHOCK ABSORBER", and "VARIOUS SETTINGS". The item "VARIOUS SETTINGS" includes a general-purpose master for registering input values in a drop-down list of input items for the selection of a cylinder operating system and the selection of a shock absorber, and a unit master for selecting the unit standard to be used.

Figure 3:
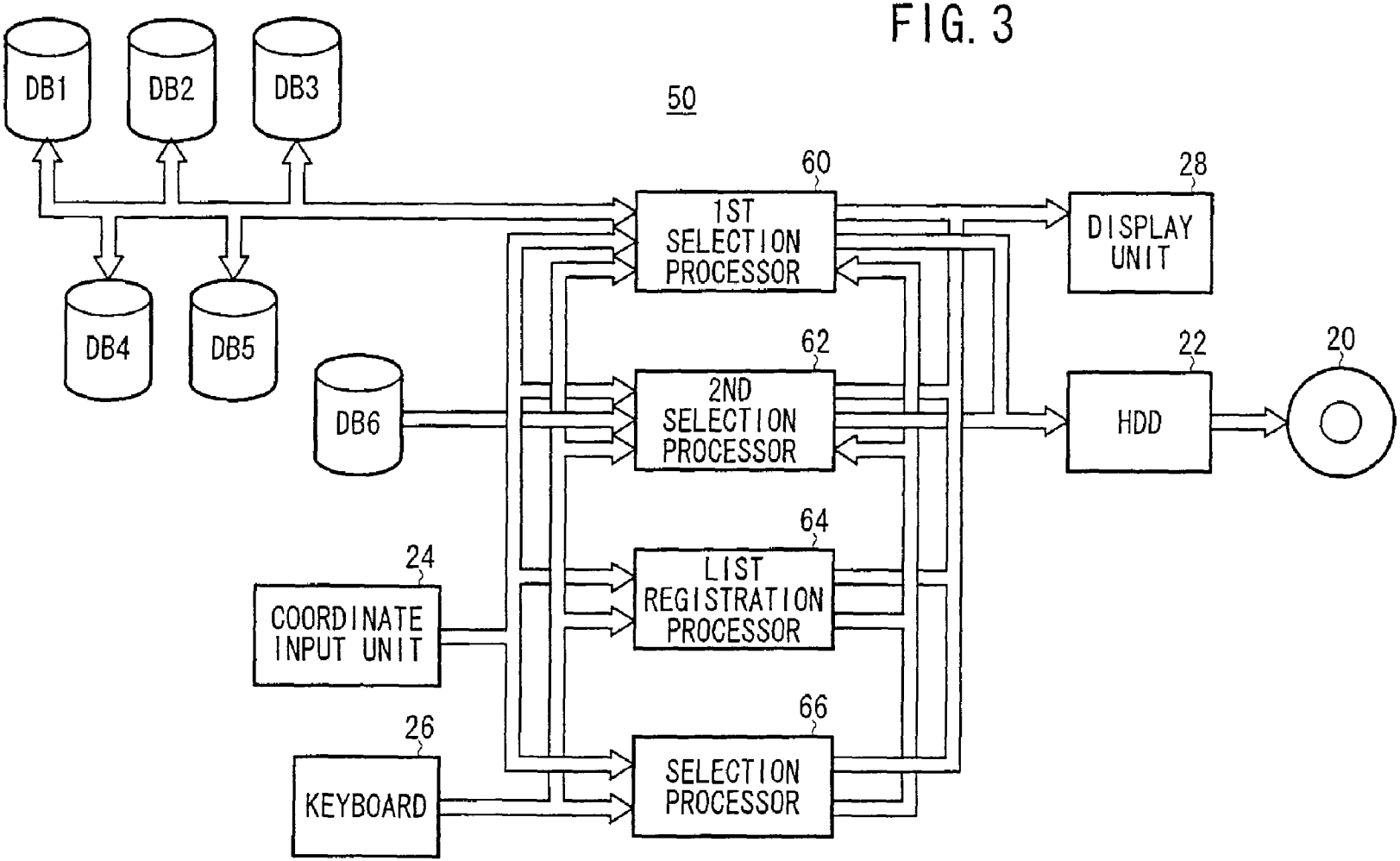
FIG. 3 is a functional block diagram of the pneumatic device selecting system according to the present invention.

As shown in FIG. 3, the program 50 has a first selection processor 60 for selecting a cylinder operating system based on input data from the coordinate input unit 24 or the like, a second selection processor 62 for selecting a shock absorber based on input data from the coordinate input unit 24 and/or the selected result from the first selection processor 60, a list registration processor 64 for providing the general-purpose master, and selection processor 66 for selecting the system of units.

The first selection processor 60 has a function to automatically select the model numbers of a cylinder, a solenoid valve, a speed control valve, and a tube which are of optimum and minimum sizes, based on entered usage conditions.

The second selection processor 62 has a function to select a shock absorber optimally according to entered usage conditions and impact conditions. The second selection processor 62 is capable of handling various impact patterns including linear impact, rotation impact, cylinder drive, motor drive, and free dropping.

Figure 4:
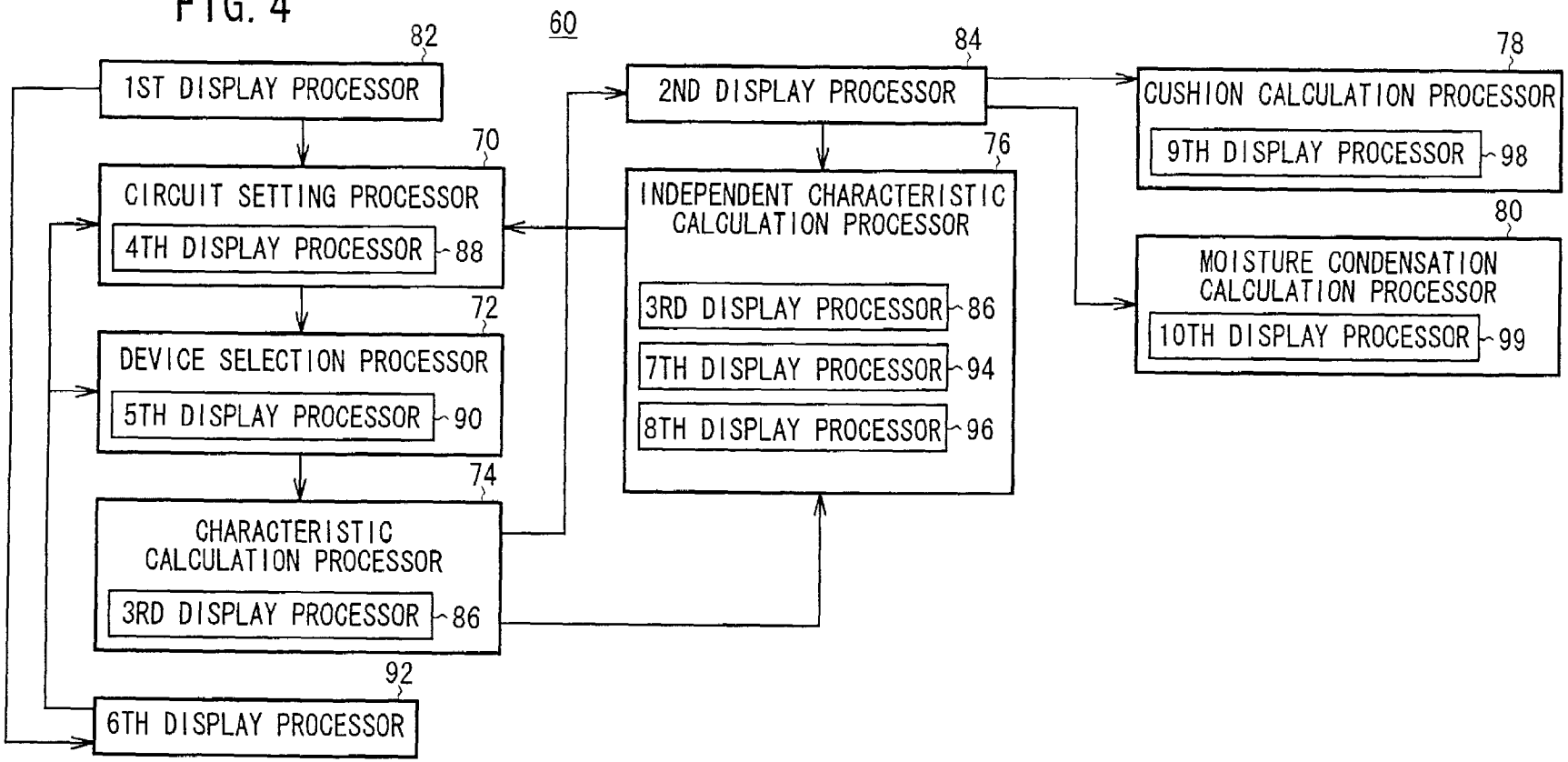
FIG. 4 is a functional block diagram of a first selection processor.

As shown in FIG. 4, the first selection processor 60 has a circuit setting processor 70 for setting a pneumatic circuit configuration based on input data from the coordinate input unit 24 or the like, a device selection processor 72 for automatically selecting a device which satisfies usage conditions entered through the coordinate input unit 24 or the like, based on information about devices registered in various databases, and a characteristic calculation processor 74 for calculating characteristics of a cylinder operating system based on a device selected through the coordinate input unit 24 or the like and the pneumatic circuit.

The first selection processor 60 executes a dynamic characteristic analyzing process for solving simultaneous equations composed of basic equations of fluid dynamics considering tubes, rather than a standard process according to a conventional combined effective area method, and is capable of accurately calculating characteristic differences due to different mounting positions of a speed controller.

The first selection processor 60 has an independent characteristic calculation processor 76 for calculating characteristics of the cylinder operating system based on a pneumatic circuit determined based on input data from the coordinate input unit 24 or the like, a device selected in relation to the pneumatic circuit, and usage conditions entered through the coordinate input unit 24 or the like.

The independent characteristic calculation processor 76 has a function to calculate and display dynamic characteristics such as pressure, displacement, velocity, and acceleration, and characteristic values such as an amount of consumed air, when the model numbers of a used circuit, a cylinder, and a solenoid valve are entered. The independent characteristic calculation processor 76 allows the automatically selected results from the first selection processor (the selected results from the device selection processor 72) to be changed, or allows the user to select devices freely.

The first selection processor 60 also has a cushion calculation processor 78 for calculating an energy to be absorbed by a cylinder based on the cylinder operating system, and a moisture condensation calculation processor 80 for calculating the probability of moisture condensation produced in the cylinder operating system based on the calculated characteristics of the cylinder operating system and humidity information entered through the coordinate input unit 24 or the like.

The cushion calculation processor 78 has a function to calculate an absorption energy from the result of the device selection or characteristic calculations of the cylinder operating system, and determines the cushioning capability of a cylinder. The cushion calculation processor 78 can shift its operation to the second selection processor 62 for the selection of an optimum shock absorber. The cushion calculation processor 78 can achieve accurate calculations because it uses a stroke end velocity and a stroke end pressure (a velocity and a pressure at the time a load impinges upon a cushion if the cylinder has the cushion) according to dynamic characteristic calculations for the calculation of kinetic energy and thrust energy of the cylinder.

The moisture condensation calculation processor 80 uses a moisture condensation decision standard taking into account not only the sizes of a cylinder and a tube, but also the humidity, temperature, and pressure of the supplied air. The moisture condensation calculation processor 80 calculates a moisture condensation probability for predicting the possibility of moisture condensation because of the indefiniteness of a phenomenon of moisture condensation in experiments. Specifically, the moisture condensation calculation processor 80 calculates the amount of a water mist produced in the system and the volume ratio of the cylinder to the tube from the result of the device selection or characteristic calculations of the cylinder operating system.

The program 50 is applicable to not only typical double-acting cylinder/meter-out circuits, but also meter-in circuits, meter-out circuits, single-acting cylinder circuits, and circuits using quick exhaust valves.

In the program 50, the display and calculation of flow rate characteristics of pneumatic devices such as solenoid valves are in accordance with flow rate characteristic display process according to ISO6358.

Specifically, flow rate characteristics are displayed as a pair of sound velocity conductance and critical pressure ratio. The sound velocity conductance represents a value produced by dividing a passage mass flow rate of the device which is in a choked flow mode, by the product of an upstream absolute pressure and the density of a standard state. The critical pressure ratio refers to a pressure ratio (downstream pressure/upstream pressure) above which a choked flow is caused and below which a subsonic flow is caused.

The choked flow is a flow in which the upstream pressure is higher than the downstream pressure and the fluid velocity reaches a sound velocity in a certain portion of the device. The mass flow rate of a gas is proportional to the upstream pressure and does not depend on the downstream pressure. The subsonic flow refers to a flow equal to or higher than the critical pressure ratio. The standard state refers to a state of air having a temperature of 20° C., an absolute pressure of 0.1 MPa (=100 kPa=1 bar), and a relative humidity of 65%. In figures, the unit of the amount of air is displayed with an acronym ANR.

Figure 5:
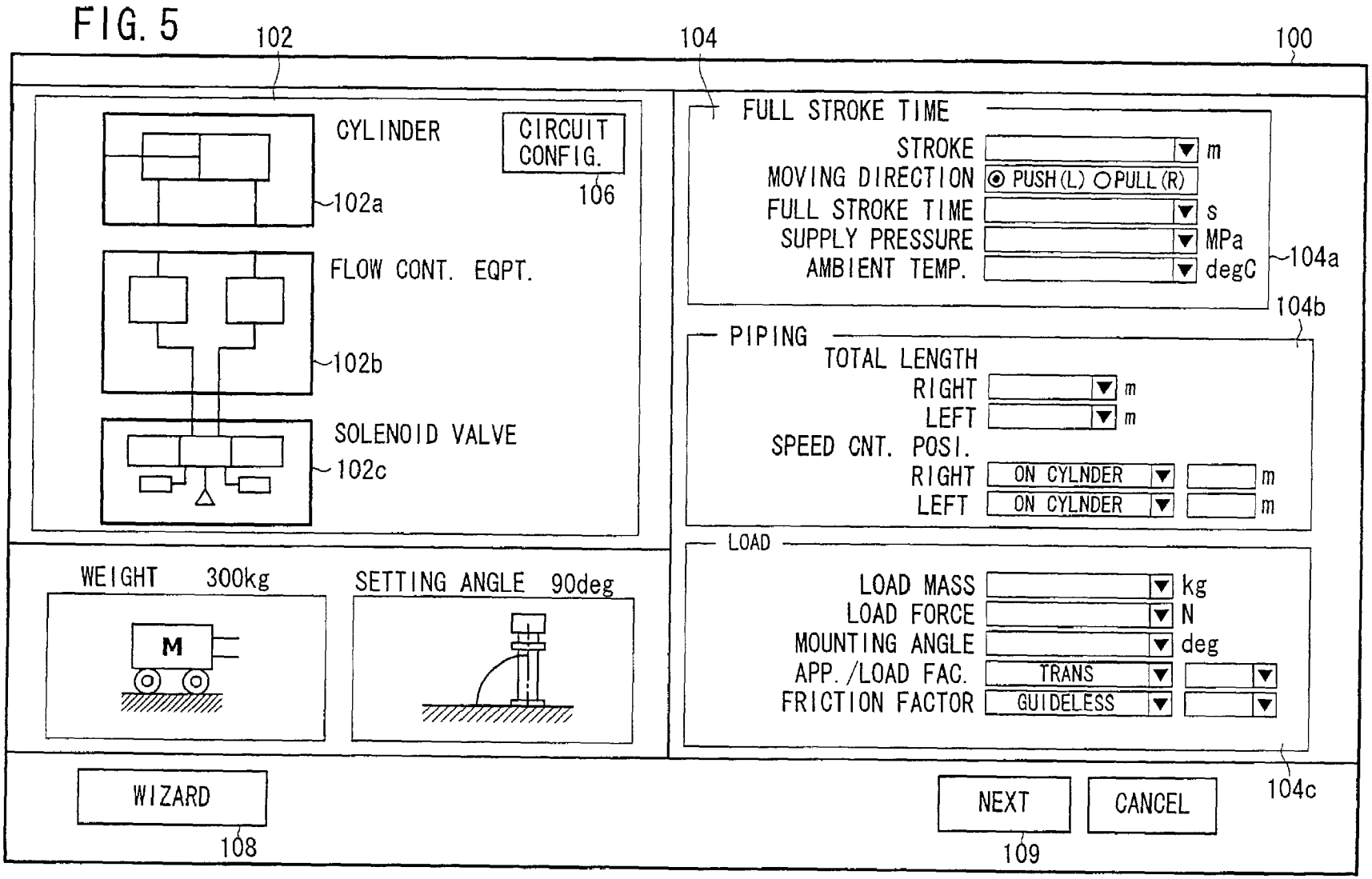
FIG. 5 is a diagram showing a displayed example of a device selection input screen.

The first selection processor 60 has a first display processor 82 for displaying a device selection input screen 100 (FIG. 5). As shown in FIG. 5, the screen 100 has a circuit setting area 102 for displaying a circuit configuration which is being set, and a condition setting area 104 for entering usage conditions.

The circuit setting area 102 displays a circuit diagram 102*a* corresponding to the type of a cylinder, a circuit diagram 102*b* corresponding to the type of a flow control equipment, a circuit diagram 102*c* corresponding to the type of a solenoid valve, and a circuit configuration request button 106 for activating the circuit setting processor 70 (see FIG. 4).

The condition setting area 104 is divided into three areas, i.e., an area 104*a* for a full stroke time, an area 104*b* for a tube, and an area 104*c* for a load. The area 104*a* displays input boxes for entering a stroke, a moving direction, a full stroke time, a supply pressure, and an ambient temperature. The area 104*b* displays input boxes for entering a total length (right, left) and a speed controller position (right, left). The area 104*c* displays input boxes for entering a load mass, a load force (requested thrust), a mounting angle, an application, a load factor, and a friction factor.

The full stroke time refers to a time consumed after the solenoid valve is energized (de-energized) until the piston (rod) of the cylinder reaches a stroke end. The load acting on the cylinder may be of various types including an inertial load, a force load, a resilient load, and a viscous load. According to the program 50, the inertial load and the force load used in the cylinder operating system are handled by the input items "LOAD MASS" and "LOAD FORCE".

The load force acting in the direction of operation of the piston is the sum of (1) a gravitational force component of the load mass, (2) a frictional force, and (3) another external force acting on the cylinder. According to the program 50, the load force is defined as a force load other than (1) and (2), i.e., the other external force acting on the cylinder. For example, if the application of the cylinder operating system is for transport, then the load mass is moved only, and there is no other load than the gravitational force component and the frictional force, so that the load force is "0".

If the application is for clamping an object or applying a pressure, then since a resistive force is imposed when an object is clamped or a pressure is applied, in addition to moving the load mass, a clamping force or an applied pressure is entered as the load force.

The load factor is defined according to the following equation:

$$\eta = \frac{\text{total load}}{\text{theoretical output}} \times 100\%$$

$$= \frac{\text{gravitational force component} + \text{frictional force} + \text{other force load}}{\text{piston area} + \text{supplied air pressure}} \times 100\%$$

The load factor is usually used as a safety margin for the cylinder output in static operations, and as a parameter for determining the velocity (acceleration) of the piston in dynamic operations. For example, the load factor is 0.7 or less for static operations, 1 or less for horizontal motion in dynamic operations, and 0.5 or less for vertical motion in dynamic operations. It is recommended that the load factor be further reduced for high-speed operations.

According to the program 50, since the velocity of the cylinder is automatically calculated and judged and the cylinder size is automatically changed, the user is not required to take into account the effect of the load factor on the velocity of the piston, but may consider the load factor as the safety margin for the cylinder output. Therefore, the process of entering data is simplified.

Figure 6:
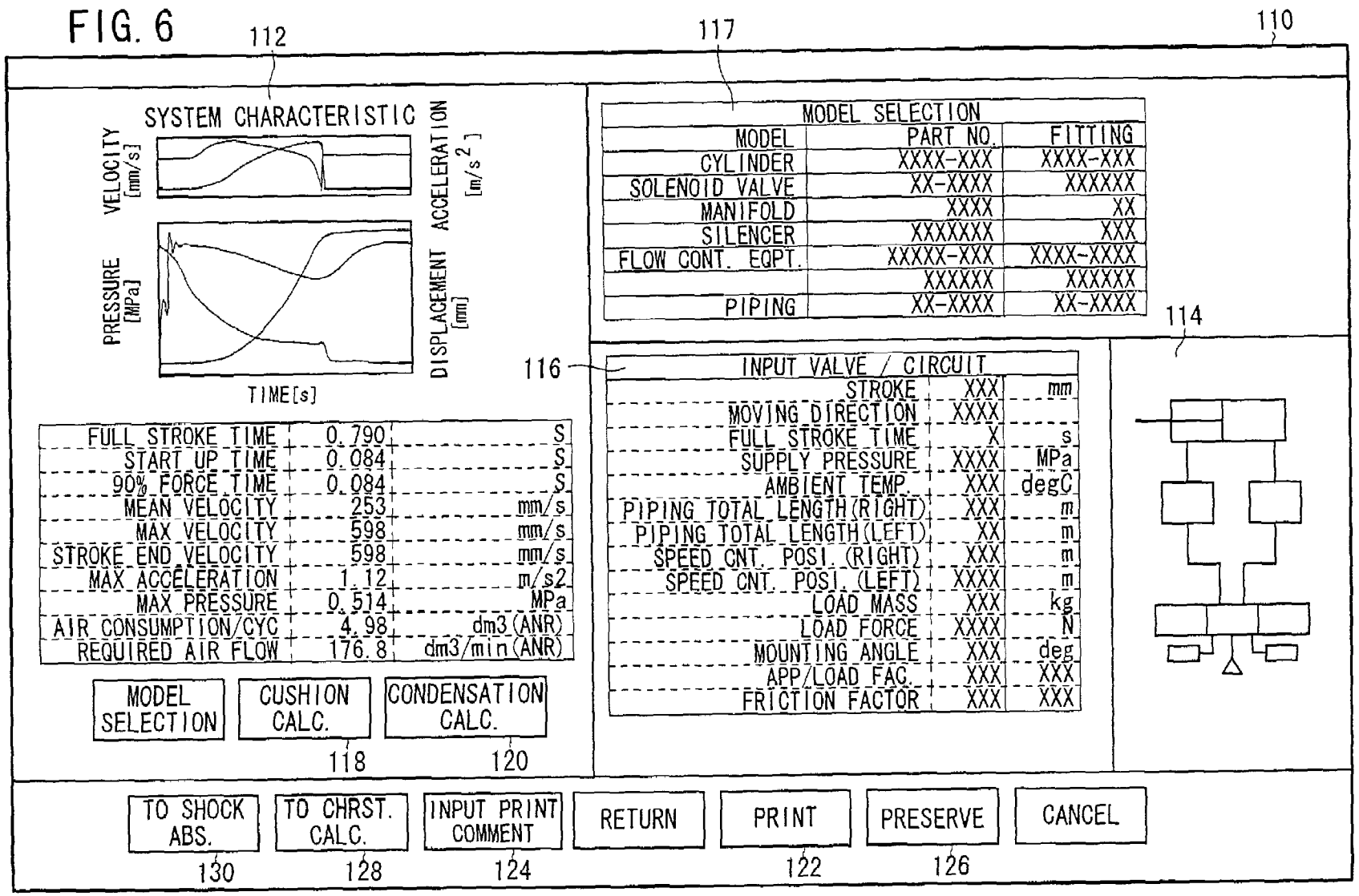
FIG. 6 is a diagram showing a displayed example of a device selection result screen.

As shown in FIG. 4, the first selection processor 60 has a second display processor 84 for displaying a device selection result screen 110 (see FIG. 6). As shown in FIG. 6, the screen 110 has a system characteristic display area 112 for displaying the dynamic behavior (graphic representation) and major characteristic values of a selected cylinder operating system, a circuit configuration display area 114 for displaying the circuit configuration diagram, a condition display area 116 for displaying entered usage conditions, and a model number display area 117 for displaying the model numbers of selected devices. The graphic representation in the system characteristic display area 112 is produced through a third display processor 86 in the independent characteristic calculation processor 76 based on the characteristic values obtained by the characteristic calculation processor 74.

As shown in FIG. 6, the displayed characteristic values include a full stroke time, a piston startup time, a 90% force time, a mean velocity, a maximum velocity, a stroke end velocity, a maximum acceleration, a maximum pressure, a maximum flow rate, an air consumption per cycle, and a required air flow rate.

The piston startup time is a time consumed after the solenoid valve is energized (de-energized) until the piston (rod) of the cylinder starts to move. The piston startup time is accurately determined by the time when an acceleration curve starts to rise.

The 90% force time is a time consumed after the solenoid valve is energized (de-energized) until the cylinder output force reaches 90% of a theoretical output value.

The mean velocity is represented by a value produced by dividing a stroke by the full stroke time. The stroke is the length per one stroke of the piston. The maximum velocity is represented by a maximum value of the piston velocity while the piston is in motion. The stroke end velocity is a piston velocity when the piston (rod) of the cylinder reaches a stroke end. If the cylinder has an adjustable cushion, then the stroke end velocity is a piston velocity at the inlet of the cushion, and is used to judge the cushioning capability and select a cushioning mechanism. The maximum acceleration refers to a maximum value of the piston acceleration while the piston is in motion. The maximum pressure is a maximum value of the air pressure in the piston.

The air consumption per cycle refers to an amount of air converted to a value in the standard state, which is required to move the cylinder in one cycle of reciprocating motion, and is determined according to the Boyle-Charles law. The air consumption per cycle includes an amount of air consumed by the cylinder itself and an amount of air consumed by the tube which interconnects the cylinder and the solenoid valve. If the cylinder is a double-acting cylinder, then the air consumption per cycle represents the sum of an amount of air discharged from the cylinder and an amount of air drawn into the cylinder. If the cylinder is a single-acting cylinder, then the air consumption per cycle represents an amount of air either discharged from or drawn into the cylinder.

The total air consumption of the system is determined by integrating the amounts of air consumed by all cylinders of the system according to an operation time chart of the system. The total air consumption is an important marker for recognizing the running cost of the system, and serves as a reference for selecting an air compressor while taking into account an appropriate safety margin.

The required air flow rate refers to an air flow rate to be supplied downstream to the system within a given time. Since the required air flow rate differs depending on the direction in which the cylinder operates, the required air flow rate of a greater value is used. If the system includes a plurality of cylinders, then a maximum value of the required air flow rates of the cylinders which operate simultaneously is used. The required air flow rate serves as a flow rate indicator for selecting the types and sizes of upstream components (FRL, a pressure-boosting valve, etc.) of the actuator system.

The screen 110 shown in FIG. 6 has icons simulating a plurality of operating buttons. The operating buttons simulated by these icons include a cushion calculation button 118 for requesting cushion calculations, a moisture condensation button 120 for requesting moisture condensation calculations, a print button 122 for requesting the printing of the results of the device selection, the cushion calculations, the moisture condensation calculations, and the usage conditions, a comment input button 124 for shifting to an input view for entering comments to be printed on a lower portion of the printed sheet, a save button 126 for requesting the saving of the results of the device selection, the cushion calculations, the moisture condensation calculations, and the usage conditions on a hard disk, or an optical disk such as a CD-R or a DVD-RAM, etc., a characteristic calculation button 128 for requesting a shift to an independent characteristic calculation process, and a shock absorber selection button 130 for requesting a shift to the second selection processor 62.

The circuit setting processor 70 of the first selection processor 60 has a fourth display processor 88. The fourth display processor 88 is activated when the circuit configuration request button 106 in the screen 100 shown in FIG. 5 is clicked, and displays a circuit configuration setting screen 140 shown in FIG. 7. The screen 140 displays a list of information (model numbers, etc.) of various devices together with a circuit configuration diagram.

Figure 7:
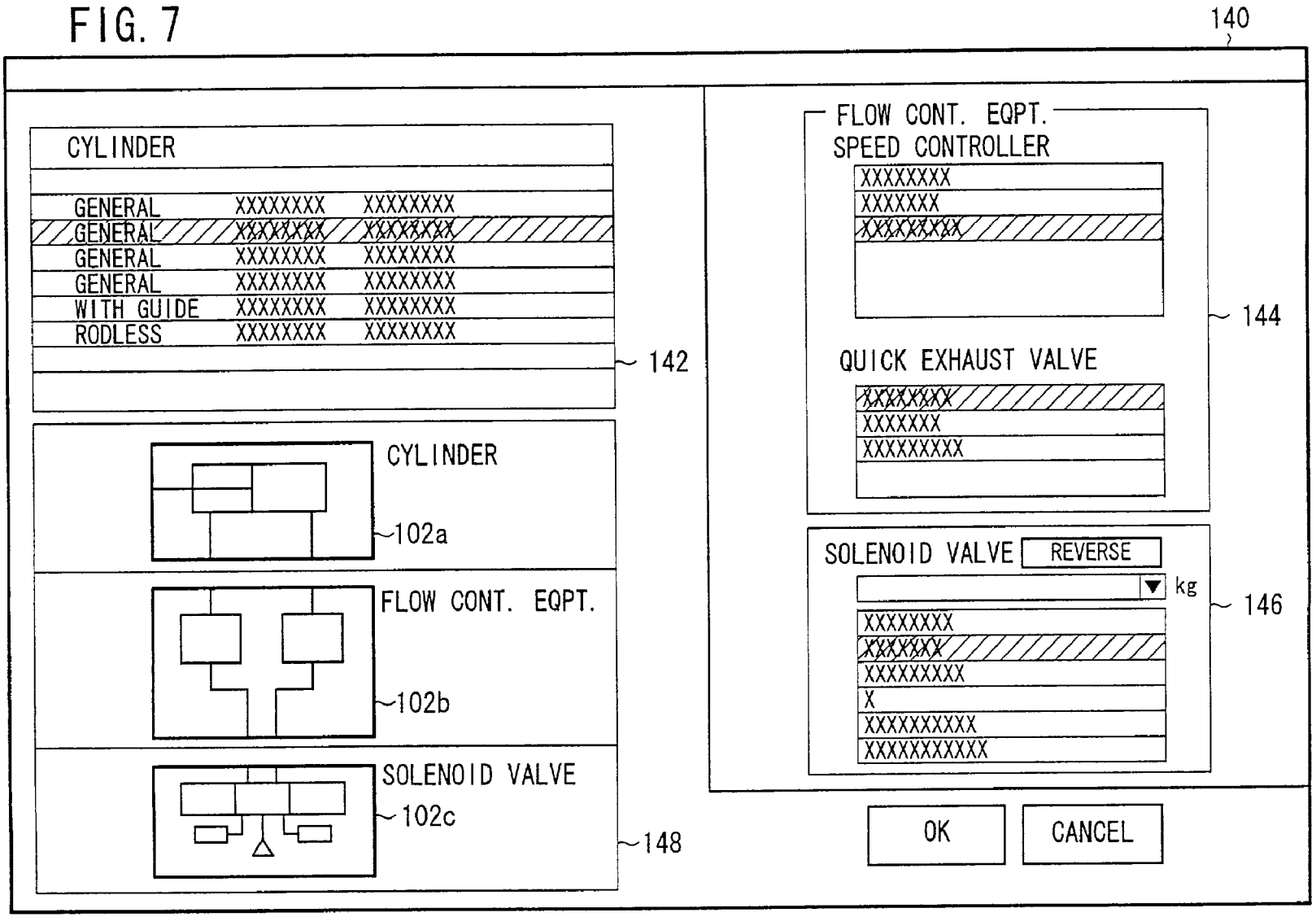
FIG. 7 is a diagram showing a displayed example of a circuit configuration setting screen.

Specifically, as shown in FIG. 7, the screen 140 has a cylinder display area 142 for displaying a list of cylinder classifications registered in the first database DB1, a flow control equipment display area 144 for displaying a list of flow control equipment classifications registered in the third database DB3, a solenoid valve display area 146 for displaying a list of solenoid valve classifications registered in the second database DB2, and a circuit display area 148 for displaying a circuit configuration diagram made up of a combination of graphic symbols (e.g., Japanese Industrial Standard (JIS) symbols) corresponding to selected devices.

As shown in FIG. 4, the device selection processor 72 has a fifth display processor 90 which is activated by the fourth display processor 88. The fifth display processor 90 displays a list of devices which satisfy entered usage conditions among the devices related to the pneumatic circuit, and displays at least outer profile images and specifications of devices selected from the displayed list of devices.

Figure 8:
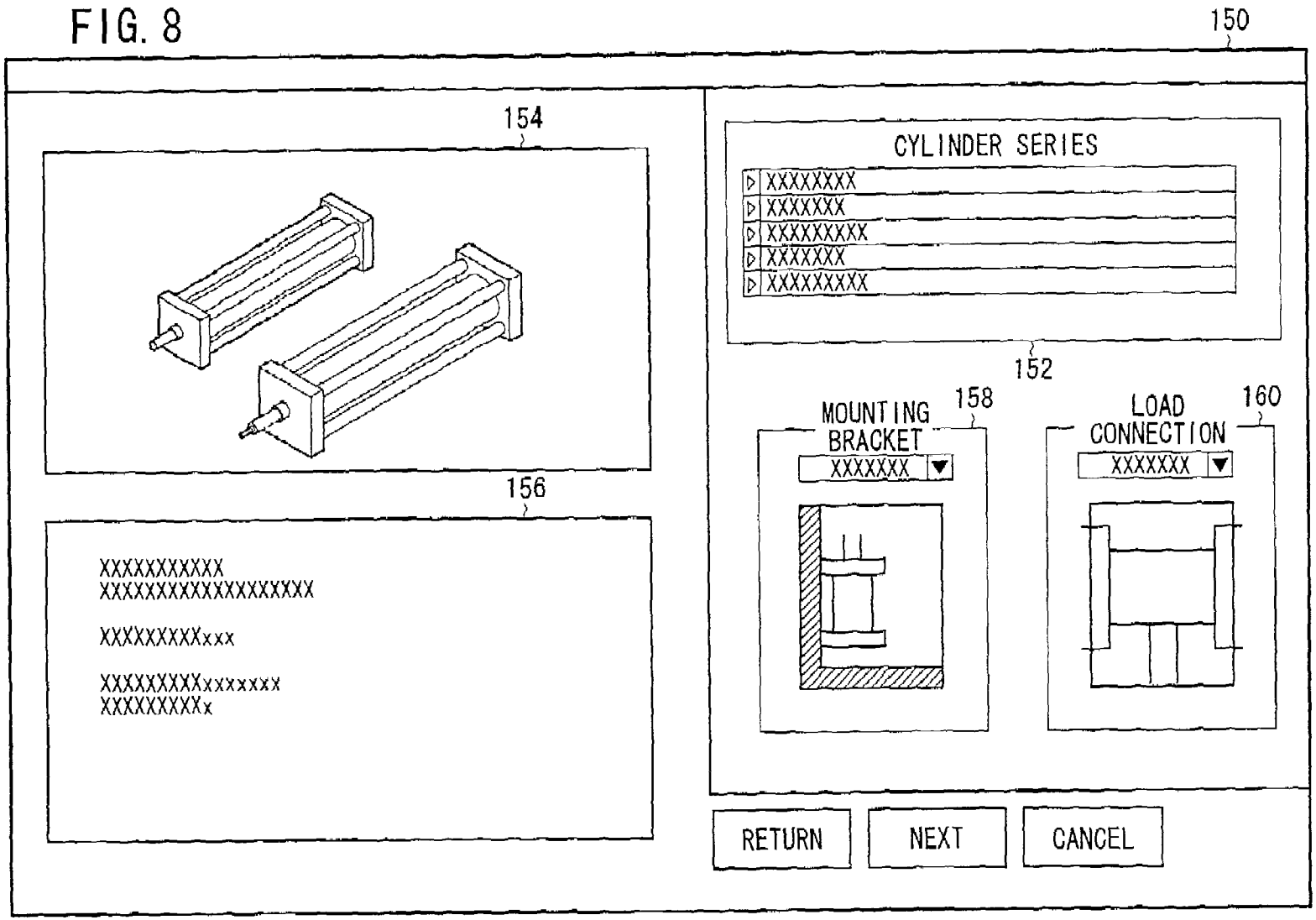
FIG. 8 is a diagram showing a displayed example of a cylinder selection screen.

For example, when one of the cylinder classifications displayed in the cylinder display area 142 is selected in the screen 140, the fifth display processor 90 displays a cylinder selection screen 150 shown in FIG. 8.

The screen 150 has a list display area 152 for displaying a list of information (e.g., model numbers) relative to cylinders which satisfy entered usage conditions among the cylinders contained in the selected cylinder classification, an image display area 154 for displaying an image (e.g., a photographic image or a computer graphic image) of a cylinder corresponding to a model number which is selected from the displayed model numbers by the user, a description display area 156 for displaying a description of the specifications of the cylinder corresponding to the selected model number, a first type selector 158 for selecting a mounting type for the cylinder, and a second type selector 160 for selecting a load connection type for the cylinder. In the screen 150, the user selects the model number of a cylinder, and also selects a mounting type and a load connection type for the cylinder.

Figure 9:
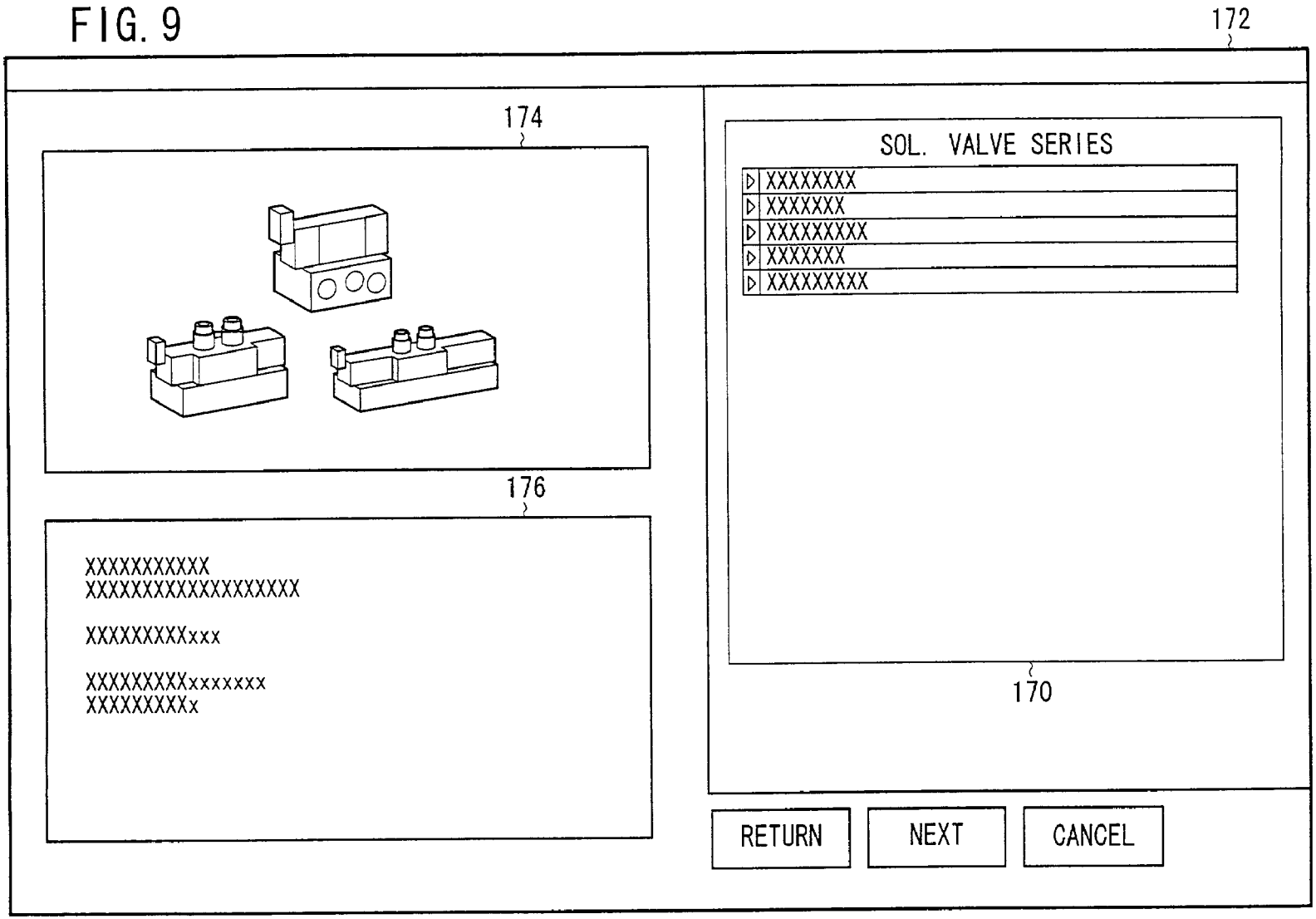
FIG. 9 is a diagram showing a displayed example of a solenoid valve selection screen.

When one of the solenoid valve classifications displayed in the solenoid valve display area 146 is selected in the screen 140 shown in FIG. 7, the fifth display processor 90 displays a solenoid valve selection screen 170 shown in FIG. 9.

The screen 170 has a list display area 172 for displaying a list of information (e.g., model numbers) relative to solenoid valves which satisfy entered usage conditions among the solenoid valves contained in the selected solenoid valve classification, an image display area 174 for displaying an image (e.g., a photographic image or a computer graphic image) of a solenoid valve corresponding to a model number which is selected from the displayed model numbers by the user, and a description display area 176 for displaying a description of the specifications of the solenoid valve corresponding to the selected model number. In the screen 170, the user selects the model number of a solenoid valve.

Figure 10:
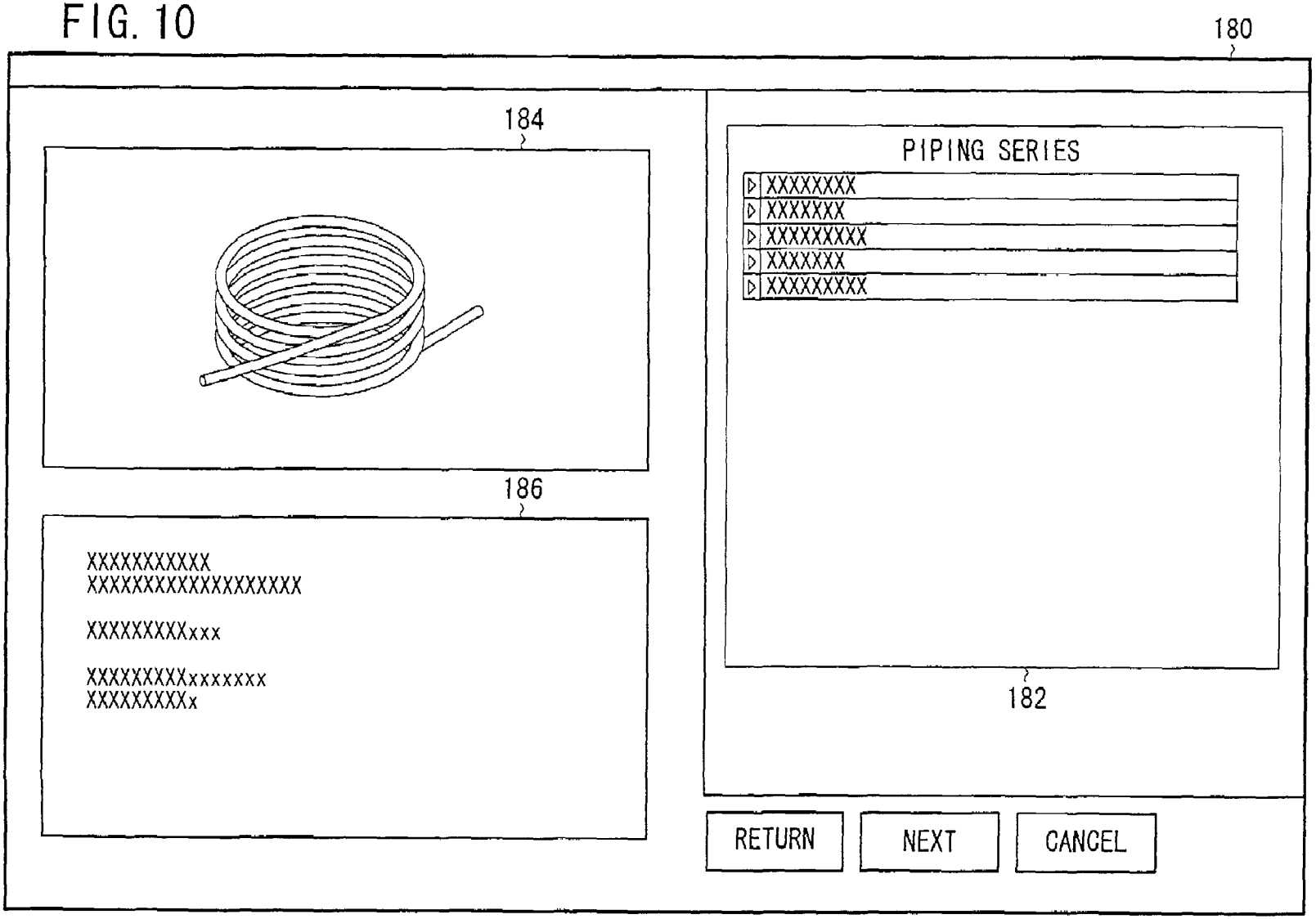
FIG. 10 is a diagram showing a displayed example of a tube selection screen.

When one of the flow control equipments displayed in the flow control equipment display area 144 is selected in the screen 140 shown in FIG. 7, the fifth display processor 90 displays a tube selection screen 180 shown in FIG. 10.

The screen 180 has a list display area 182 for displaying a list of information (e.g., model numbers) relative to tubes which satisfy entered usage conditions, an image display area 184 for displaying an image (e.g., a photographic image or a computer graphic image) of a tube corresponding to a model number which is selected from the displayed model numbers by the user, and a description display area 186 for displaying a description of the specifications of the tube corresponding to the selected model number. In the screen 180, the user selects the model number of a tube.

Figure 11:
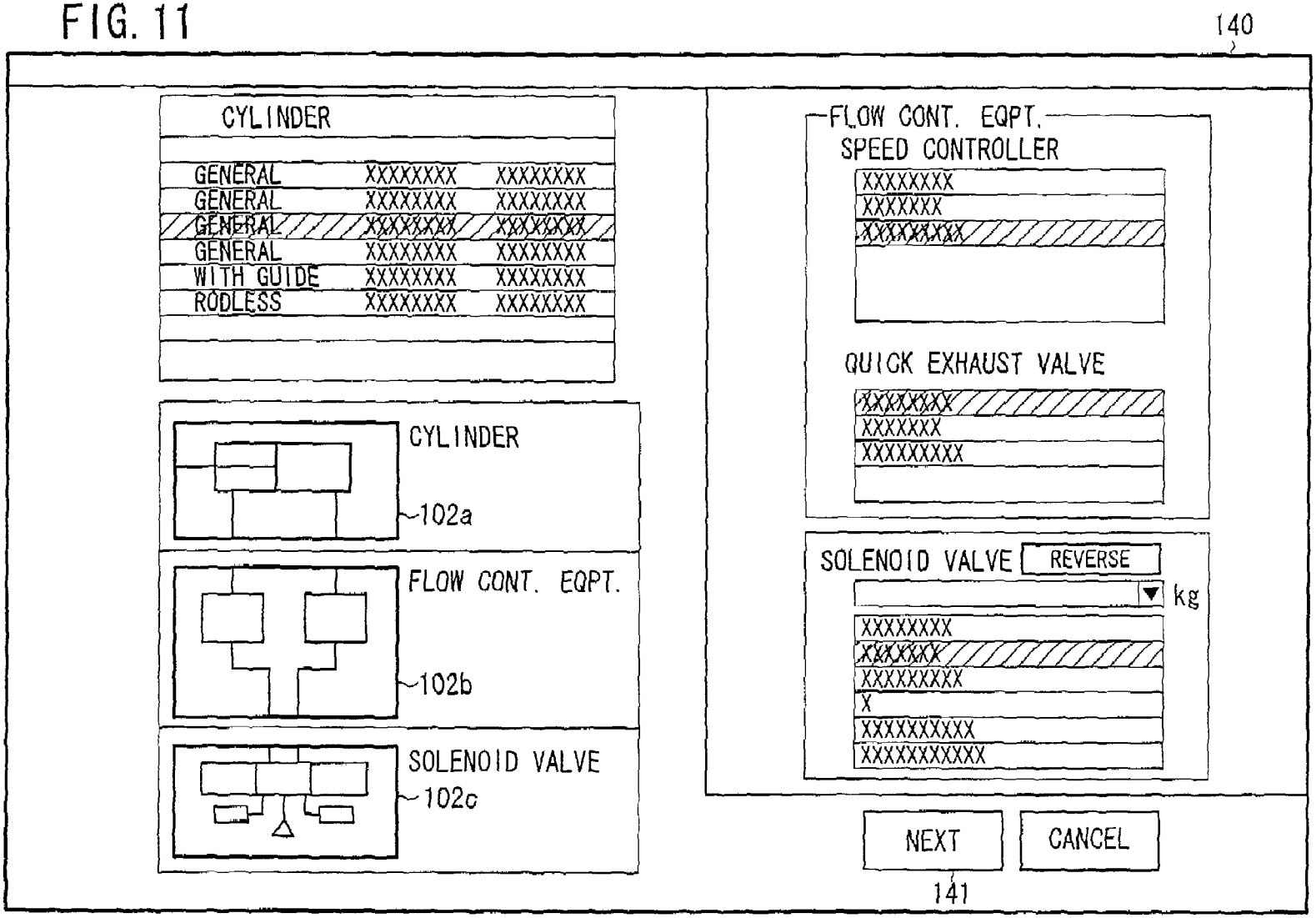
FIG. 11 is a diagram showing a circuit configuration setting screen in a wizard function.

As shown in FIG. 4, the first selection processor 60 has a sixth display processor 92 for performing a so-called wizard function. The sixth display processor 92 is activated when a wizard button 108 in the screen 100 shown in FIG. 5 is clicked. The sixth display processor 92 first activates the fourth display processor 88 to display a circuit configuration setting screen 140 shown in FIG. 11.

Figure 12:
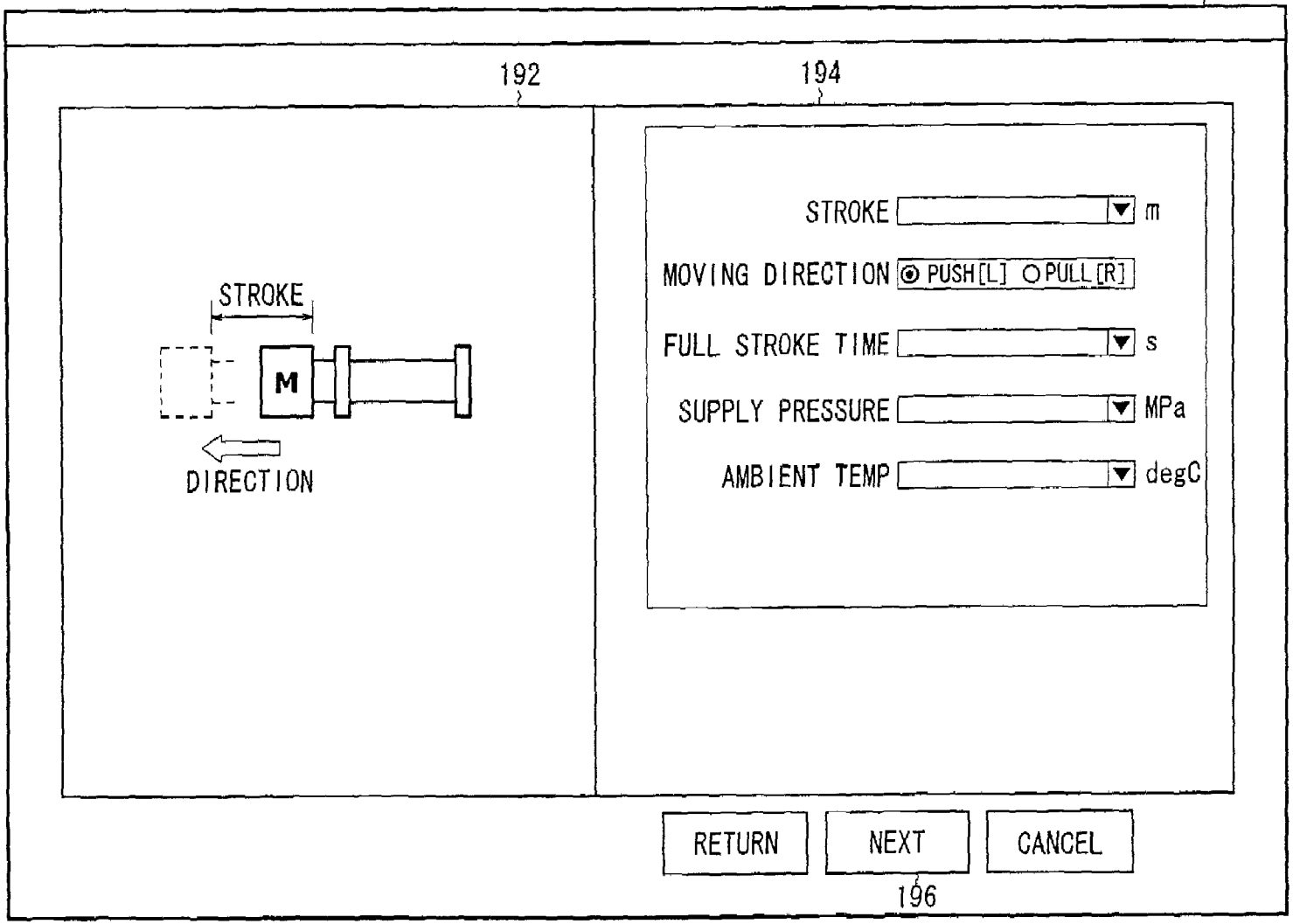
FIG. 12 is a diagram showing a setting screen for a full stroke time in the wizard function.

After the user finishes a setting process in the screen 140, the user clicks a button 141 representing "NEXT", whereupon the first display processor 82 is activated to display a setting screen 190 for a full stroke time shown in FIG. 12. As shown in FIG. 12, the screen 190 has a moving image display area 192 for displaying an animated image of a basic structure of the selected cylinder classification, and a condition input area 194 for entering numerical values relative to a full stroke time. In the setting screen 190, the user enters items relative to a full stroke time, i.e., a stroke, a moving direction, a full stroke time, a supply pressure, and an ambient temperature.

Figure 13:
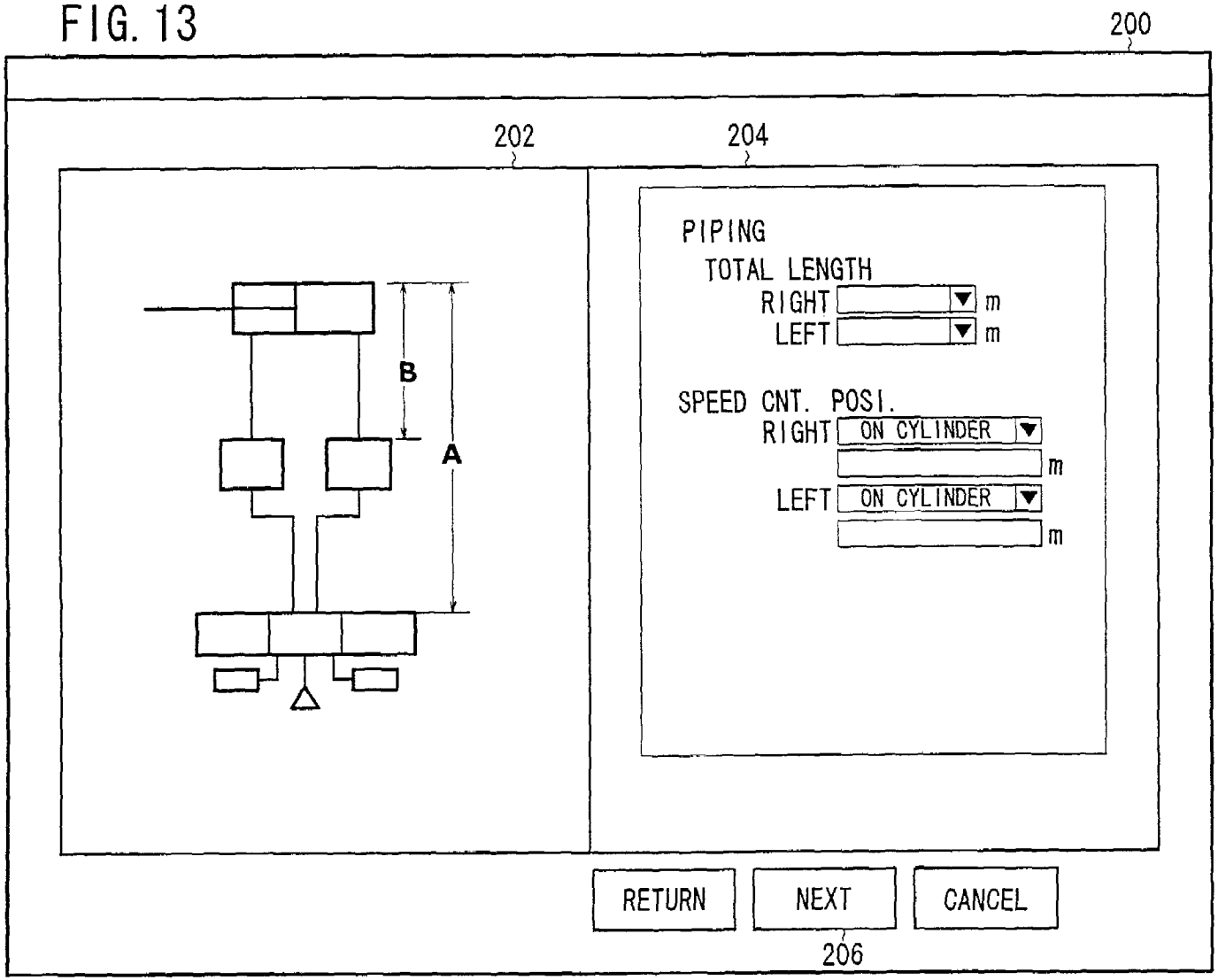
FIG. 13 is a diagram showing a setting screen for a tube in the wizard function.

After the user enters data in the screen 190, the user clicks a button 196 representing "NEXT", whereupon a setting screen 200 relative to a tube shown in FIG. 13 is displayed. As shown in FIG. 13, the screen 200 has a circuit diagram display area 202 for displaying a circuit diagram of the selected circuit configuration, and a condition input area 204 for entering numerical values relative to a tube. In the screen 200, the user enters items relative to a tube, i.e., a total length (right, left) and a speed controller position (right, left).

Figure 14:
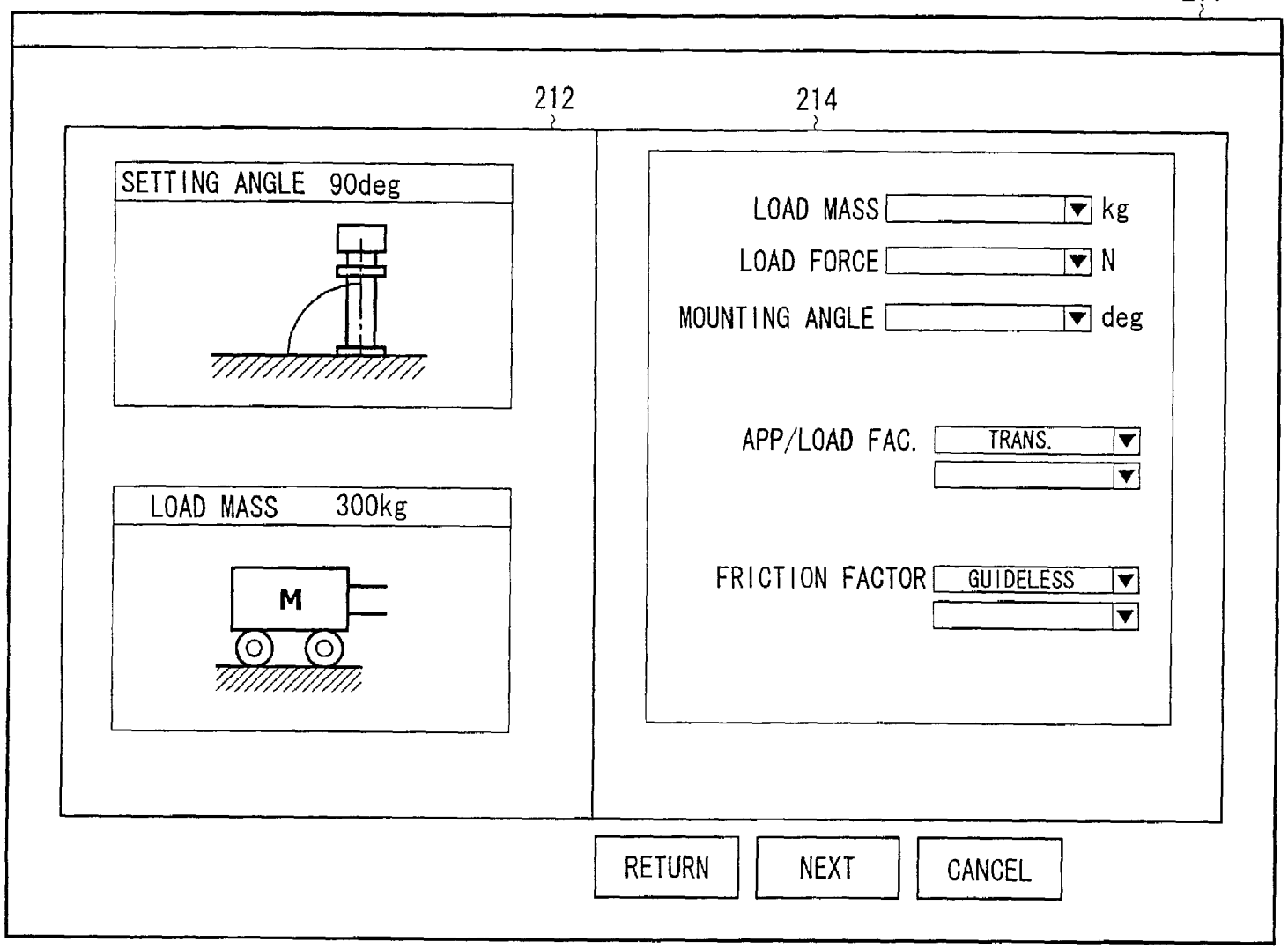
FIG. 14 is a diagram showing a setting screen for a load in the wizard function.

After the user enters data in the screen 200 for a tube, the user clicks a button 206 representing "NEXT", whereupon a setting screen 210 relative to a load shown in FIG. 14 is displayed. As shown in FIG. 14, the screen 210 has an image display area 212 for displaying an image showing a load mass and an image showing a mounting angle, and a condition input area 214 for entering numerical values relative to a load. In the condition input area 210, the user enters items relative to a load, i.e., a load mass, a load force (required thrust), a mounting angle, an application, a load factor, and a friction factor.

After the user enters data in the screen 210, the processing sequence in the sixth display processor 92 is finished.

Figure 15:
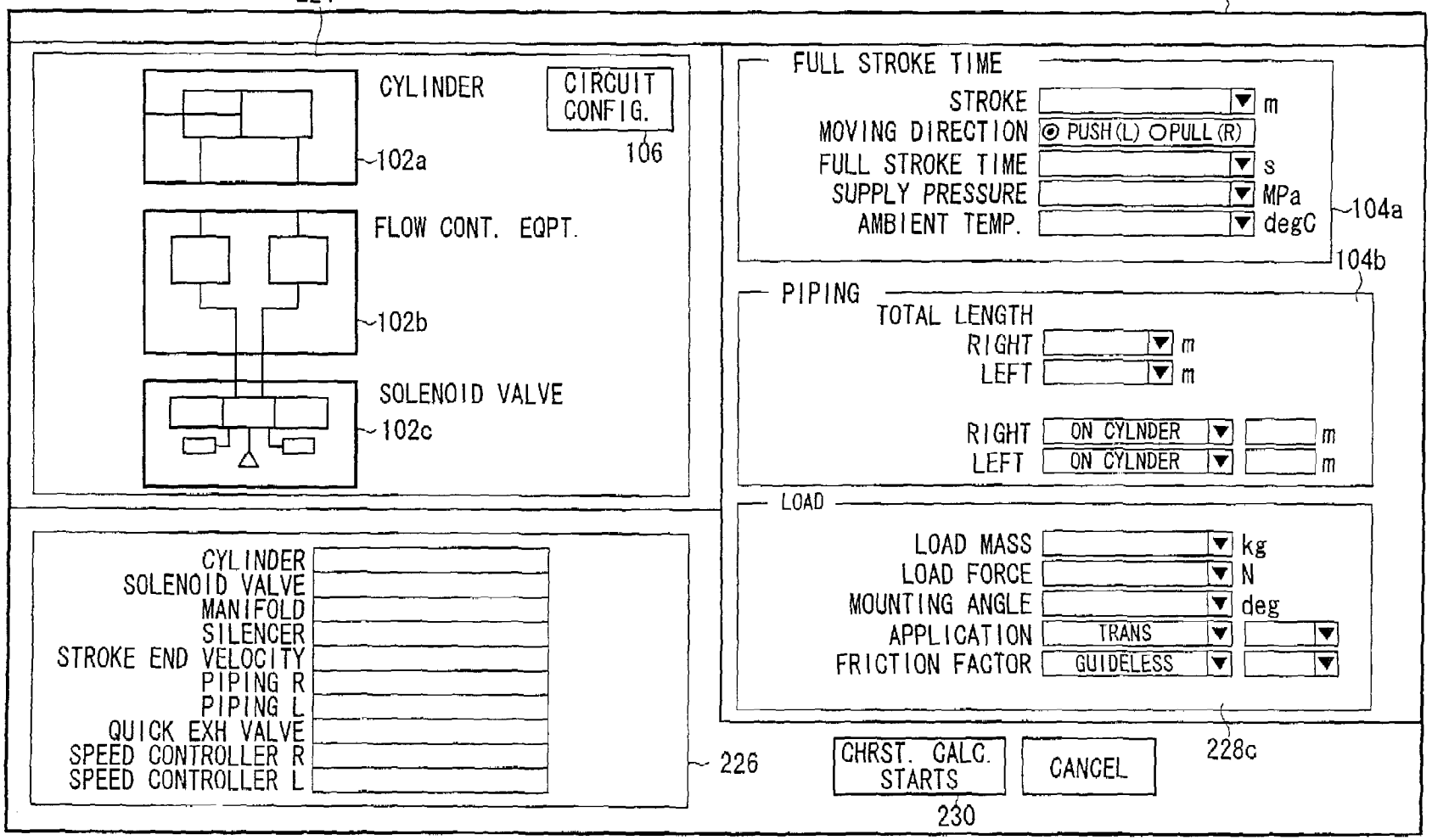
FIG. 15 is a diagram showing a displayed example of a characteristic calculation input screen.

As shown in FIG. 4, the independent characteristic calculation processor 76 has a seventh display processor 94 for displaying a characteristic calculation input screen 220 (see FIG. 15) and an eighth display processor 96 for displaying a characteristic calculation result screen 222 (see FIG. 15).

As shown in FIG. 15, the screen 220, which is similar to the screen 100 shown in FIG. 5, has a circuit setting area 224 for displaying a circuit configuration which is being set, a model number input area 226 for entering the model numbers of devices, a condition setting area 228 for entering usage conditions, and a calculation start button (icon) 230 for requesting a start of characteristic calculations.

Figure 16:
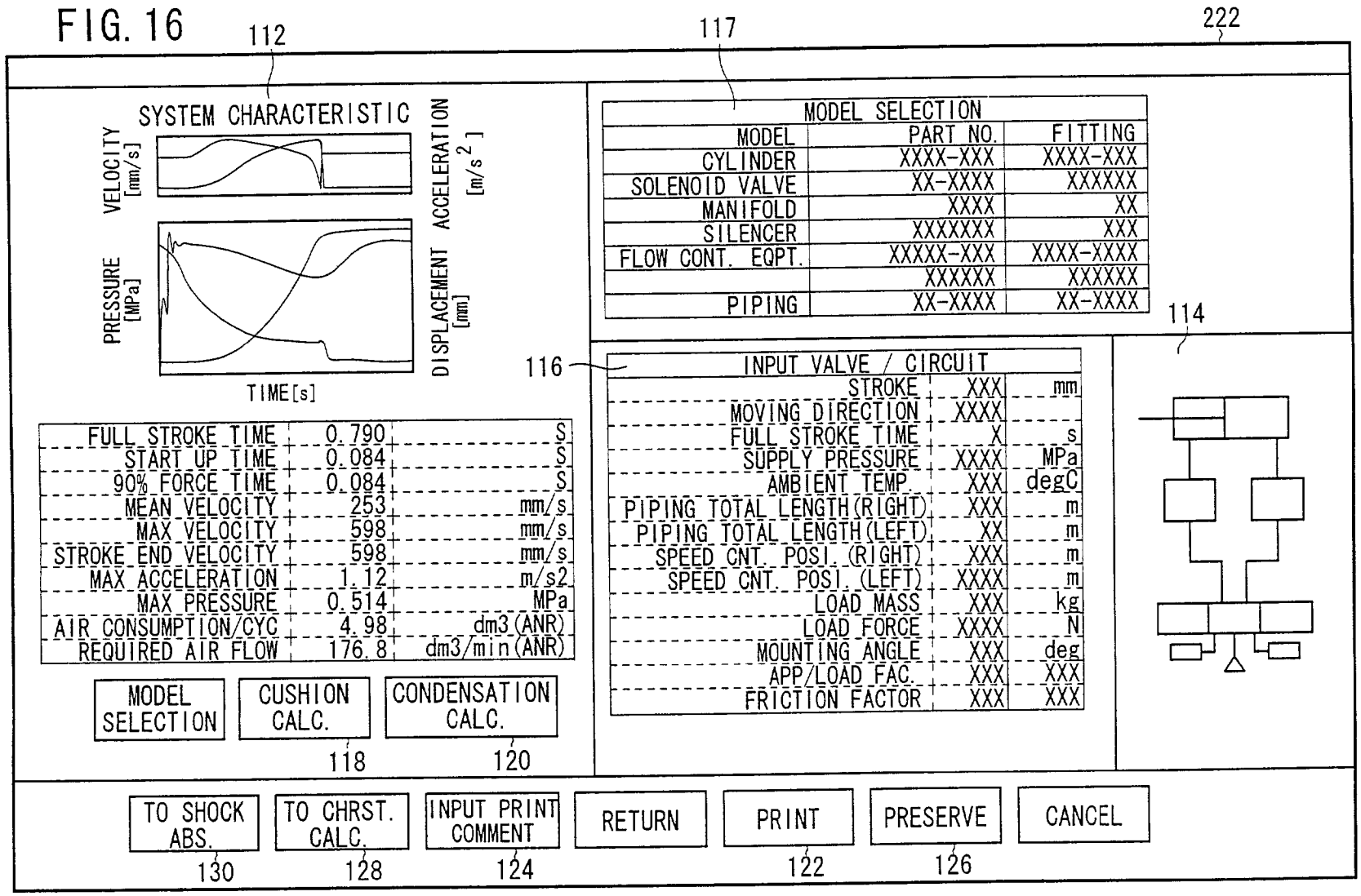
FIG. 16 is a diagram showing a displayed example of a characteristic calculation result screen.

As shown in FIG. 16, the screen 222 is essentially identical to the screen 110 shown in FIG. 6. Those parts of the screen 222 which are identical to those of device selection result screen 110 are denoted by identical reference characters, and will not be described below.

Figure 17:
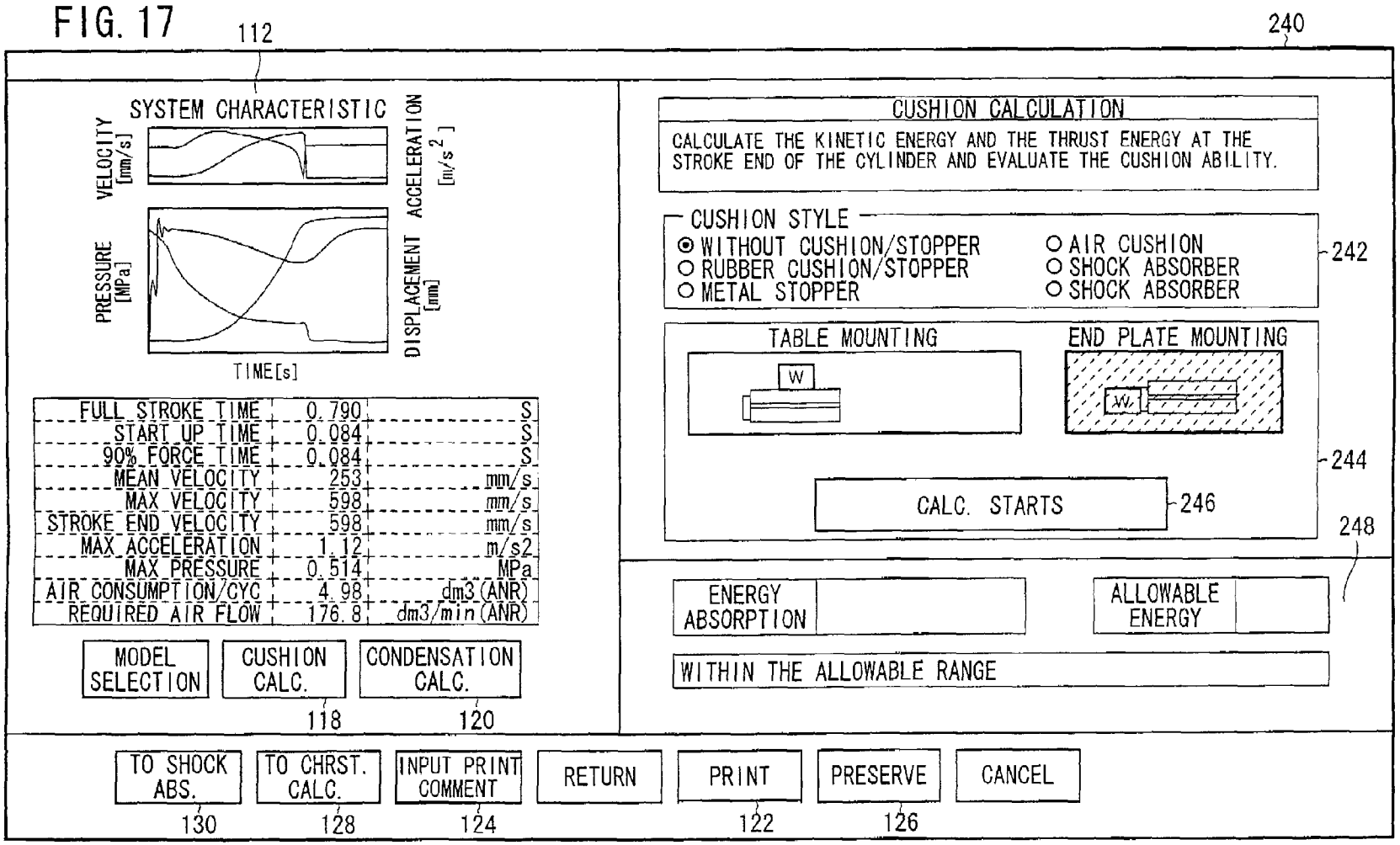
FIG. 17 is a diagram showing a displayed example of a cushion calculation screen.

As shown in FIG. 4, the characteristic calculation processor 74 has a ninth display processor 98. The ninth display processor 98 is activated when the cushion calculation button 118 in the device selection result screen 110 shown in see FIG. 6 is clicked, and displays a cushion calculation screen 240 shown in FIG. 17. As shown in FIG. 17, the screen 240 has, displayed in a left half area thereof, data identical to those in the left half area of the screen 110, and also has, displayed in a right half area thereof, a first type selector 242 for selecting a cushion style, a second type selector 244 for selecting a workpiece mounting type, a calculation start button (icon) 246, and a result display area 248 for displaying calculated results (the values of an energy to be absorbed by the cylinder and an allowable energy), and a comment message corresponding to the calculated results.

Figure 18:
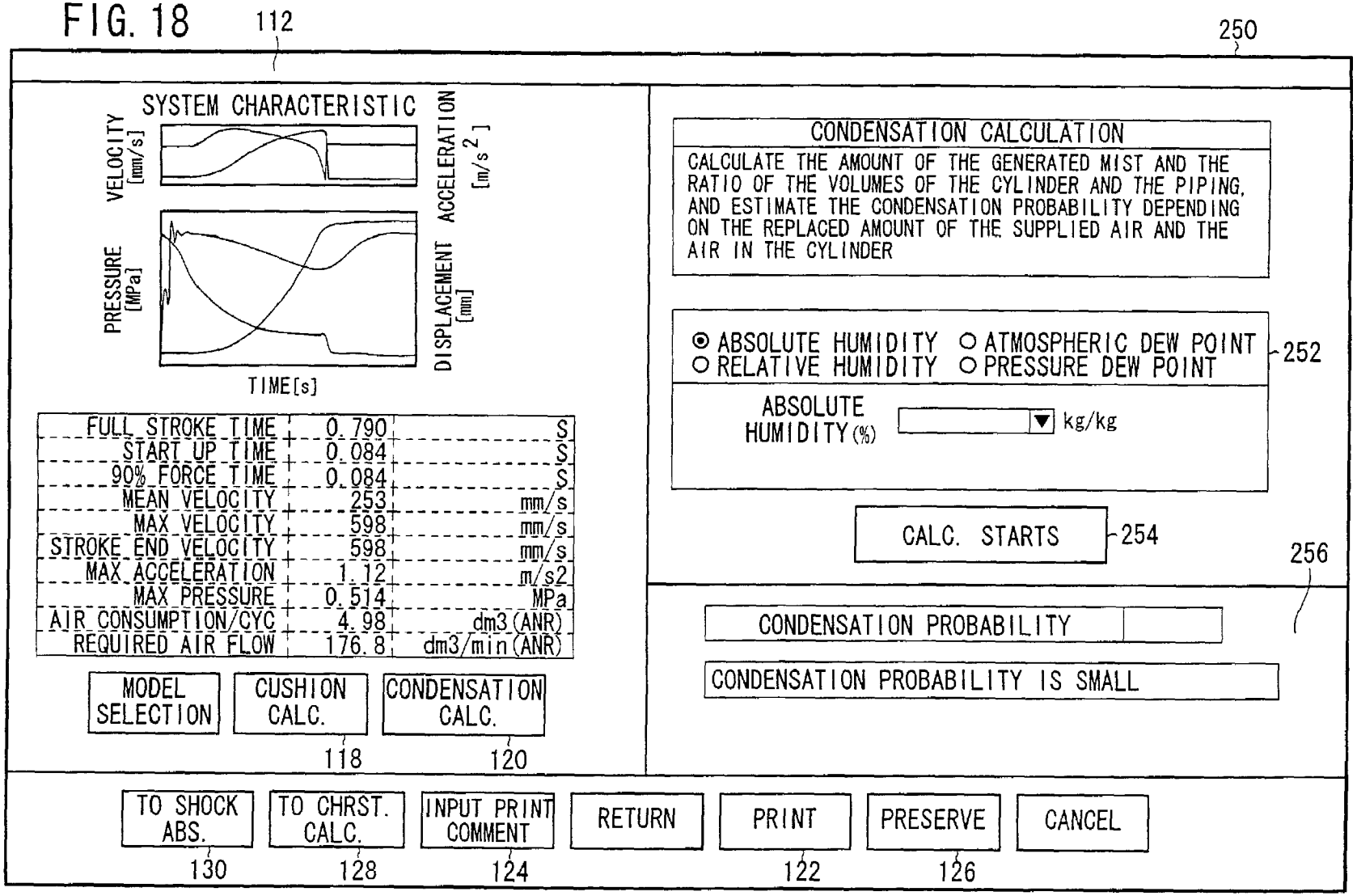
FIG. 18 is a diagram showing a displayed example of a moisture condensation calculation screen.

As shown in FIG. 4, the moisture condensation calculation processor 80 has a tenth display processor 99. The tenth display processor 99 is activated when the moisture condensation calculation button 120 in the screen 110 shown in see FIG. 6 is clicked, and displays a moisture condensation calculation screen 250 shown in FIG. 18. As shown in FIG. 18, the screen 250 has, displayed in a left half area thereof, data identical to those in the left half area of the screen 110, and also has, displayed in a right half area thereof, a moisture selector 252 for selecting an air humidity, a calculation start button (icon) 254, and a result display area 256 for displaying calculated results (the value of a moisture condensation probability) and a comment message corresponding to the calculated results.

The air humidity is selected by selecting either an absolute humidity, a relative humidity, an atmospheric dew point, or a pressure dew point as the humidity of air supplied to the solenoid valve.

A phenomenon of moisture condensation, a mechanism of moisture condensation, and a countermeasure to prevent moisture condensation will be described below.

Usually, moisture condensation in a cylinder operating system refers to moisture condensation which is caused by compressed air that has been adjusted in humidity while the cylinder is in operation. The moisture condensation occurs in two different phenomena, i.e., internal moisture condensation and external moisture condensation. The internal moisture condensation is a phenomenon in which humidity in the air is condensed within pneumatic devices or tubes due to a drop in the temperature of the air. The external moisture condensation is a phenomenon in which the air at a low temperature cools pneumatic devices which it contacts, condensing humidity contained in the air on outer surfaces of the pneumatic devices.

It is generally known that moisture condensation is basically caused by a reduction in the temperature of the air due to an adiabatic change of the air. In addition to the different phenomena of internal moisture condensation and external moisture condensation, the moisture condensation also occurs as moisture condensation on smaller-size cylinders and moisture condensation on larger-size cylinders.

Figure 19:
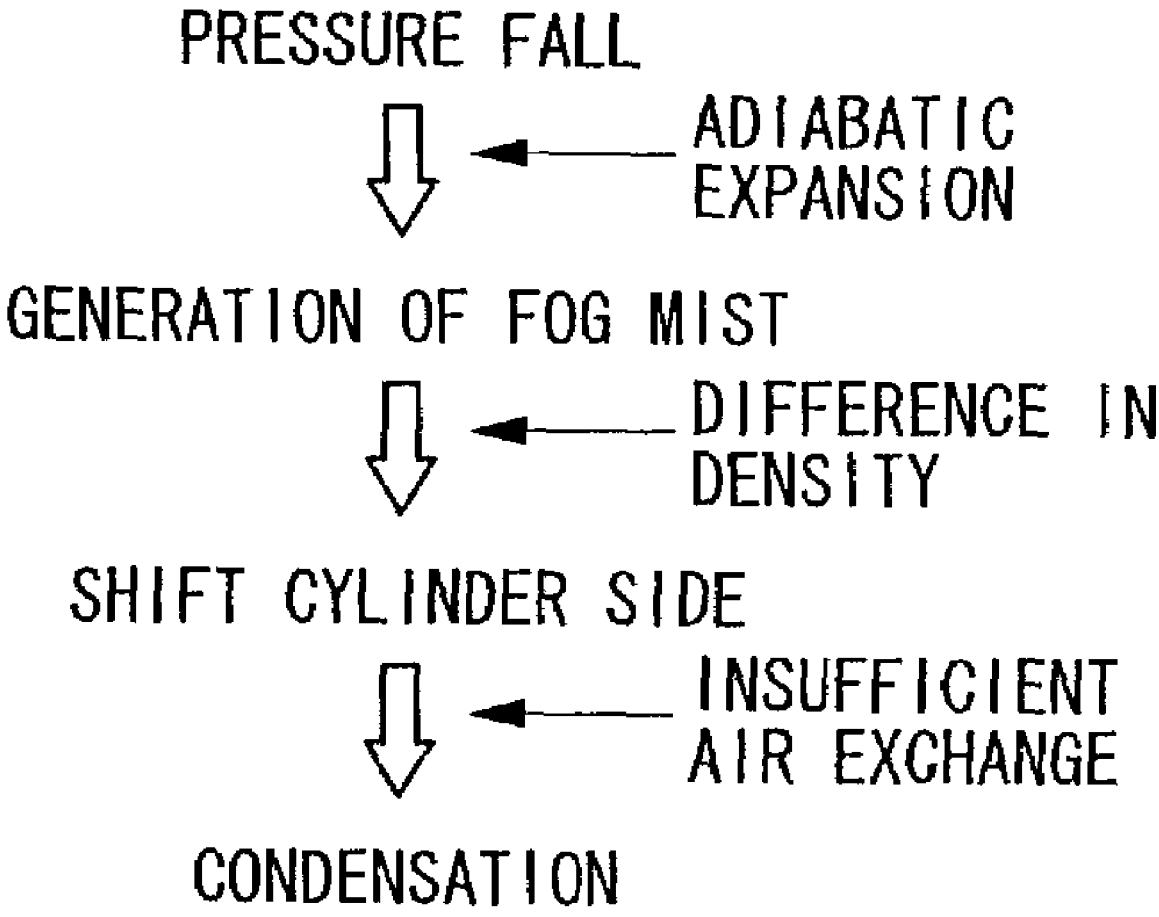
FIG. 19 is a diagram showing a mechanism of moisture condensation due to an insufficient air exchange.
Figure 20:
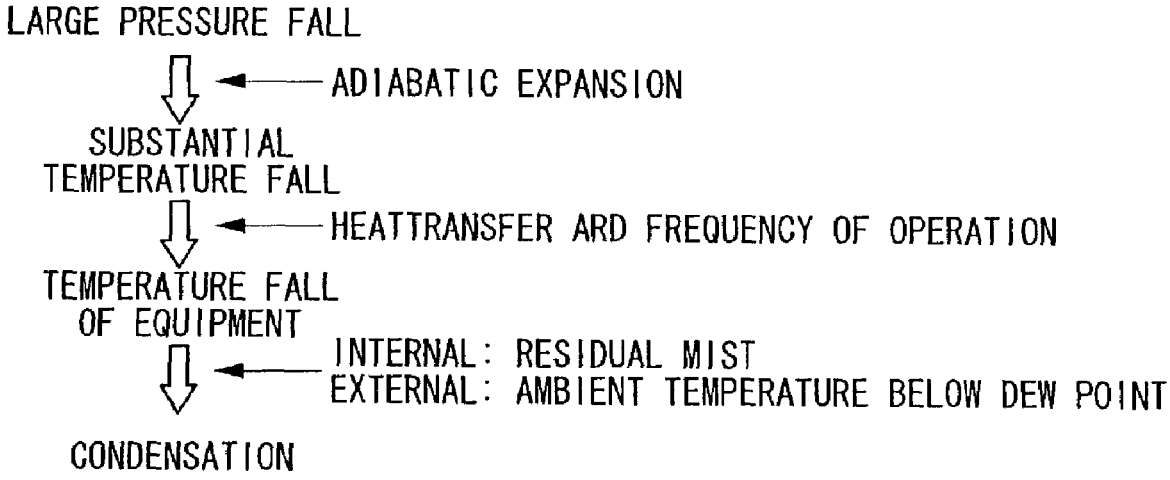
FIG. 20 is a diagram showing a mechanism of moisture condensation due to a low temperature on a device surface.

Internal moisture condensation tends to occur in a long tube or a small-size cylinder because of insufficient air exchange. FIG. 19 shows a mechanism of moisture condensation due to an insufficient air exchange. If a large-size cylinder actuates a large load or a meter-in circuit is used, then moisture condensation tends to occur owing to a low temperature at the surface of the device. FIG. 20 shows a mechanism of moisture condensation due to a low temperature on a device surface.

A first process of preventing moisture condensation from occurring is to prevent a mist from being produced. A mist is prevented from being produced by lowering the humidity of supplied air, reducing the pressure of supplied air, or reducing an effective area of a speed control valve. However, these solutions often fail because of the ability of existing dehumidifiers and limited usage conditions.

A second process of preventing moisture condensation from occurring is to prevent a produced mist from staying undischarged. For preventing moisture condensation due to an insufficient air exchange, there are available a tube method, a quick discharge valve method, and a bypass tube method. According to the tube method, the proportion of the volume of the tube is selected to be smaller than the volume of the cylinder for sufficiently mixing the remaining air in the cylinder and the tube with supplied fresh air and discharging the remaining air. Generally, the volumes of the cylinder and the tube are selected to satisfy the following formula:

$$\text{Volume of the air in the cylinder as converted at the atmospheric pressure} \times 0.7 \geqq \text{internal volume of the tube} \quad (1)$$

Figure 21:
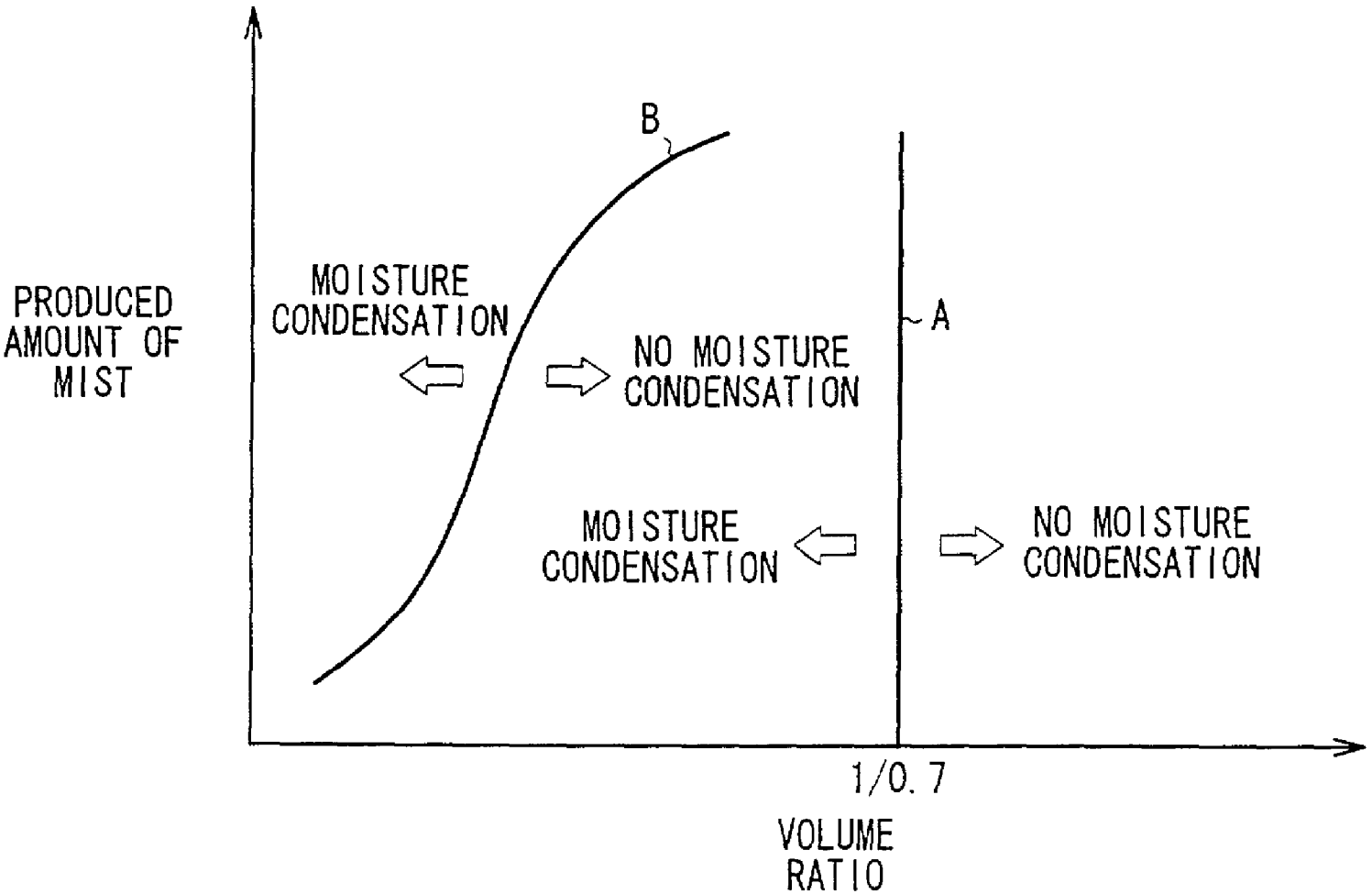
FIG. 21 is a diagram showing the relationship between a volume ratio and a produced amount of mist.

As indicated by a straight-line curve A in FIG. 21, it is judged that moisture condensation will take place if the volume ratio is smaller than 1/0.7, and no moisture condensation will take place if the volume ratio is greater than 1/0.7.

The above formula takes into account only the supply pressure, the size of the cylinder, and the size of the tube, but not whether a mist is produced or not as a precondition for moisture condensation.

According to the present embodiment, a countermeasure for preventing moisture condensation from occurring is taken based on the following formula which takes into account, in addition to the supply pressure, the size of the cylinder, and the size of the tube, whether a mist is produced or not depending on the humidity of the supplied air and the ambient temperature, and the amount of a mist which is produced, as elements that affect moisture condensation.

$$\text{Volume of the air in the cylinder as converted at the atmospheric pressure} \geqq \text{internal volume of the tube} \times \text{critical amount of mist} \quad (2)$$

This process does not consider a safety coefficient, but introduces a moisture condensation probability depending on a moisture condensation uncertainty zone based on experimentation.

As shown in FIG. 21, it is judged that moisture condensation will take place in a region smaller than a characteristic curve B which is plotted as representing the relationship between the volume ratio and the amount of the mist, and no moisture condensation will take place in a region greater than the characteristic curve B. In this manner, the occurrence of moisture condensation can be judged more accurately.

According to the quick discharge valve method, a quick discharge valve is installed near the cylinder for discharging air in the cylinder directly into the atmosphere thereby to prevent highly humid air from staying undischarged in the cylinder. If the tube method cannot be used due to the device layout, then it is preferable to prevent moisture condensation from taking place with the quick discharge valve method.

According to the bypass tube method, a check valve and a bypass tube are used to supply air in one direction and discharge air in one direction for achieving a sufficient air exchange.

Moisture condensation which tends to occur owing to a low temperature at the surface of the device may be prevented by turning down a speed controller or reducing an operation frequency so that the temperature of the air will not be lowered quickly. In this case, it is preferable to avoid use of a meter-in circuit.

Processing operation of the first selection processor 60 will be described below with reference to FIGS. 22 through 38.

Figure 22:
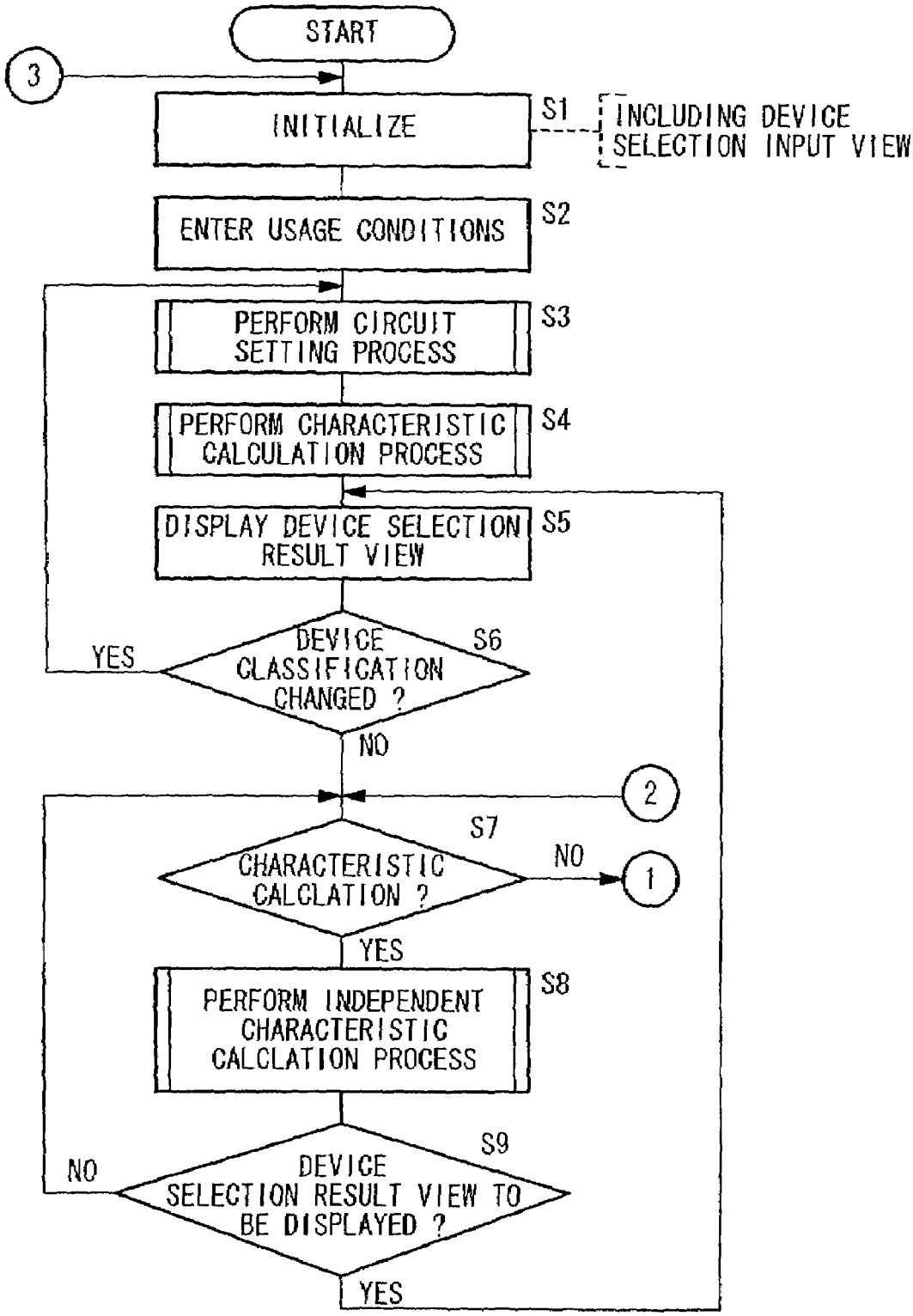
FIG. 22 is a flowchart of part 1 of a processing sequence of the first selection processor.

In step S1 shown in FIG. 22, an initializing process is carried out. In the initializing process, working areas are logically assigned to a main memory and various parameters are set therein, and the screen 100 is displayed on the display screen of the display unit 28.

In step S2, the user operates the coordinate input unit 24 an the keyboard 26 to enter various usage conditions while seeing the screen 100 displayed on the display unit 28. The use may enter the usage conditions using the wizard function described above. The usage conditions that are entered include a stroke, a full stroke time, a moving direction (pushing or pulling), a supply pressure, an ambient temperature, a load mass, a load force (requested thrust), a mounting angle, an application (feeding or clamping), a load factor, a friction factor, and a tube length.

Since no circuit configuration is set in the initial stage, no circuit diagram is displayed in the circuit setting area 102 of the screen 100. After the usage conditions are entered, the circuit setting processor 70 performs its processing sequence in step S3. The user clicks the circuit configuration request button 106 or clicks a button 109 representing "NEXT" to have the circuit setting processor 70 perform its processing sequence.

Figure 24:
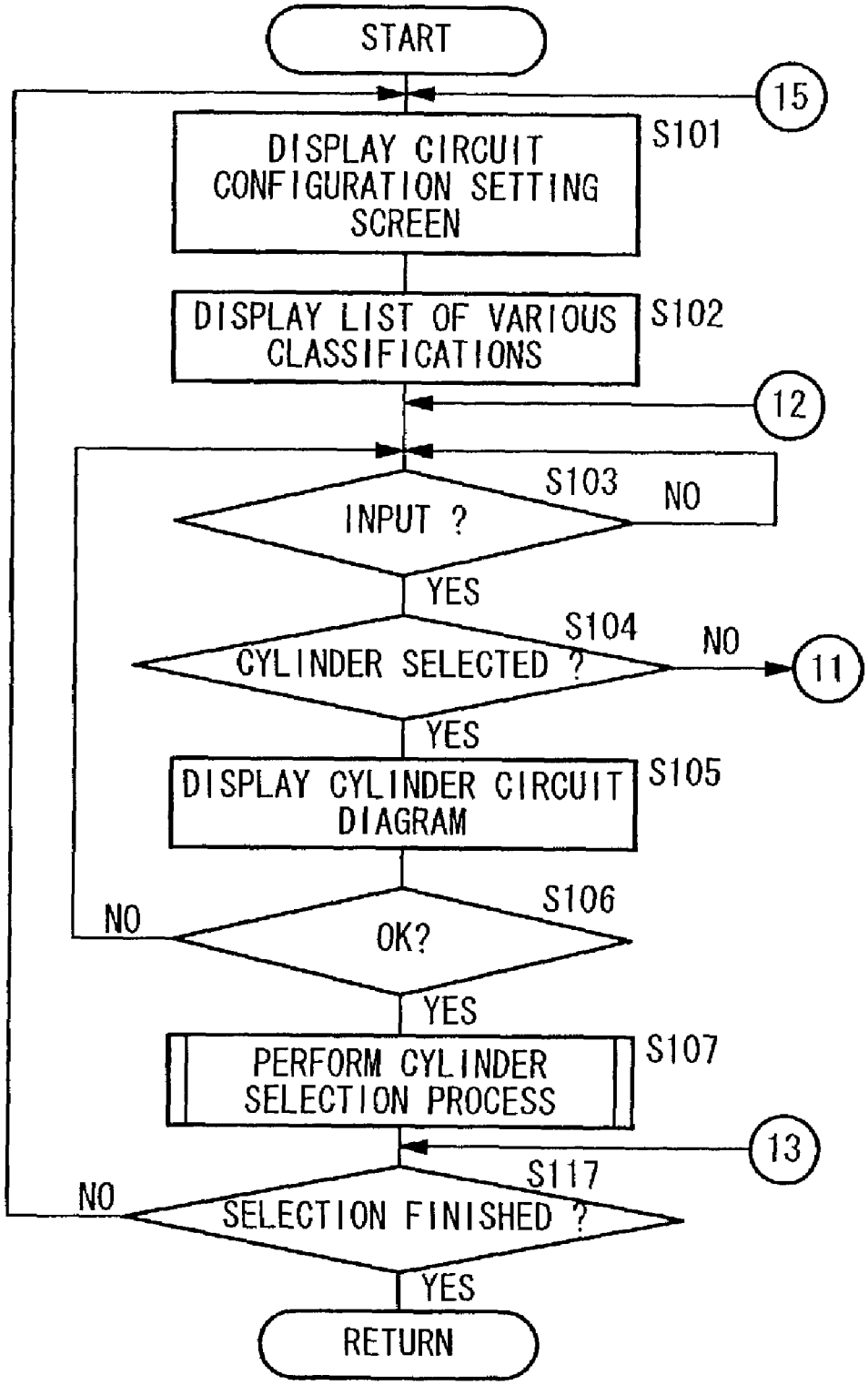
FIG. 24 is a flowchart of part 1 of a processing sequence of a circuit setting processor.

In the processing sequence, the circuit setting processor 70 controls the fourth display processor 88 to display the screen 140 shown in FIG. 7 on the display screen of the display unit 28 in step S101 shown in FIG. 24. Then, in step S102, the circuit setting processor 70 reads information cylinder classifications, solenoid valve classifications, and flow control equipment classifications registered in the databases, and displays lists of those classifications.

In step S103, the circuit setting processor 70 waits for an input from the user. If there is an input from the user, then the circuit setting processor 70 determines, in step S104, whether the input represents a cylinder selection or not by determining whether the user selects (e.g., clicks with the mouse) any one of cylinder classifications displayed in the list display area 142 of the screen 140 or not. If the user selects one of cylinder classifications, then the circuit setting processor 70 reads information of a circuit diagram corresponding to the selected cylinder classification, and displays the information in a cylinder display area in the circuit display area 148 in step S105.

Then, in step S106, the circuit setting processor 70 determines whether the selected cylinder classification is OK or not by determining whether there is an input indicating OK or not. If not OK, then control returns to step S103 in which the circuit setting processor 70 waits for an input from the user. If OK, then control goes to step S107 in which the device selection processor 72 performs its cylinder selecting sequence.

Figure 27:
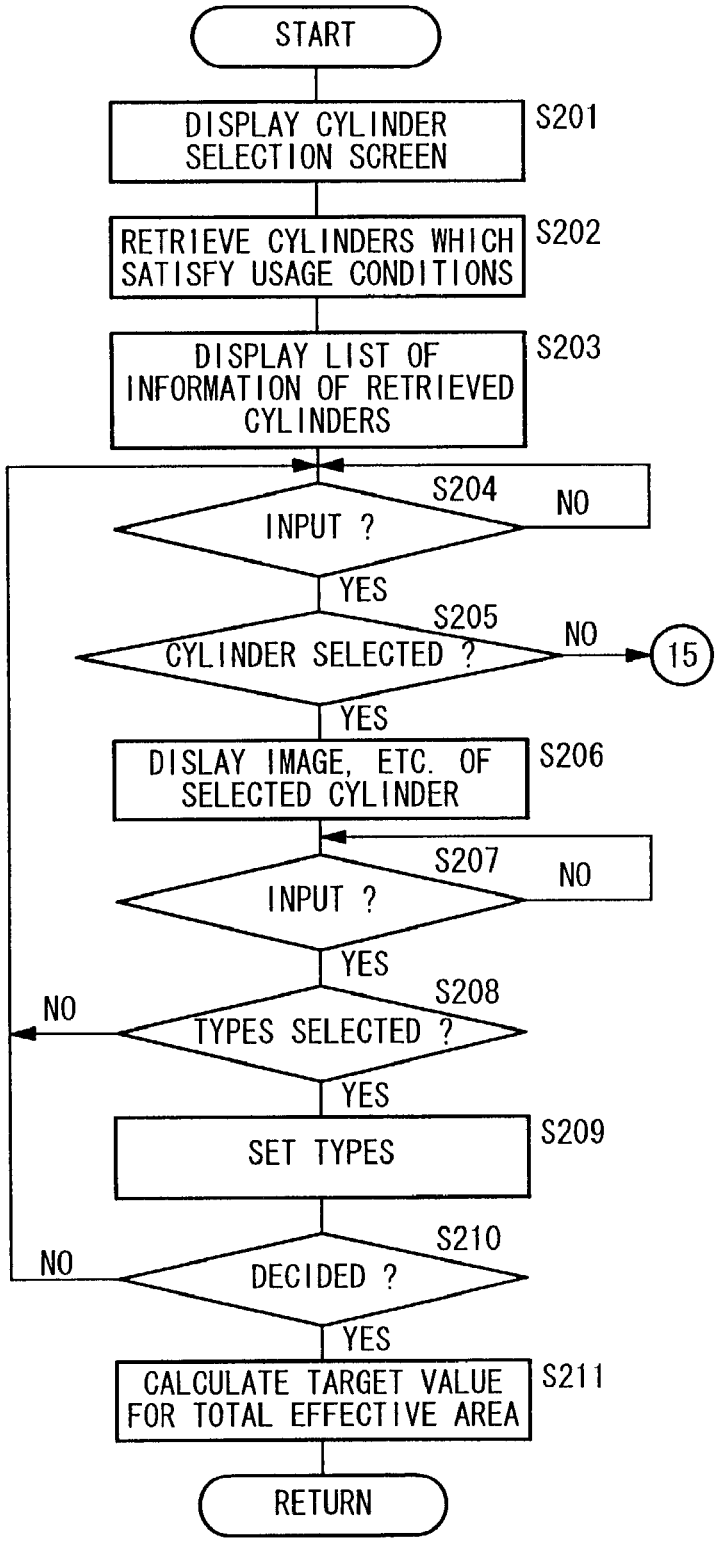
FIG. 27 is a flowchart of a cylinder selecting sequence of a device selection processor.

In the cylinder selecting sequence, the device selection processor 72 controls the fifth display processor 90 to display the 150 shown in FIG. 8 on the display screen of the display unit 28 in step S201 shown in FIG. 27.

In step S202, the device selection processor 72 searches for a cylinder which satisfies the usage conditions among one or more cylinders included in the selected cylinder classification.

Specifically, the device selection processor 72 carries out calculations according to a programmed formula for calculating the inside diameter of the cylinder, a programmed formula for calculating cylinder buckling, a programmed formula for calculating a lateral load on the cylinder, and the basic equations shown in FIG. 28C, and retrieves, from the first database DB1, a minimum-size cylinder which satisfies (1) a load condition (a dynamic condition for a selected system to operate sufficiently under input conditions, such as a load mass and thrust, an application, and a supplied air pressure, of a specified pneumatic actuator (cylinder)), (2) a velocity condition (a condition for a selected system to reach a stroke end of an output member (e.g., the piston of a cylinder) of a pneumatic actuator within a specified full stroke time, and (3) a strength condition (a condition for a selected system to satisfy the specified load condition while preventing the pneumatic actuator from being buckled, deformed, or broken.

Thereafter, the device selection processor 72 displays a list of information (model number, etc.) of the retrieved cylinder in step S203. Then, the device selection processor 72 waits for an input from the user in step S204.

If there is an input from the user, then control goes to step S205 in which the device selection processor 72 determines whether the input represents selection of the cylinder or not. If the input does not represent selection of the cylinder, but a cancel which means going back to the preceding view, then control returns to step S101 shown in FIG. 24, carrying out the circuit setting sequence again.

If the input represents selection of the cylinder, then control proceeds to step S206 in which the device selection processor 72 reads an image (e.g., a photographic image or a computer graphic image) of the selected cylinder, a description of the specifications of the selected cylinder, and graphic symbols showing a mounting type and a load connection type for the selected cylinder, and displays them in the image display area 154, the description display area 156, the first type selector 158, and the second type selector 160. Thereafter, the device selection processor 72 waits for an input from the user in step S207.

If there is an input from the user, then control goes to step S208 in which the device selection processor 72 determines whether the input represents selection of types or not. If the input does not represent selection of types, but a cancel, then control returns to step S204, carrying out the cylinder selecting sequence again. If the input represents selection of types, then control goes to step S209 in which a mounting type and a load connection type for the cylinder are set.

In step S210, the device selection processor 72 determines whether the mounting type and the load connection type are decided on or not by determining whether there is an input representing going to a next screen or not. If there is an input representing a cancel, then control goes back to step S204, carrying out the cylinder selecting sequence again. If the mounting type and the load connection type are decided on, then control goes to step S211 in which the device selection processor 72 calculates a target value Coa for the combined sound velocity conductance of the cylinder (the response time of the system is mainly determined from the sound velocity conductance and critical pressure ratio of a device on a fluid passage of the cylinder), allocates the target value Coa according to a certain rule, and determines the sizes of the devices based on the divided target value Coa. This is to make the sound velocity conductance of each device as close to an optimum value as possible for thereby reducing the number of calculations required to make an optimum selection (see steps 602 through S606 shown in FIG. 33) in the characteristic calculation processor 74.

The target value Coa for the combined sound velocity conductance represents a combined value (see FIG. 29B) of sound velocity conductances of all restrictions in the flow passage required for the specified response time of the system (when the response time t is exactly a specified response time treq).

Figures 29A, 29B:
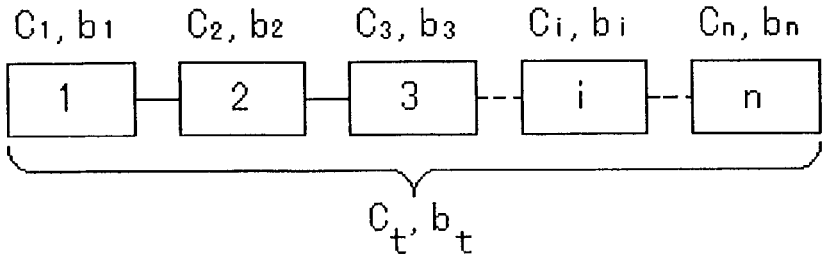
FIG. 29A is a diagram showing an equation for combining sound velocity conductances and critical pressure ratios of all restrictions of a fluid passage required for the response time of a system.
FIG. 29B is a diagram showing equations for weighting respective devices.

An equation for combining sound velocity conductances and critical pressure ratios as shown in FIG. 29A will be described below. As shown in FIG. 29A, a system of series-connected pneumatic devices is assumed.

A combined sound velocity conductance Ct and a combined critical pressure ratio bt of the system are determined on the basis of sound velocity conductances Ci and critical pressure ratios bi of the individual pneumatic devices, as follows:

A dimensionless number $\alpha$ defined according to the equation (1) in FIG. 29B is determined with respect to two devices 1, 2 shown in FIG. 29A. When $\alpha<1$, if the sum of pressure drops in the devices 1, 2 is normal, the flow through the device 1 is of the sound velocity, and only if the sum of pressure drops in the devices 1, 2 is very large, the flow through the device 2 is of the sound velocity.

When $\alpha>1$, the flow through only the device 2 is of the sound velocity, and when $\alpha=1$, the flows through both the devices 1, 2 are of the sound velocity.

Using the dimensionless number $\alpha$, the combined sound velocity conductance $C_{1,2}$ of the devices 1, 2 is expressed by the equation (2) shown in FIG. 29B. The combined critical pressure ratio $b_{1,2}$ of the devices 1, 2 is expressed by the equation (3) shown in FIG. 29B irrespective of the dimensionless number $\alpha$.

In a next step, the above procedure is repeated to determine the combined sound velocity conductance $C_{1,2,3}$ and the combined critical pressure ratio $b_{1,2,3}$ of the devices 1, 2, 3, using the combined sound velocity conductance $C_{1,2}$ and the combined critical pressure ratio $b_{1,2}$ of the devices 1, 2, and the sound velocity conductance $C_3$ and critical pressure ratio $b_3$ of the device 3. The above procedure is repeated (n−1) times to determine the combined sound velocity conductance Ct and the combined critical pressure ratio bt of the system.

Figure 30:
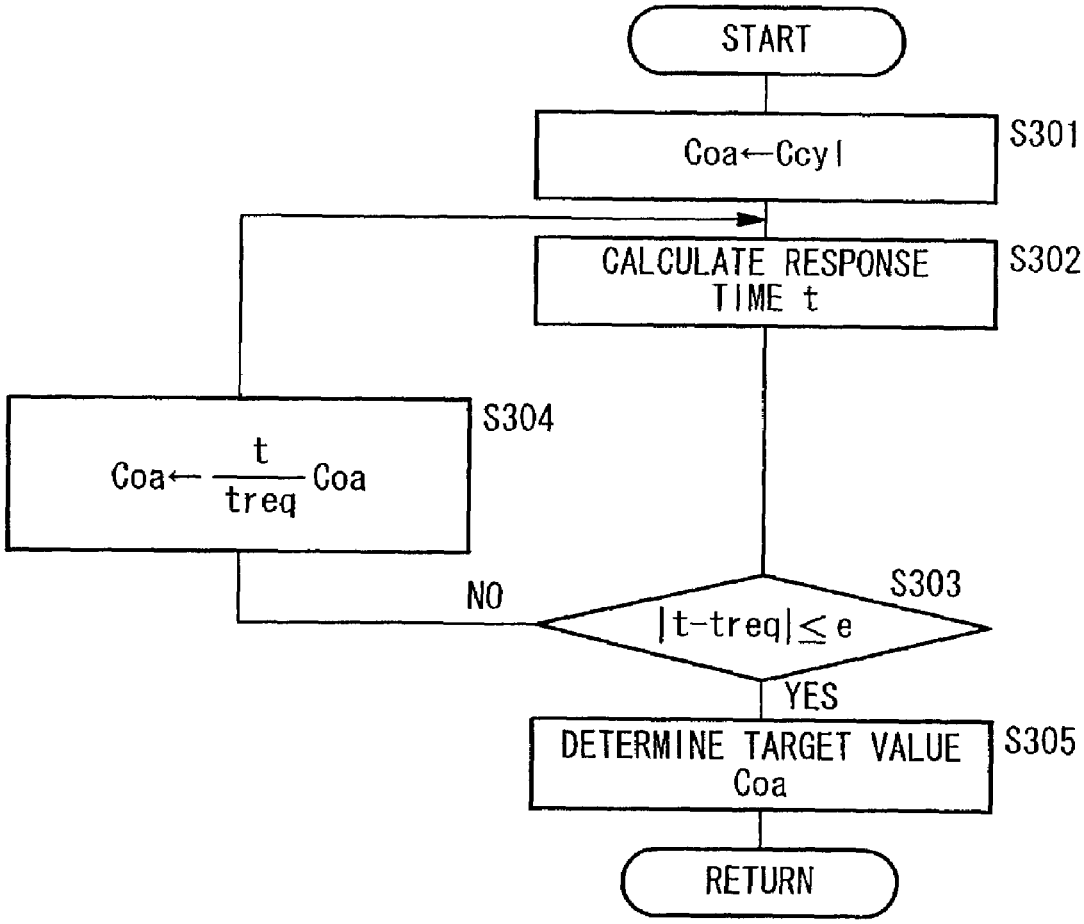
FIG. 30 is a flowchart of a sequence for determining a target value for a combined sound velocity conductance.

A process of calculating the target value Coa for the combined sound velocity conductance is shown in the flowchart (steps S301 through S305) of FIG. 30.

In step S301, a sound velocity conductance Ccyl of a cylinder port is inputted as an initial value of the target value Coa for the combined sound velocity conductance. Then, the response time t is calculated using the target value Coa as the sound velocity conductance of the cylinder port according to a simulation in step S302.

In step S303, it is determined whether the calculated response time t falls in a deviation e of the specified response time treq or not. If the calculated response time t falls in the deviation e, then the target value Coa is determined in step S305. If the calculated response time t does not fall in the deviation e, then the target value Coa is reduced stepwise in step S304, after which control returns to step S302.

When the target value Coa for the combined sound velocity conductance is determined in step S211 shown in FIG. 27, the target value Coa for the combined sound velocity conductance is allocated to other devices than the cylinder, using the equation (1) for combining sound velocity conductances and critical pressure ratios as shown in FIG. 29A, thus determining the sizes of the other devices than the cylinder. In order to allocate the target value Coa for the combined sound velocity conductance appropriately to the devices, each of the devices is weighted by the equation (2) in FIG. 29B as a weighting equation crresponding to each of the devices.

When the processing in step S211 is finished, the cylinder selecting sequence shown in FIG. 27 is put to an end.

Control goes back to the routine shown in FIG. 24. If the input does not represent a cylinder selection in step S104, then control goes to step S108 shown in FIG. 25 to determine whether the input represents a solenoid valve selection or not by determining whether the user selects any one of solenoid valve classifications displayed in the solenoid valve display area 146 of the screen 140 or not.

If the user selects one of solenoid valve classifications, then control goes to step S109 in which the circuit setting processor 70 reads information of a circuit diagram corresponding to the selected solenoid valve classification, and displays the information in a solenoid valve display area in the circuit display area 148. Then, in step S110, the circuit setting processor 70 determines whether the selected solenoid valve classification is OK or not by determining whether there is an input indicating OK or not. If not OK, then control returns to step S103 shown in FIG. 24 in which the circuit setting processor 70 waits for an input from the user. If OK, then control goes to step S111 in which the device selection processor 72 performs its solenoid valve selecting sequence.

Figure 31:
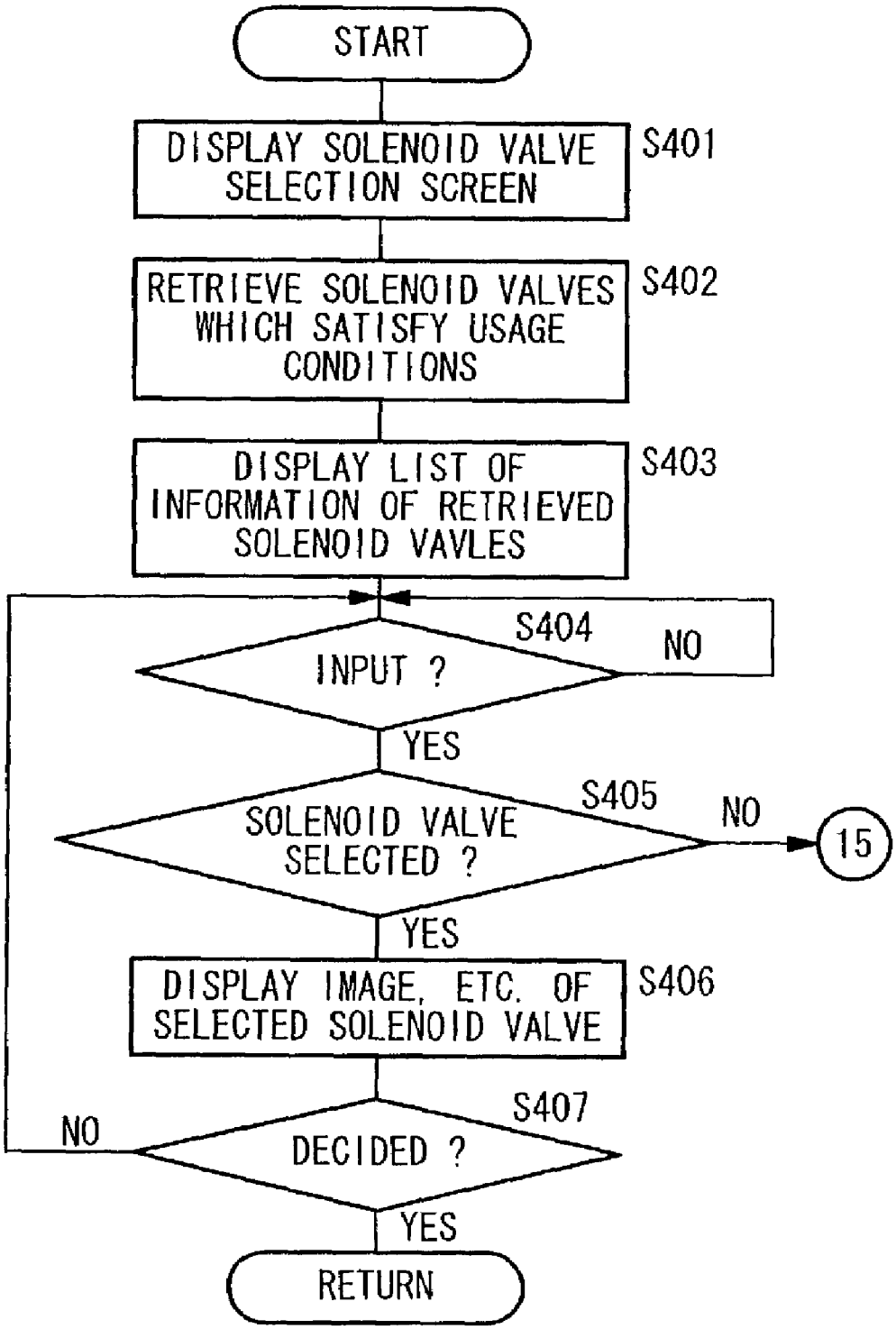
FIG. 31 is a flowchart of a solenoid valve selecting sequence of the device selection processor.
Figure 32:
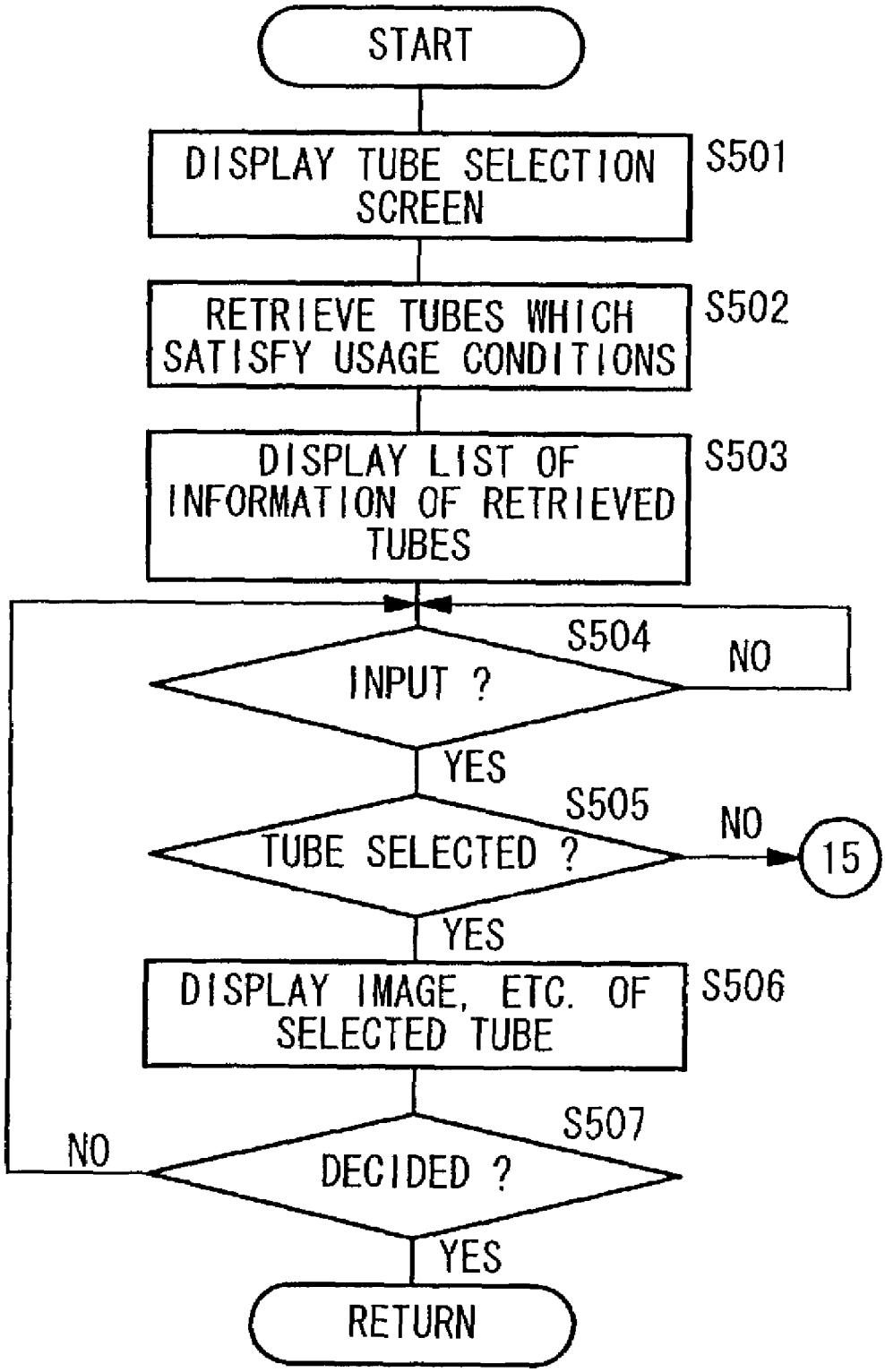
FIG. 32 is a flowchart of a tube selecting sequence of the device selection processor.

In the solenoid valve selecting sequence, the device selection processor 72 controls the fifth display processor 90 to display the screen 170 shown in FIG. 9 on the display screen of the display unit 28 in step S401 shown in FIG. 31.

In step S402, the device selection processor 72 searches for a solenoid valve which satisfies the usage conditions among one or more solenoid valves included in the selected solenoid valve classification. Specifically, the device selection processor 72 retrieves, from the second database DB2, a minimum solenoid valve whose sound velocity conductance Csol satisfies the following formula:

$$Csol>f1(tst, Ccyl)$$

where tst represents the specified response time and Ccyl represents the sound velocity conductance of the cylinder.

Since a manifold and an exhaust processing device (silencer) are ancillary to a solenoid valve, if a manifold and an exhaust processing device need to be selected, then a solenoid valve is retrieved, and a manifold and an exhaust processing device are further retrieved.

Thereafter, the device selection processor 72 displays a list of information (model number, etc.) of the retrieved solenoid valve in step S403. Then, the device selection processor 72 waits for an input from the user S404.

If there is an input from the user, then control goes to step S405 in which the device selection processor 72 determines whether the input represents selection of the solenoid valve or not. If the input does not represent selection of the solenoid valve, but a cancel which means going back to the preceding screen, then control returns to step S101 shown in FIG. 24, carrying out the circuit setting sequence again.

If the input represents selection of the solenoid valve, then control proceeds to step S406 in which the device selection processor 72 reads an image (e.g., a photographic image or a computer graphic image) of the selected solenoid valve, and a description of the specifications of the selected solenoid valve, and displays them in the image display area 174 and the description display area 176.

In step S407, the device selection processor 72 determines whether the solenoid valve is decided on or not by determining whether there is an input representing going to a next screen or not. If there is an input representing a cancel, then control goes back to step S404, carrying out the solenoid valve selecting sequence again. If the solenoid valve is decided on, then the solenoid valve selecting sequence is put to an end.

Figure 25:
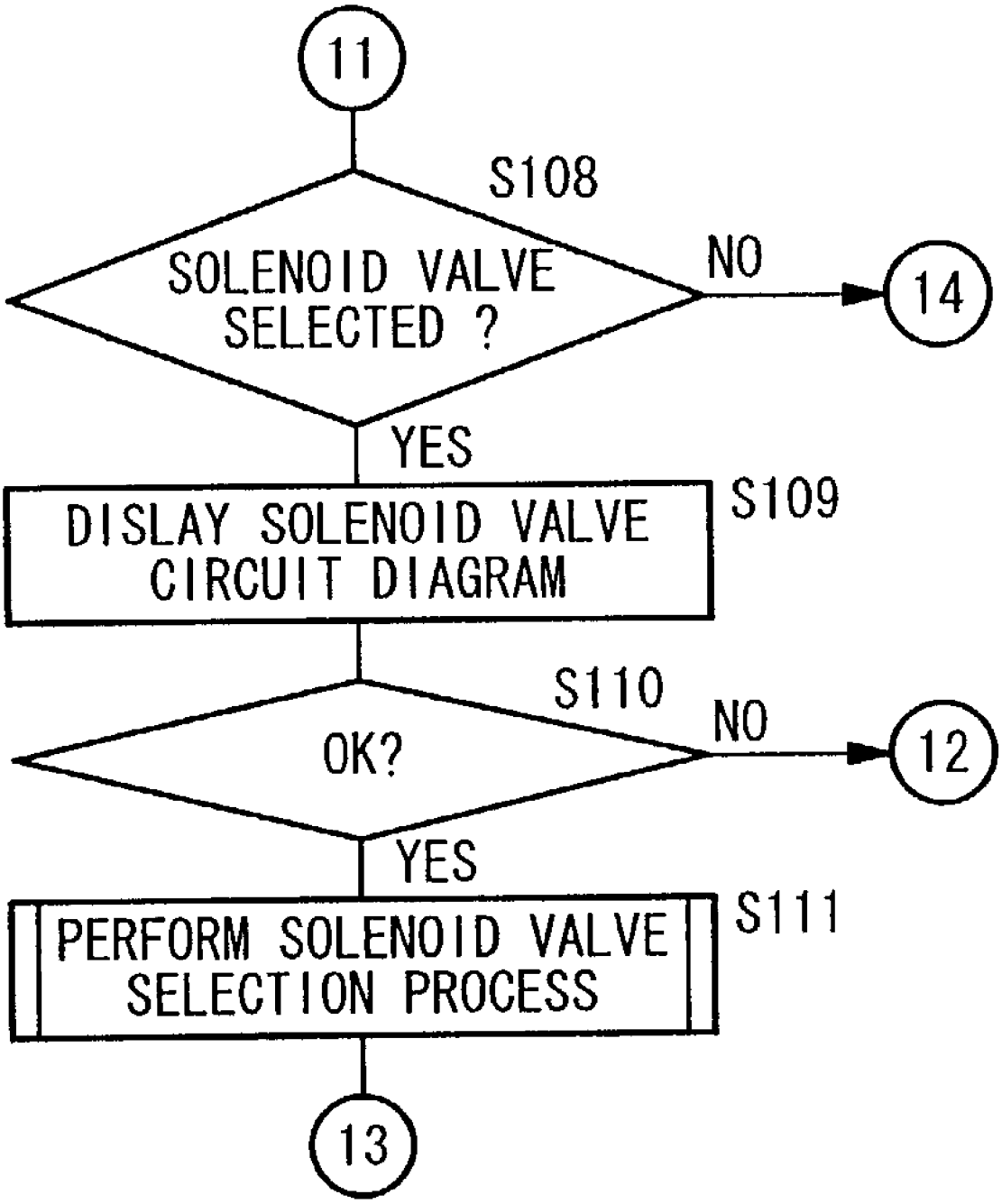
FIG. 25 is a flowchart of part 2 of the processing sequence of the circuit setting processor.
Figure 26:
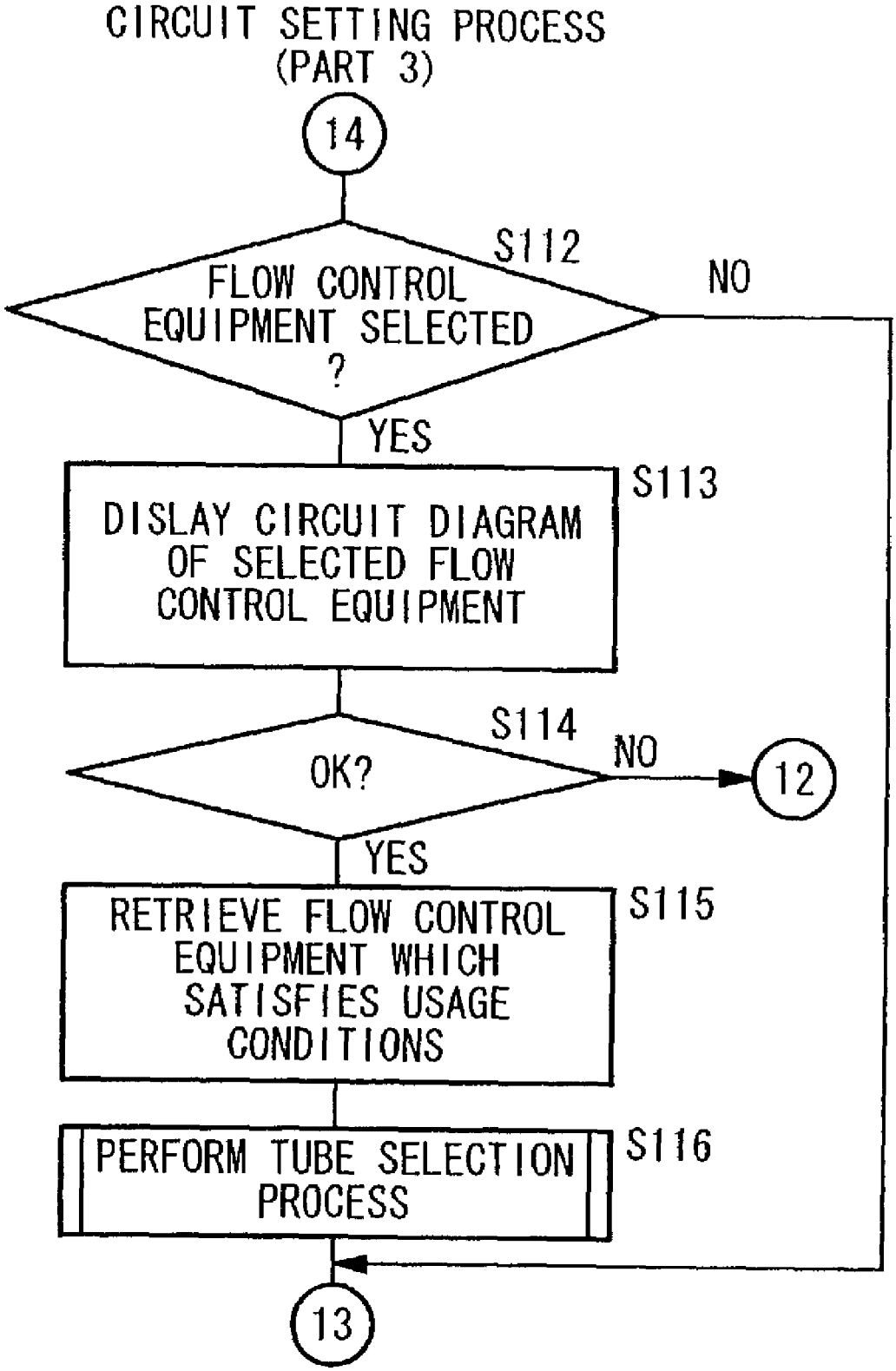
FIG. 26 is a flowchart of part 3 of the processing sequence of the circuit setting processor.

If the input does not represents a solenoid valve selection in step S108 shown in FIG. 25, then control goes to step S112 shown in FIG. 26 to determine whether the input represents a flow control equipment selection or not by determining whether the user selects any one of flow control equipment classifications displayed in the flow control equipment display area 144 of the screen 140 or not.

If the user selects one of flow control equipment classifications, then control goes to step S113 in which the circuit setting processor 70 reads information of a circuit diagram corresponding to the selected flow control equipment classification, and displays the information in a flow control equipment display area in the circuit display area 148.

Then, in step S114, the circuit setting processor 70 determines whether the selected flow control equipment classification is OK or not by determining whether there is an input indicating OK or not. If not OK, then control returns to step S103 shown in FIG. 24 in which the circuit setting processor 70 waits for an input from the user. If OK, then control goes to step S115 in which the device selection processor 72 searches for a flow control equipment which satisfies the usage conditions among one or more flow control equipment included in the selected flow control equipment classification.

Specifically, the device selection processor 72 retrieves, from the third database DB3, a minimum flow control equipment whose sound velocity conductance Cspi satisfies the following formula:

$$Cspi > f2(tst, Ccyl, Csol)$$

where tst represents the specified response time, Ccyl represents the sound velocity conductance of the cylinder, and Csol represents the sound velocity conductance of the solenoid valve.

Then, the device selection processor 72 performs its tube selecting sequence in step S116. In the tube selecting sequence, the device selection processor 72 controls the fifth display processor 90 to display the screen 180 shown in FIG. 10 on the display screen of the display unit 28 in step S501 shown in FIG. 32.

In step S502, the device selection processor 72 searches for a tube which satisfies the usage conditions among one or more tubes valves included in the selected flow control equipment classification. Specifically, the device selection processor 72 retrieves, from the fourth database DB4, a minimum tube whose sound velocity conductance Ctub satisfies the following formula:

$$Ctub > f3(tst, Ccyl, Csol, Cspi)$$

where tst represents the specified response time, Ccyl represents the sound velocity conductance of the cylinder, Csol represents the sound velocity conductance of the solenoid valve, and Cspi represents the sound velocity conductance of the flow control equipment.

Thereafter, the device selection processor 72 displays a list of information (model number, etc.) of the retrieved tube in step S503. Then, the device selection processor 72 waits for an input from the user S504.

If there is an input from the user, then control goes to step S505 in which the device selection processor 72 determines whether the input represents selection of the tube or not. If the input does not represent selection of the tube, but a cancel which means going back to the preceding screen, then control returns to step S101 shown in FIG. 24.

If the input represents selection of the tube, then control proceeds to step S506 in which the device selection processor 72 reads an image (e.g., a photographic image or a computer graphic image) of the selected tube, and a description of the specifications of the selected tube, and displays them in the image display area 184 and the description display area 186.

In step S507, the device selection processor 72 determines whether the tube is decided on or not by determining whether there is an input representing going to a next screen or not. If there is an input representing a cancel, then control goes back to step S504, carrying out the tube selecting sequence again. If the tube is decided on, then the tube selecting sequence is put to an end.

If the processing in step S107 shown in FIG. 24, the processing in step S111 in FIG. 25, or the processing in step S116 in FIG. 26 is finished, then control goes to step S117 shown in FIG. 24 to determine whether the selection of all devices is ended or not. If the selection of all devices is not ended, then control returns to step S101 to display the screen 140 again.

If the selection of a cylinder, a solenoid valve, a flow control equipment, and a tube is ended in step S117, then the processing sequence of the circuit setting processor 70 is put to an end.

Control now returns to the main routine shown in FIG. 22, and the characteristic calculation processor 74 performs its processing sequence in step S4.

Figure 33:
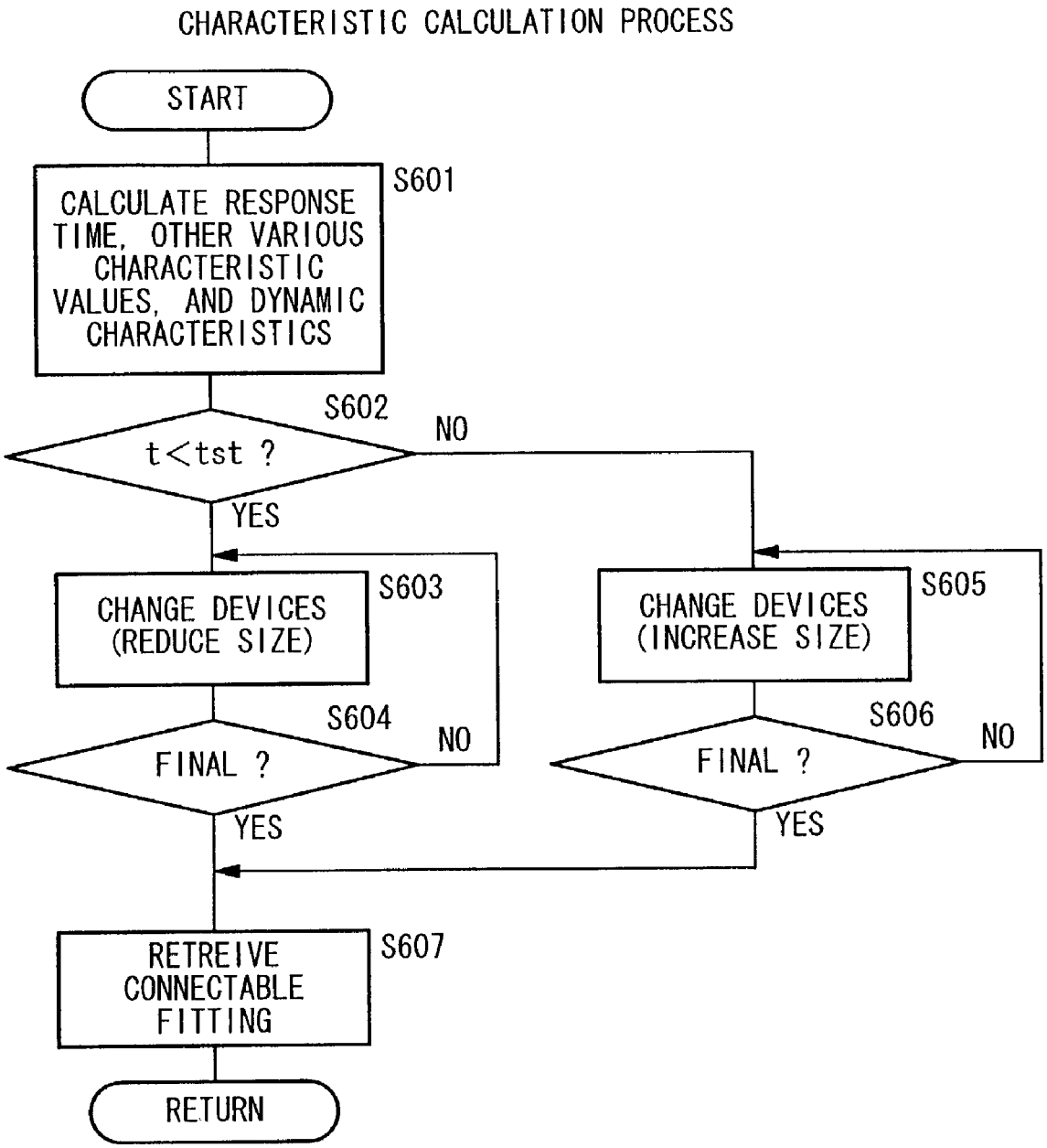
FIG. 33 is a flowchart of a processing sequence of a characteristic calculation processor.

In step S601 shown in FIG. 33, the characteristic calculation processor 74 calculates a response time t, other various characteristic values, and dynamic characteristics of the selected cylinder operating system, based on the model numbers, the circuit configurations in the circuit configuration setting screens, and the entered usage conditions of the cylinder, the solenoid valve (including the exhaust processing device), the flow control equipment, and the tube which have been selected as described above.

The characteristic calculation processor 74 calculates numerical values according to simultaneous basic equations for the cylinder, the solenoid valve, the flow control equipment, the tube, the fittings, etc. as shown in FIGS. 28A through 28C and FIGS. 34A through 34D.

Specifically, in a physical model of the cylinder operating system shown in FIG. 28A, a flow rate qm through a restriction is expressed by basic equations (1a), (1b) shown in FIG. 28B. For a choked flow, i.e., if $p2/p1 \leqq b$, then the flow rate qm is expressed by the equation (1a). For a subsonic flow, i.e., if $p2/p1 > b$, then the flow rate qm is expressed by the equation (1b).

Equations of the flow rates through the solenoid valve, the flow control equipment, the tube, the fittings, etc. are obtained from the equations (1a), (1b) shown in FIG. 28B. In view of changes in the temperature of the air, state equations (2) through (4), energy equations (5) through (7), and a kinetic equation (8) shown in FIG. 28C are satisfied as basic equations for an air cylinder.

For a tube line model shown in FIG. 34A, basic equations for a tube line (piping) shown in FIG. 34B are expressed as a continuous equation (9), a state equation (10), a kinetic equation (11), and an energy equation (12).

The tube line is divided into n elements as shown in FIG. 34C, and basic equations for the ith element are expressed as a continuous equation (13), a state equation (14), a kinetic equation (15), and an energy equation (16). The symbols and suffixes of the basic equations shown in FIGS. 28A through 28C and FIGS. 34A through 34D are described in FIG. 35.

In step S602 shown in FIG. 33, the characteristic calculation processor 74 determines whether the response time t of the selected cylinder operating system is shorter than the specified response time tst or not. If the response time t shorter than the specified response time tst ($t<tst$), then control goes to steps S603, S604. In steps S603, S604, since the sizes of the selected devices have margins, the sizes of the selected devices are reduced to a level closest to the specified response time tst.

In steps S603, S604, specifically, (1) the size of the largest device (the solenoid valve, the flow control equipment, the tube, the fitting, and the exhaust processing device) other than the cylinder is reduced, then (2) if good results are obtained from the size reduction, the reduction of the size of the largest device is continued, and (3) when the size of a certain device has reached a lower limit, this device is removed from the devices to be reduced in size, and the size of another device is reduced, and when there are no longer any devices to be reduced in size, the results obtained so far are used as final results, and (4) when $t \geqq tst$ owing to a reduction in the size of a certain device, the device changing process is finished, and the results immediately prior to the end of the device changing process are used as final results.

If the response time t of the cylinder operating system is equal to or greater than the specified response time tst ($t \geqq tst$), then control goes to steps S605, S606. In steps S605, S606, since the sizes of the selected devices are too small, the sizes of the selected devices are increased to a level closest to the specified response time tst.

In steps S605, S606, specifically, (1) the size of the smallest device (the solenoid valve, the flow control equipment, the tube, the fitting, and the exhaust processing device) other than the cylinder is increased, then (2) if poor results are obtained from the size increase, the size is returned to the value immediately prior to the size increase, and this device is removed from the devices to be increased in size, then (3) when the size of a certain device reaches an upper limit, since no devices to be increased in size are available, the selection is stopped, then (4) the selection is stopped when the minimum sound velocity conductance of those of the solenoid valve, the flow control equipment, the tube, and the fitting becomes a multiple of the sound velocity conductance of the cylinder, and (5) when $t<tst$ for the first time owing to an increase in the size of a certain device, the device changing process is finished, and the results immediately prior to the end of the device changing process are used as final results.

On the assumption that the cylinder has been selected, the minimum sizes of the solenoid valve, the flow control equipment, the tube, the fitting, and the exhaust processing device are selected while satisfying the specified response time tst according th a suitable selection in steps S602 through S606.

In step S607, a connectable fitting is retrieved from the fifth database DB5 based on the results of the above characteristic calculations. When the retrieval of the fitting is finished, the processing sequence of the characteristic calculation processor 74 is put to an end.

Control then goes back to the main routine shown in FIG. 22. In step S5, the second display processor 84 displays the screen 110 shown in FIG. 6 on the display screen of the display unit 28. In the screen 110, various characteristic values and dynamic characteristics obtained by the characteristic calculation processor 74 are displayed as graphs, and numerical values are displayed at locations corresponding to the respective items of the results.

In step S6, it is determined whether the cylinder classification, the solenoid valve classification, or the flow control equipment classification is to be changed or not based on whether there is an input which means going back to the preceding screen or not. If there is a command for changing the classification, then control returns to step 3 in which the circuit setting processor 70 performs its processing sequence again.

If there is no command for changing the classification, then control goes to step S7 which determines whether there is an independent characteristic calculation request or not based on whether the characteristic calculation button 128 in the screen 110 is clicked or not. If there is an independent characteristic calculation request, then control proceeds to step S8 in which the independent characteristic calculation processor 76 performs its processing sequence.

Figure 36:
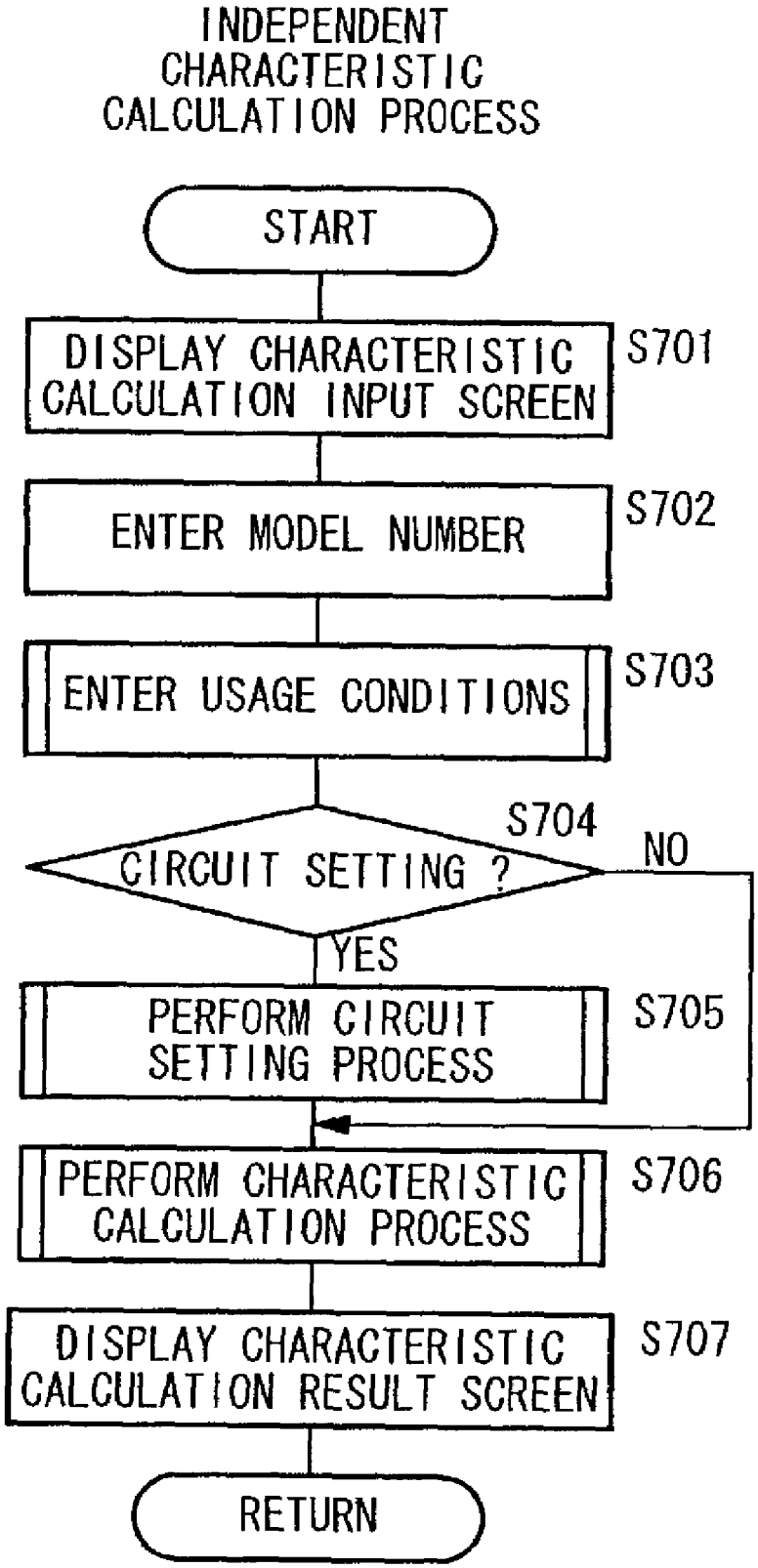
FIG. 36 is a flowchart of a processing sequence of an independent characteristic calculation processor.
Figure 37:
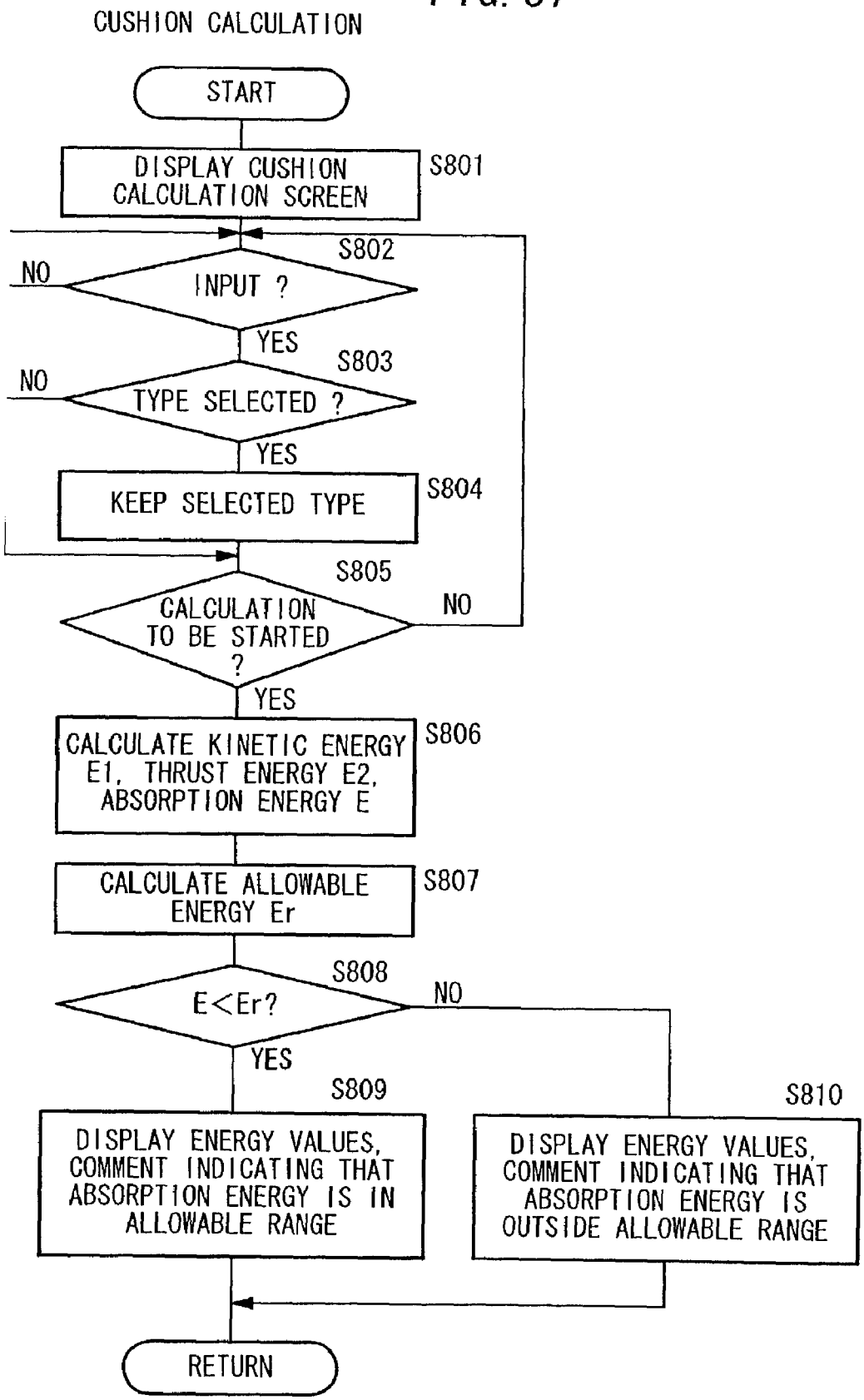
FIG. 37 is a flowchart of a processing sequence of a cushion calculation processor.

In step S701 shown in FIG. 36, the independent characteristic calculation processor 76 controls the seventh display processor 94 to display the screen 220 shown FIG. 15 on the display screen of the display unit 28. Thereafter, the user enters the model numbers of the devices and then enters various usage conditions in step S702. The use may enter the usage conditions using the wizard function described above.

In step S704, the independent characteristic calculation processor 76 determines whether there is a circuit setting request or not based on whether the circuit configuration request button 106 in the screen 220 is clicked or not. If there is a circuit setting request, then control goes to step S705 in which the circuit setting processor 70 performs its processing sequence. The processing sequence of the circuit setting processor 70 has been described above, and will not be described below.

When the processing sequence of the circuit setting processor 70 is finished, or if there is no circuit setting request in step S704, then control goes to step S706 in which the characteristic calculation processor 74 performs its processing sequence. The processing sequence of the circuit setting processor 70 has been described above, and will not be described below.

When the processing sequence of the characteristic calculation processor 74 is ended, then control goes to step S707 in which the display processor 96 displays a characteristic calculation result screen 222 shown in FIG. 16 on the display screen of the display unit 28. When the characteristic calculation result screen is displayed, then calculation of the independent characteristic calculation processor 76 is ended.

Control returns to the main routine shown in FIG. 22. In step S9, it is determined whether the screen 110 shown in FIG. 6 is to be displayed or not based on whether there is an input representing a cancel or not. If there is no input to display the screen 110, then control goes back to step S7 in which it is determined whether there is an independent characteristic calculation request or not. If there is an input to display the screen 110, then control returns to step S5 to display the screen 110 on the display screen of the display unit 28.

Figure 23:
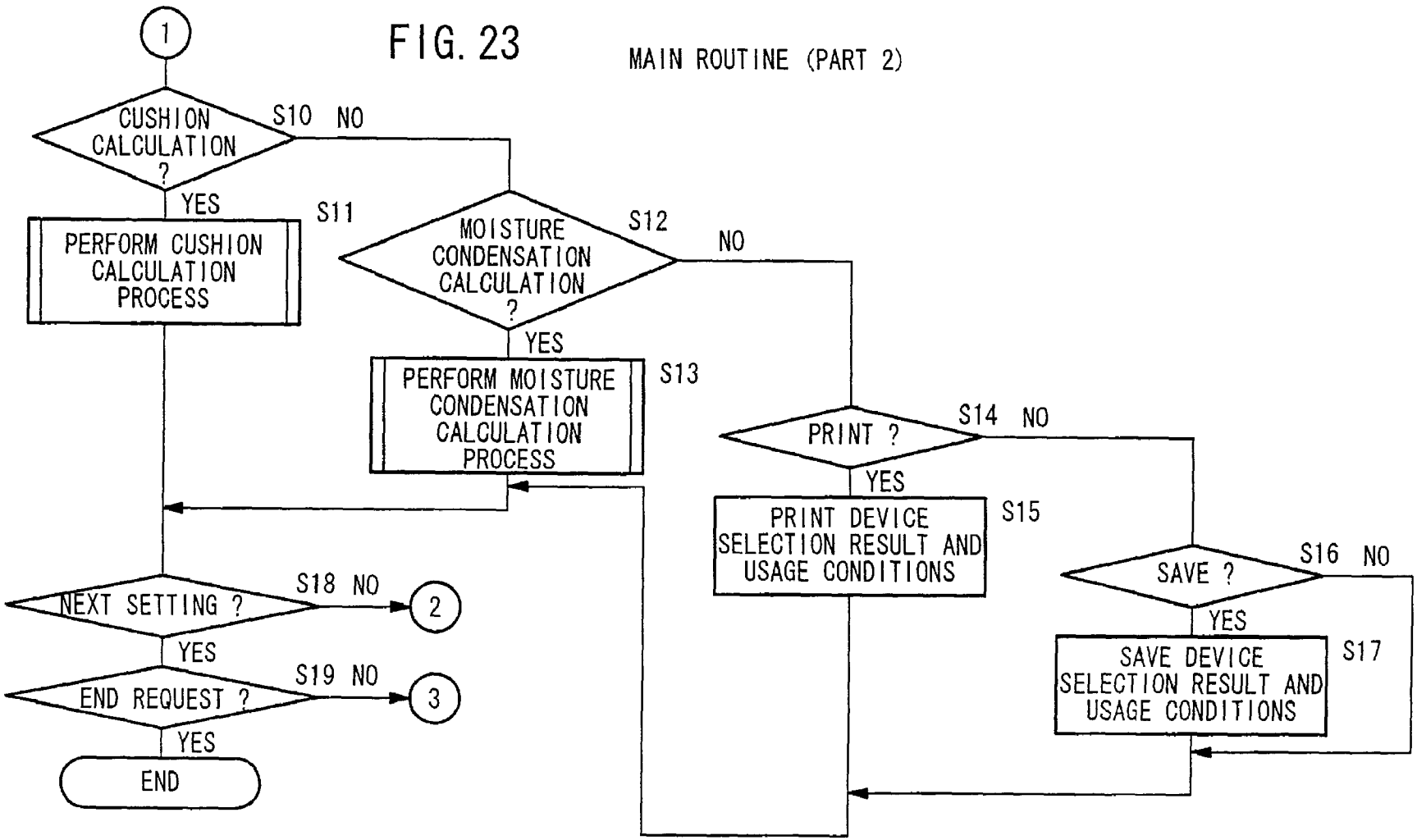
FIG. 23 is a flowchart of part 2 of the processing sequence of the first selection processor.

If there is no independent characteristic calculation request in step S7, then control goes to step S10 shown in FIG. 23 which determines whether there is a cushion calculation request or not based on whether the cushion calculation button 118 in the screen 110 or the cushion calculation button 118 in the screen 222 is clicked or not.

If there is a cushion calculation request, then control goes to step S11 in which the cushion calculation processor 78 performs its processing sequence. In step S801 shown in FIG. 37, the cushion calculation processor 78 controls the ninth display processor 98 to display the screen 240 shown in FIG. 17 on the display screen of the display unit 28.

In step S802, the cushion calculation processor 78 waits for an input from the user. If there is an input from the user, then control goes to step S803 in which the cushion calculation processor 78 determines whether the input represents the selection of a cushion style and a workpiece mounting type or not. If the input represents the selection of a cushion style and a workpiece mounting type, then control goes to step S804 in which the cushion calculation processor 78 keeps the cushion style and the workpiece mounting type which have been selected.

When the processing in step S804 is finished or if the input does not represent the selection of a cushion style and a workpiece mounting type in step S803, then control goes to step S805 in which the cushion calculation processor 78 determines whether the input represents a calculation start request or not based on whether the calculation start button 246 is clicked or not.

If the input does not represent a calculation start request, then control returns to step S802 in which the cushion calculation processor 78 waits for an input from the user. If the input represents a calculation start request, then control goes to step S806.

In step S806, the cushion calculation processor 78 calculates a kinetic energy E1, a thrust energy E2, and an absorption energy E of the cylinder based on the cylinder model number, the load mass, the mounting angle, the supply pressure, the stroke end velocity, the cushion style, and the workpiece mounting type. In step S807, the cushion calculation processor 78 calculates an allowable energy Er. The cylinder model number, the load mass, the mounting angle, the supply pressure, and the stroke end velocity are represented by values entered as usage conditions and values obtained from characteristic calculations.

In step S808, the cushion calculation processor 78 determines whether the calculated absorption energy E is smaller than the allowable energy Er or not. If the calculated absorption energy E is smaller than the allowable energy Er, then control goes to step S809 in which the cushion calculation processor 78 displays corresponding values at the respective items of the absorption and allowable energies and also displays a message that the absorption energy is in an allowable range as a comment statement, in the result display area 248.

In step S808, if the calculated absorption energy E is equal to greater than the allowable energy Er in step S808, then control goes to step S810 in which the cushion calculation processor 78 displays corresponding values at the respective items of the absorption and allowable energies and also displays a message that the absorption energy is outside an allowable range as a comment statement, in the result display area 248.

When the processing in step S809 or step S810 is finished, the processing sequence of the cushion calculation processor 78 is ended.

Control goes back to the main routine shown in FIG. 23. If there is no cushion calculation request in step S10, then control goes to step S12 which determines whether there is a moisture condensation calculation request or not based on whether the moisture condensation calculation button 120 in the screen 110 in FIG. 6 or the moisture condensation calculation button 120 in the screen 222 in FIG. 16 is clicked or not.

If there is a moisture condensation calculation request, then control goes to step S13 in which the moisture condensation calculation processor 80 performs its processing sequence. In step S901 shown in FIG. 38, the moisture condensation calculation processor 80 controls the tenth display processor 99 to display the screen 250 shown in FIG. 18 on the display screen of the display unit 28.

In step S902, the moisture condensation calculation processor 80 waits for an input from the user. If there is an input from the user, then control goes to step S903 which determines whether the input represents the selection of a supplied air humidity or not. If the input represents the selection of a supplied air humidity, then control goes to step S904 in which the moisture condensation calculation processor 80 keeps the selected supplied air humidity.

When the processing in step S904 is finished or if the input does not represent the selection of a supplied air humidity in step S903, control goes to step S905 which determines whether the input represents a calculation start request or not based on whether the calculation start button 254 is clicked or not.

If the input does not represent a calculation start request, then control returns to step S902 in which the moisture condensation calculation processor 80 waits for an input from the user. If the input represents a calculation start request, then control goes to step S906.

In step S906, the moisture condensation calculation processor 80 calculates a low ambient temperature based on the cylinder model number, the tube model number, the tube length, the ambient temperature, the supply pressure, and the supplied air humidity. In step S907, the moisture condensation calculation processor 80 calculates a produced amount M of mist. The tube model number, the tube length, the ambient temperature, and the supply pressure are represented by values entered as usage conditions and values obtained from characteristic calculations.

In step S908, the moisture condensation calculation processor 80 determines whether a mist is produced or not, i.e., whether the produced amount of mist is greater than 0 or not. If the produced amount of mist is greater than 0, then control goes to step S909 in which the moisture condensation calculation processor 80 calculates a volume ratio Rv between the volume of the air in the cylinder as converted under the atmospheric pressure and the volume in the tube. In step S910, the moisture condensation calculation processor 80 calculates a critical produced amount Mc of mist.

In step S911, the moisture condensation calculation processor 80 determines how the produced amount M of mist is related to the critical produced amount Mc of mist. If M>Mc+b (b is a constant), then control goes to step S912 in which the moisture condensation calculation processor 80 displays a moisture condensation probability and a message that a moisture condensation will occur in the result display area 256 of the moisture condensation calculation screen 250 shown in FIG. 18.

If the produced amount M of mist is related to the critical produced amount Mc of mist by Mc−b≦M≦Mc+b, then control goes to step S913 in which the moisture condensation calculation processor 80 displays a moisture condensation probability and a message that a moisture condensation is indefinite in the result display area 256.

If the produced amount M of mist is related to the critical produced amount Mc of mist by M<Mc−b, or if the produced amount of mist is 0 in step S908, then control goes to step S914 in which the moisture condensation calculation processor 80 displays a moisture condensation probability and a message that a moisture condensation will not occur in the result display area 256.

When the processing in step S912, S913, or S914 is finished, the processing sequence of the moisture condensation calculation processor 80 is put to an end.

Control goes back to the main routine shown in FIG. 23. If there is no moisture condensation calculation request in step S12, then control goes to step S14 which determines whether there is a print request or not based on whether the print button 122 in the screen 110 or the print button 122 in the screen 222 in FIG. 16 is clicked or not.

If there is a print request, then control proceeds to step S15 in which the results (the various characteristic values and the dynamic characteristics) of the device selection and the usage conditions are printed.

If there is no print request in step S14, then control goes to step S16 which determines whether there is a save request or not based on whether the save button 126 in the screen 110 in FIG. 6 or the save button 126 in the screen 222 in FIG. 16 is clicked or not.

If there is a save request, then control goes to step S17 in which the results (the various characteristic values and the dynamic characteristics) of the device selection and the usage conditions are recorded on a hard disk or an optical disk.

When the processing in step S11, S13, S15, or S17 is finished, control goes to step S18 which determines whether a new cylinder operating system is to be set or not. If the setting process or confirming process for the presently set cylinder operating system is to be continued, then control goes back to step S7 and following steps. If a new cylinder operating system is to be set, then control goes to step S19 which determines whether there is a request to end the program 50 or not. If there is no request to end the program 50, control returns to step S1 to wait for an input of new usage conditions. If there is a request to end the program 50, then the processing of the program 50 is put to an end.

The second selection processor 62 will be described below with reference to FIGS. 39 through 60.

The second selection processor 62 has been developed for the purpose of automatically selecting a shock absorber. The second selection processor 62 has main functions including a function to select shock absorber model numbers and a function to calculate a particular moment.

According to the function to select shock absorber model numbers, when a series name of shock absorbers, an impact style, and usage conditions are entered, the model numbers of shock absorbers which satisfy the absorption energy are automatically selected from the series, and a plurality of candidate devices are displayed in a sequence of sizes.

According to the function to calculate a particular moment, when a particular load type is selected and a mass and dimensions are entered, an inertial moment of the load is calculated.

The second selection processor 62 performs an automatic optimizing process for calculating an absorption energy which is represented by the sum of a kinetic energy and a thrust energy of the load, and selecting a device of minimum size which satisfies the absorption energy.

The second selection processor 62 can handle a wide variety of impact styles as combinations of linear and rotational impacts in horizontal, upward, and downward directions and at any desired angles and various external thrust types including cylinder and motor drive modes.

Figure 39:
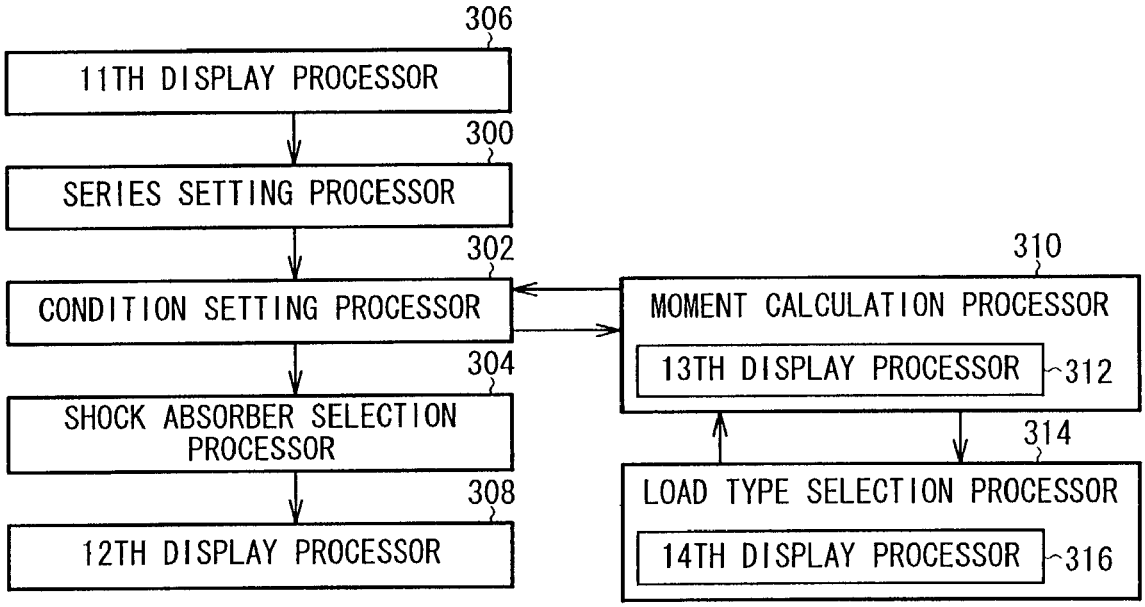
FIG. 39 is a functional block diagram of a second selection processor.

As shown in FIG. 39, the second selection processor 62 has a series setting processor 300 for setting a series of shock absorbers based on input data from the coordinate input unit 24 or the like, a condition setting processor 302 for setting at least an impact style and usage conditions based on input data from the coordinate input unit 24 or the like, and a shock absorber selection processor 304 for selecting a shock absorber of optimum size from the set series of shock absorbers.

The condition setting processor 302 has a function to set conditions with input data from the coordinate input unit 24 and also automatically set conditions (e.g., the model number, the load mass, the friction factor, the supply pressure, etc. of a cylinder) required to select a shock absorber, among the usage conditions set by the first selection processor 60.

Specifically, the second selection processor 62 is activated when the item of shock absorber selection in the menu screen 52 shown in FIG. 2 is clicked and also when the shock absorber selection button 130 in the screen 110 in the first selection processor 60 in FIG. 6 is clicked.

The second selection processor 62 is linked with the first selection processor 60, and selects a shock absorber under impact conditions based on the results of calculations performed by the characteristic calculation processor 74 controlled by the device selection processor 72 or the results of calculations performed by the independent characteristic calculation processor 76.

Figure 40:
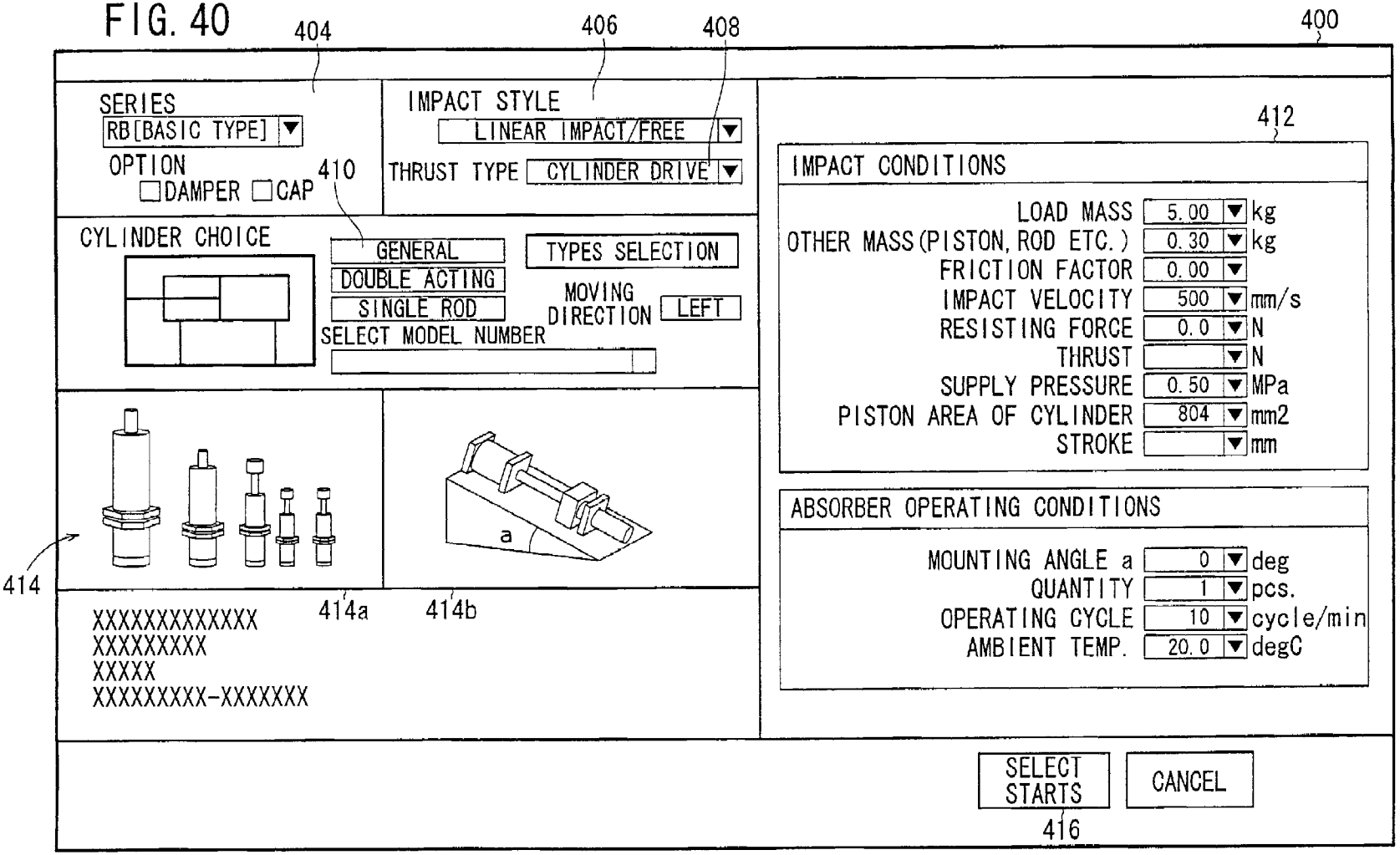
FIG. 40 is a diagram showing a displayed example of a first shock absorber selection input screen.
Figure 41:
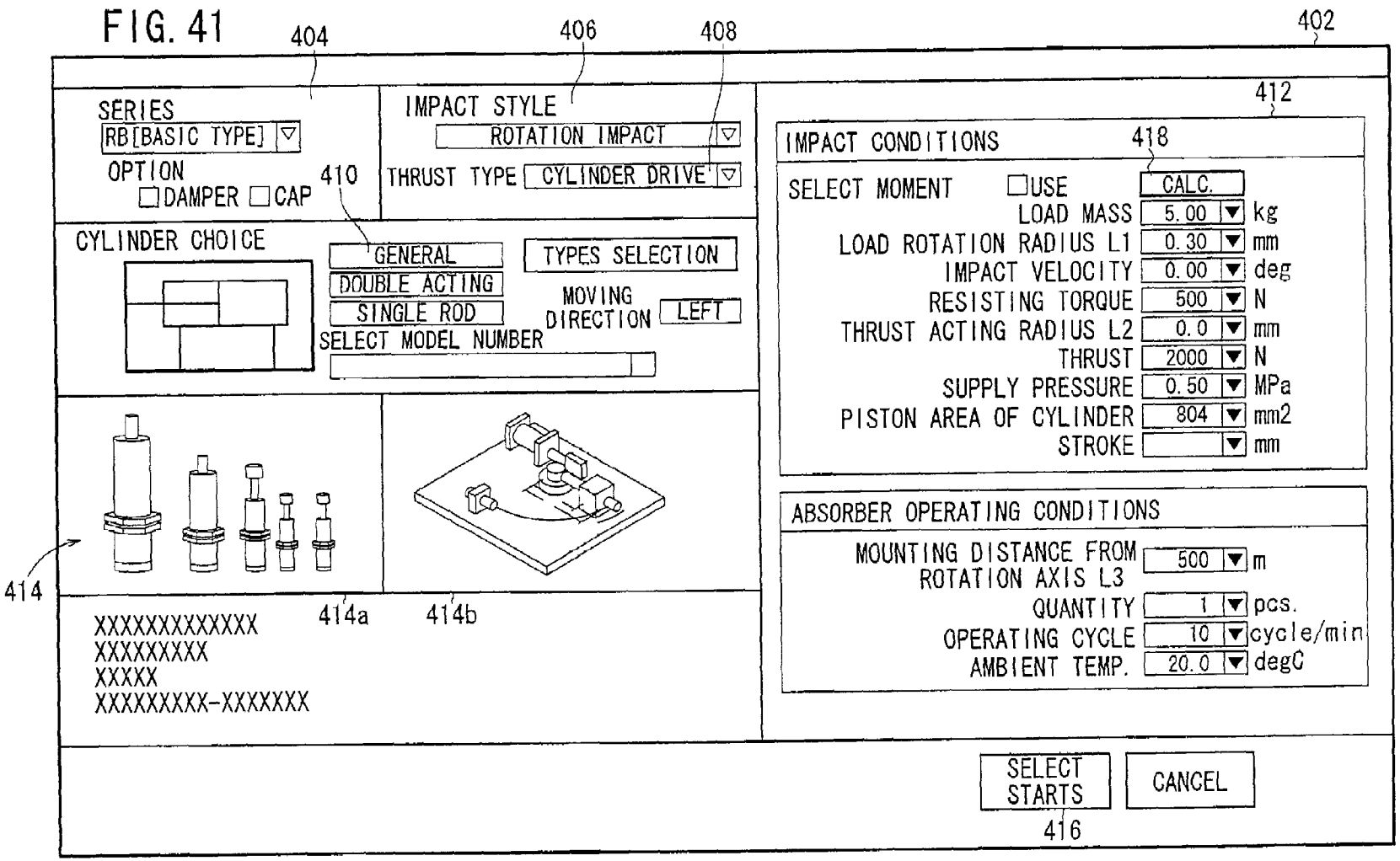
FIG. 41 is a diagram showing a displayed example of a second shock absorber selection input screen.

The second selection processor 62 also has an eleventh display processor 306 for displaying first and second shock absorber selection input screens 400, 402 (see FIGS. 40 and 41). As shown in FIG. 40, the screen 400 is a screen in relation to a linear impact, and has a series selection display area 404 for displaying a list of series for selecting a shock absorber series, an impact style display area 406 for selecting a style in which a load impinges on a shock absorber, a thrust display area 408 for selecting a thrust type acting on a shock absorber, a cylinder model number display area 410 for selecting a type and model number of a cylinder if a thrust type is a cylinder drive mode, a condition input area 412 for entering impact conditions and shock absorber usage conditions, an image display area 414 for displaying an image of a selected shock absorber, and a selection start button (icon) 416 for requesting a start of the selection of a shock absorber.

The image display area 414 includes a first area 414*a* for displaying the images of the appearances of selected shock absorbers, and a second area 414*b* for displaying an impact image in animation. Since an impact image is displayed in animation for each impact style, the user can easily recognize the impact image, finding it easy to enter items.

Of the items in the condition input area 412, an impact velocity represents a piston velocity at the time the piston (rod) of the cylinder impinges on an external stopper at a stroke end or any desired position, and a resisting force represents the sum of external forces other than a gravitational component of the load mass acting in the direction of operation of the piston, and a frictional force.

The second shock absorber selection input screen 402 is a view in relation to a rotational impact. While the second shock absorber selection input screen 402 shown in FIG. 41 is substantially similar to the first shock absorber selection input screen 400 (see FIG. 40) described above, the second shock absorber selection input screen 402 differs from the first shock absorber selection input screen 400 in that the condition input area 412 additionally includes a calculation request button (icon) 418 for requesting moment calculations.

Of the items in the condition input area 412, a resisting torque represents the sum of torques other than a gravitational component torque of the load mass acting in the direction of rotation of a rotary actuator or a motor, and a frictional torque.

Figure 42:
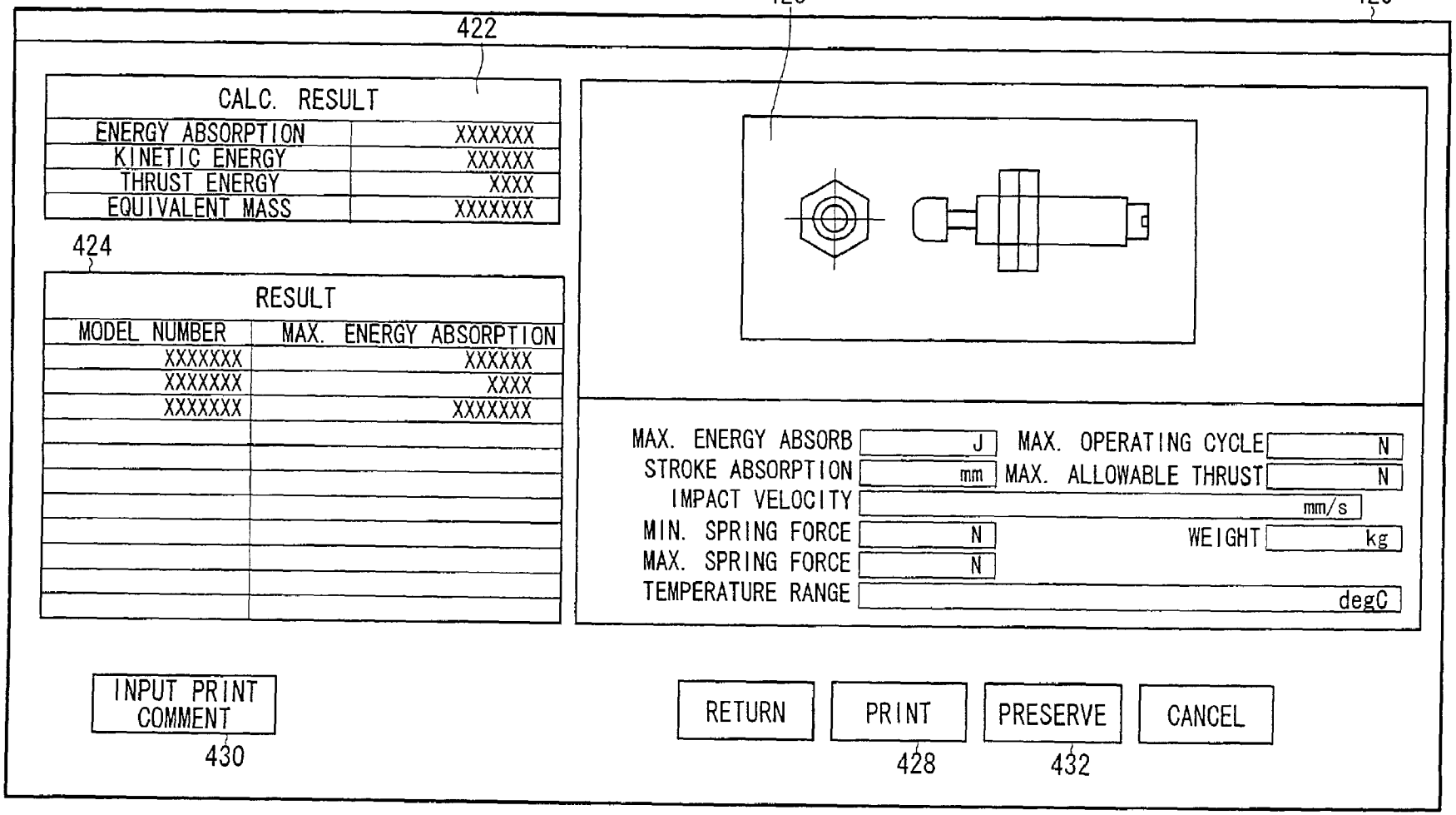
FIG. 42 is a diagram showing a displayed example of a shock absorber selection result screen.

As shown in FIG. 39, the second selection processor 62 also has a twelfth display processor 308 for displaying a shock absorber selection result screen 420 (see FIG. 42). As shown in FIG. 42, the screen 420 has a calculation result display area 422 for displaying calculation results including an absorption energy, an impact object equivalent mass, etc., a selection result display area 424 for displaying a list of model numbers of selected shock absorbers according to a sequence of maximum absorption energies, and a specification display area 426 for displaying a mounting dimension diagram and major specifications of a shock absorber selected from the list of selection results.

The screen 420 also has icons simulating a plurality of operating buttons in addition to the display areas 422, 424. These icons include a print button 428 for requesting the printing of selection results, calculation results, and entered conditions, a comment input button 430 for shifting to an input screen for entering comments to be printed on a lower portion of the printed sheet, and a save button 432 for requesting the saving of the selection results, the calculation results, and the entered conditions on a hard disk, or an optical disk such as a CD-R or a DVD-RAM, etc.

As shown in FIG. 39, the condition setting processor 302 has a moment calculation processor 310 for calculating an inertial moment based on input data from the coordinate input unit 24 or the like if a set impact style is a rotational impact mode. The moment calculation processor 310 is activated when the calculation request button 418 in the screen 402 shown in FIG. 41 is clicked. The moment calculation processor 310 is activated when calculation request button 418 in the screen 402 is clicked, and has a thirteenth display processor 312 for displaying a moment calculation screen 440 (see FIG. 43).

The screen 440 has a load type changing button (icon) 442 which is clicked to make a load type change request, an image display area 444 for displaying a load shape and type (pattern) which is selected, a numerical value input area 446 for entering the mass and dimensions of a load, and a calculation result display area 448 for displaying a calculated inertial moment.

Figure 43:
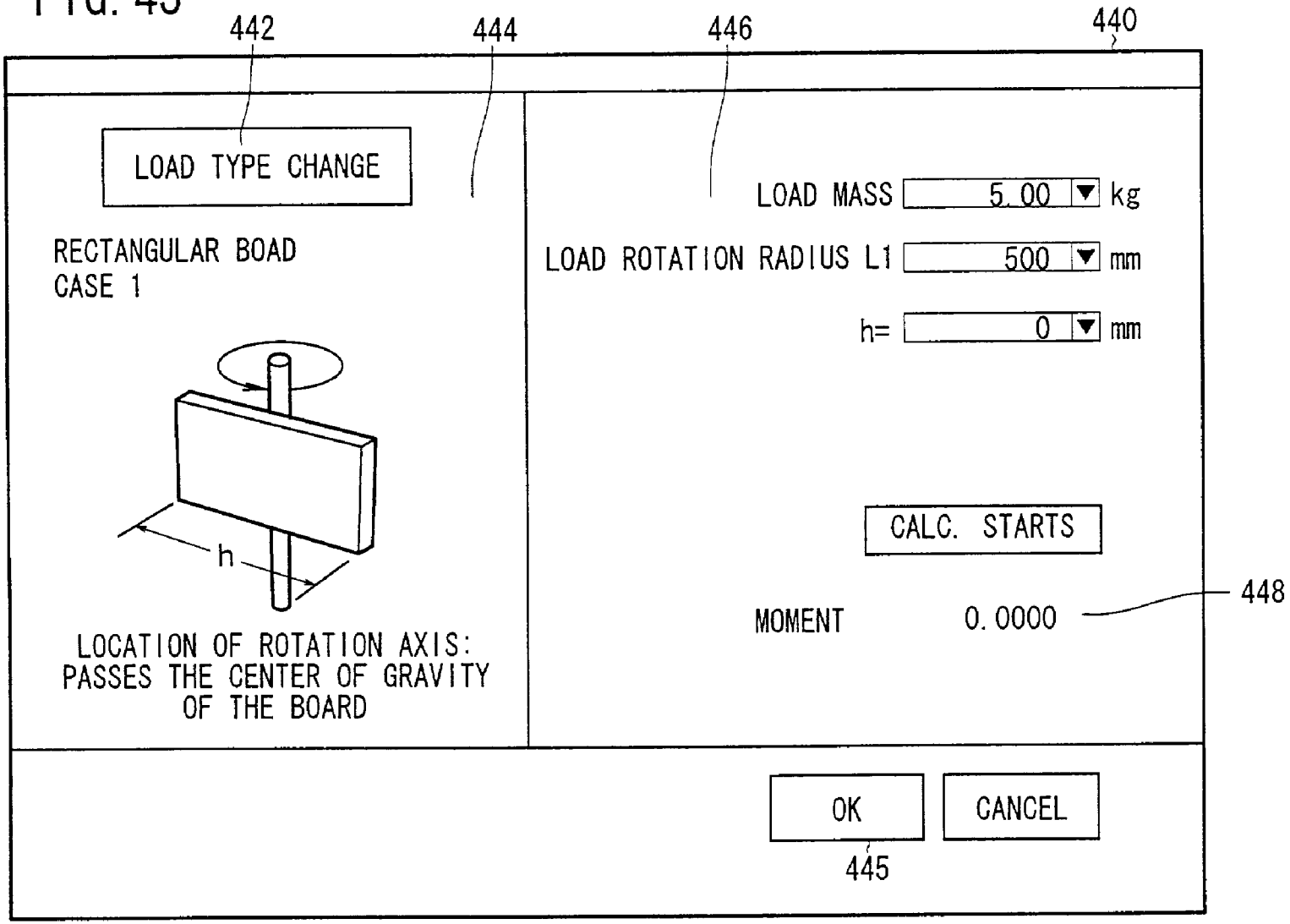
FIG. 43 is a diagram showing a displayed example of a moment calculation screen.

As shown in FIG. 39, the moment calculating processor 310 further has a load type selection processor 314 for selecting the shape of a load type and a rotational axis based on input data from the coordinate input unit 24 or the like. The load type selection processor 314 is activated when load type changing button 442 in the screen 440 shown in FIG. 43 is clicked. The load type selection processor 314 has a fourteenth display processor 316 for displaying a load type selection screen 450 (see FIG. 44).

Figure 44:
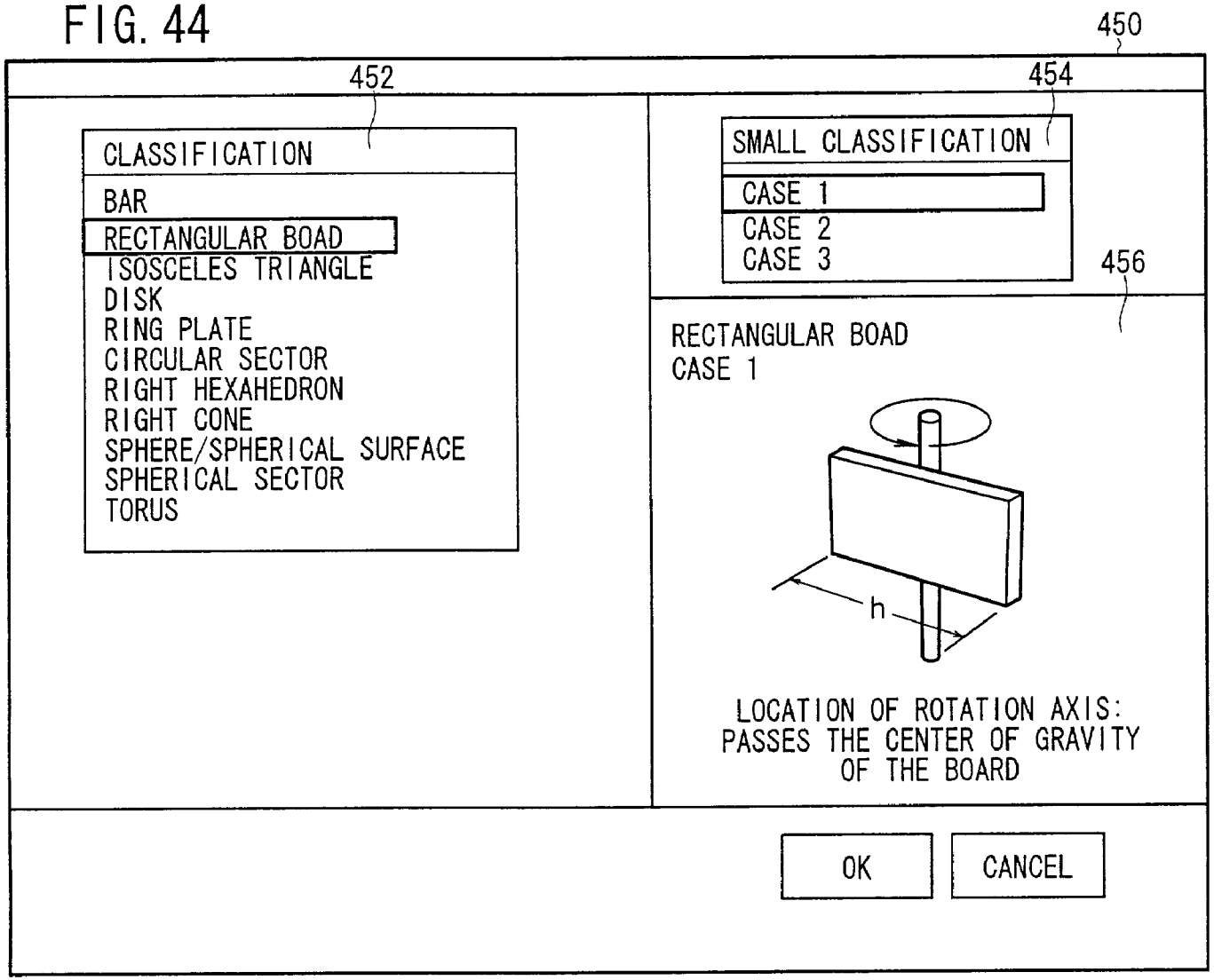
FIG. 44 is a diagram showing a displayed example of a load type selection screen.

As shown in FIG. 44, the screen 450 has a shape selection display area 452 for displaying a list of classifications in order to select the classification of a load type, and a rotational axis selection display area 454 for selecting a corresponding rotational axis from rotational axes for the selected classification of a load type. The rotational axis selection display area 454 includes an image display area 456 for displaying an image of the selected classification of a load type.

Processing operation of the second selection processor 62 will be described below with reference to FIGS. 45 through 60.

Figure 45:
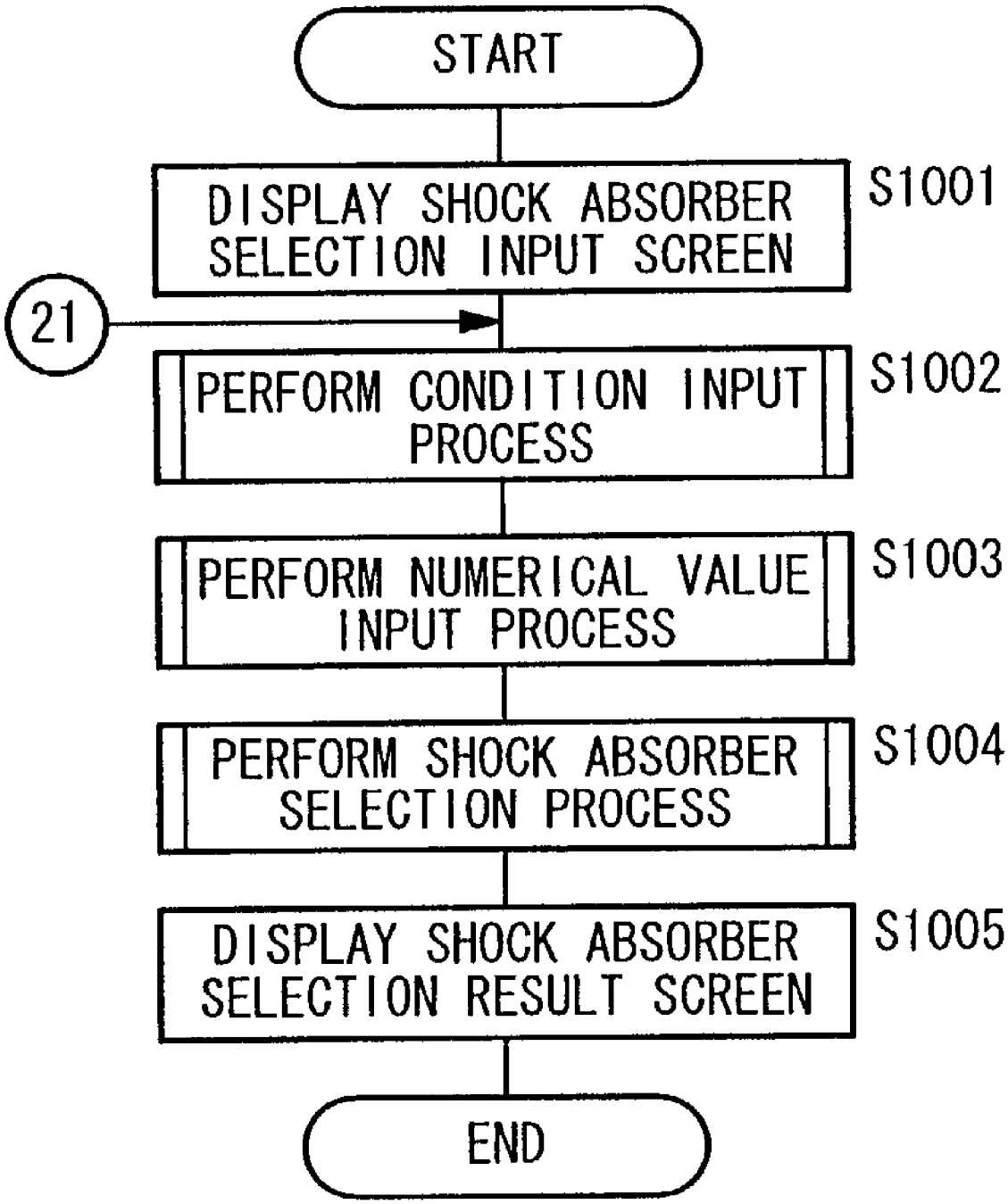
FIG. 45 is a flowchart of a processing sequence of the second selection processor.
Figure 46:
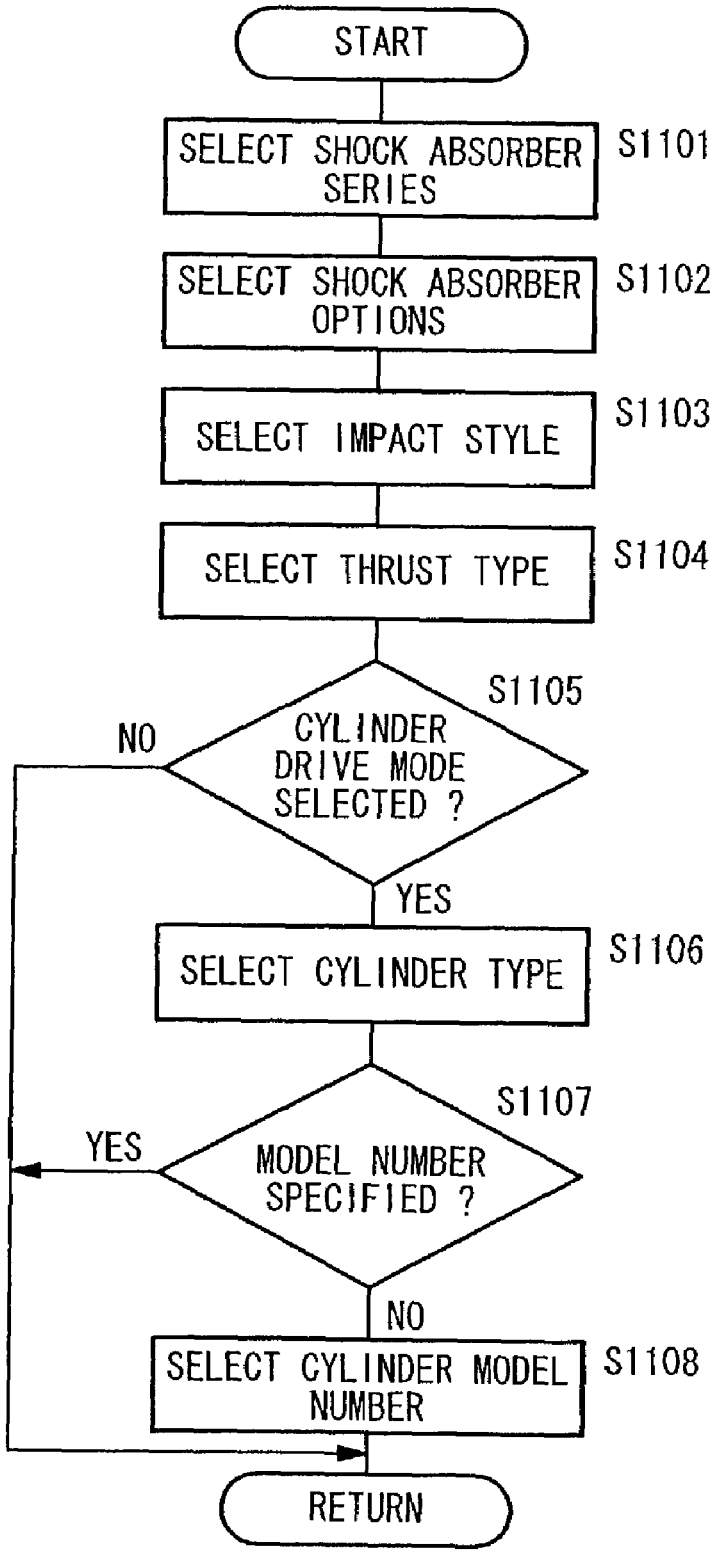
FIG. 46 is a flowchart of a processing sequence for entering conditions in a condition setting processor.

In step S1001 shown in FIG. 45, the second selection processor 62 controls the eleventh display processor 306 to display the screen 400 or 402 on the display screen of the display unit 28. Then, in step S1002, the condition setting processor 302 performs its processing sequence, particularly, a condition input processing sequence. In the condition input processing sequence, the condition setting processor 302 selects a shock absorber series based on input data from the coordinate input unit 24 or the like in step S1101 shown in FIG. 46.

In step S1102, the condition setting processor 302 selects shock absorber options based on input data from the coordinate input unit 24 or the like. Thereafter, in step S1103, the condition setting processor 302 selects the type of an impact style based on input data from the coordinate input unit 24 or the like. In step S1104, the condition setting processor 302 selects the type of a thrust based on input data from the coordinate input unit 24 or the like.

FIG. 47 shows the types of impact styles and thrust types that can be selected in steps S1103, S1104 and the relationship between calculation formulas, and FIGS. 48 through 55 show details of the calculation formulas depending on the types of impact styles and the thrust types. Information representing these details is registered as a shock absorber information table on a hard disk, for example. In a calculation process for selecting a shock absorber, as described later on, the impact style, the mounting type, and the thrust type which have been entered are read, and necessary calculation formulas are read and used as indexes to read necessary calculation for use in calculations.

In step S1105, the condition setting processor 302 determines whether a cylinder drive mode has been selected as the thrust type or not. If a cylinder drive mode has been selected, then control goes to step S1106 in which the condition setting processor 302 selects the type of a cylinder based on input data from the coordinate input unit 24 or the like.

In step S1107, the condition setting processor 302 determines whether the model number of a cylinder has been specified or not. If the model number of a cylinder has not been specified, then control goes to step S1108 in which the condition setting processor 302 selects the model number of a cylinder based on input data from the coordinate input unit 24 or the like.

When the processing in step S1108 is finished, or if the model number of a cylinder has been specified in step S1107 or if a cylinder drive mode has not been selected in step S1105, the condition input processing sequence of the condition setting processor 302 is put to an end. The processing in steps S1105 through S1108 is omitted if control has been shifted from the first selection processor 60.

Control goes back to the main routine shown in FIG. 45, and the condition setting processor 302 performs a numerical value input processing sequence in step S1003. In the numerical value input processing sequence, the condition setting processor 302 displays input items depending on the impact style and the thrust type which have been selected in the condition input processing sequence, in the condition input area 412 in step S1201 shown in FIG. 56.

In step S1202, the condition setting processor 302 waits for an input from the user. If there is an input from the user, then control goes to step S1203 in which the condition setting processor 302 determines whether the input represents numerical data or not. If the input represents numerical data, then control proceeds to step S1204 in which the condition setting processor 302 keeps the input items and the numerical data in association with each other. Control then returns to step S1202.

If the input does not represent numerical data, then control goes to step S1205 in which the condition setting processor 302 determines whether the input represents a moment calculation request or not based on whether the type of an impact style represents a rotational impact and the calculation request button 418 is clicked or not.

If the input represents a moment calculation request, then control goes to step S1206 in which the moment calculation processor 310 performs it processing sequence.

Figure 57:
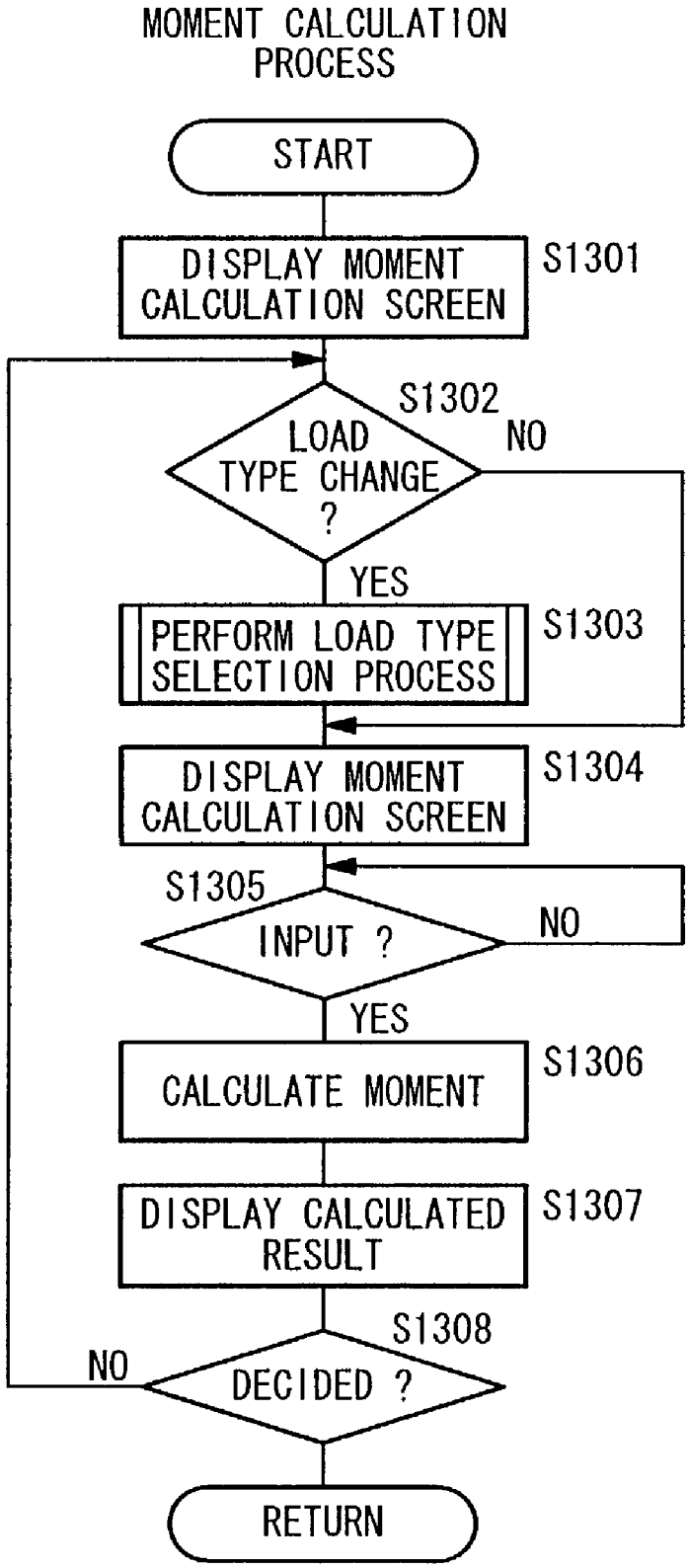
FIG. 57 is a flowchart of a processing sequence of a moment calculation processor.
Figure 58:
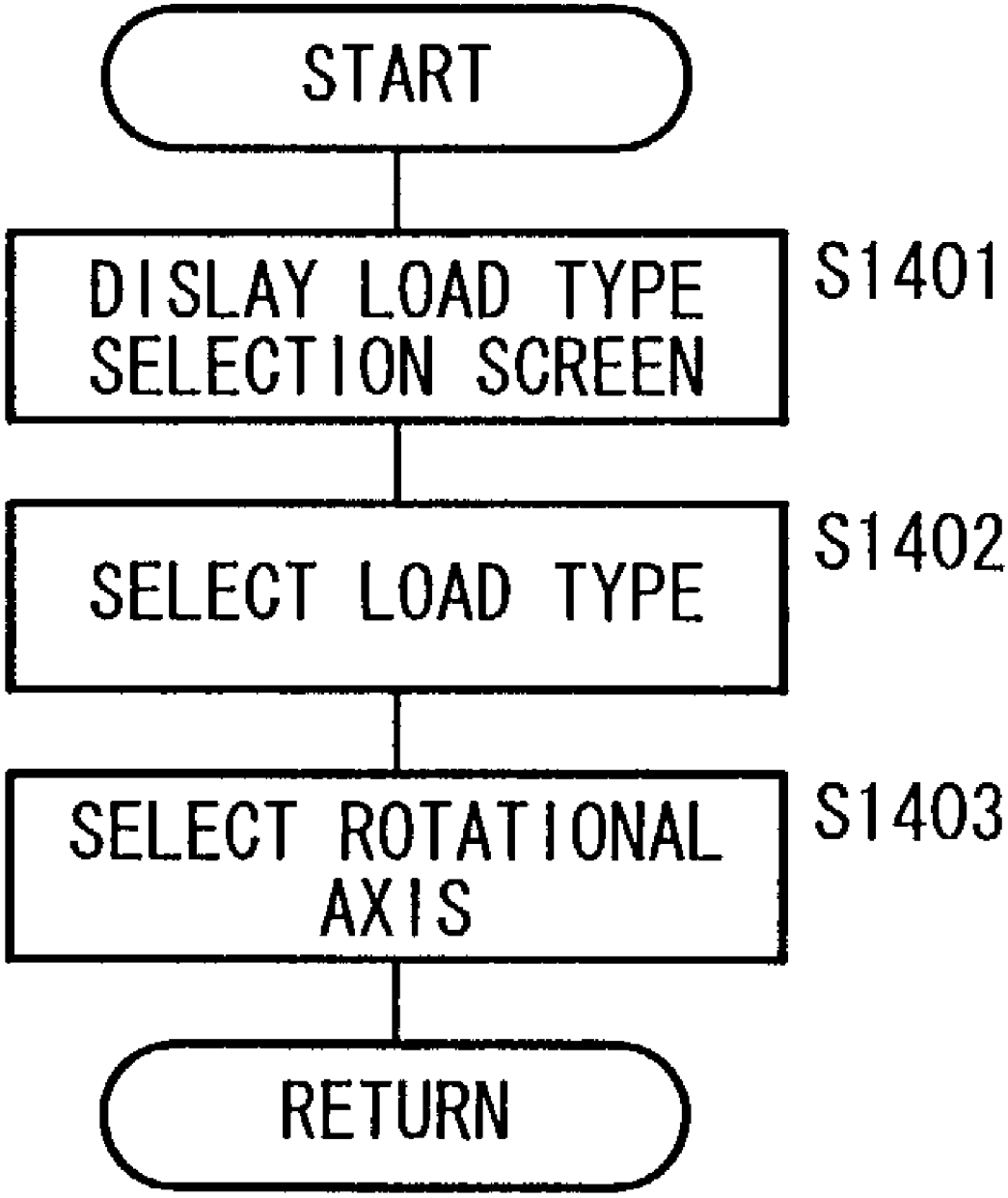
FIG. 58 is a flowchart of a processing sequence of a load type selection processor.
Figure 60:
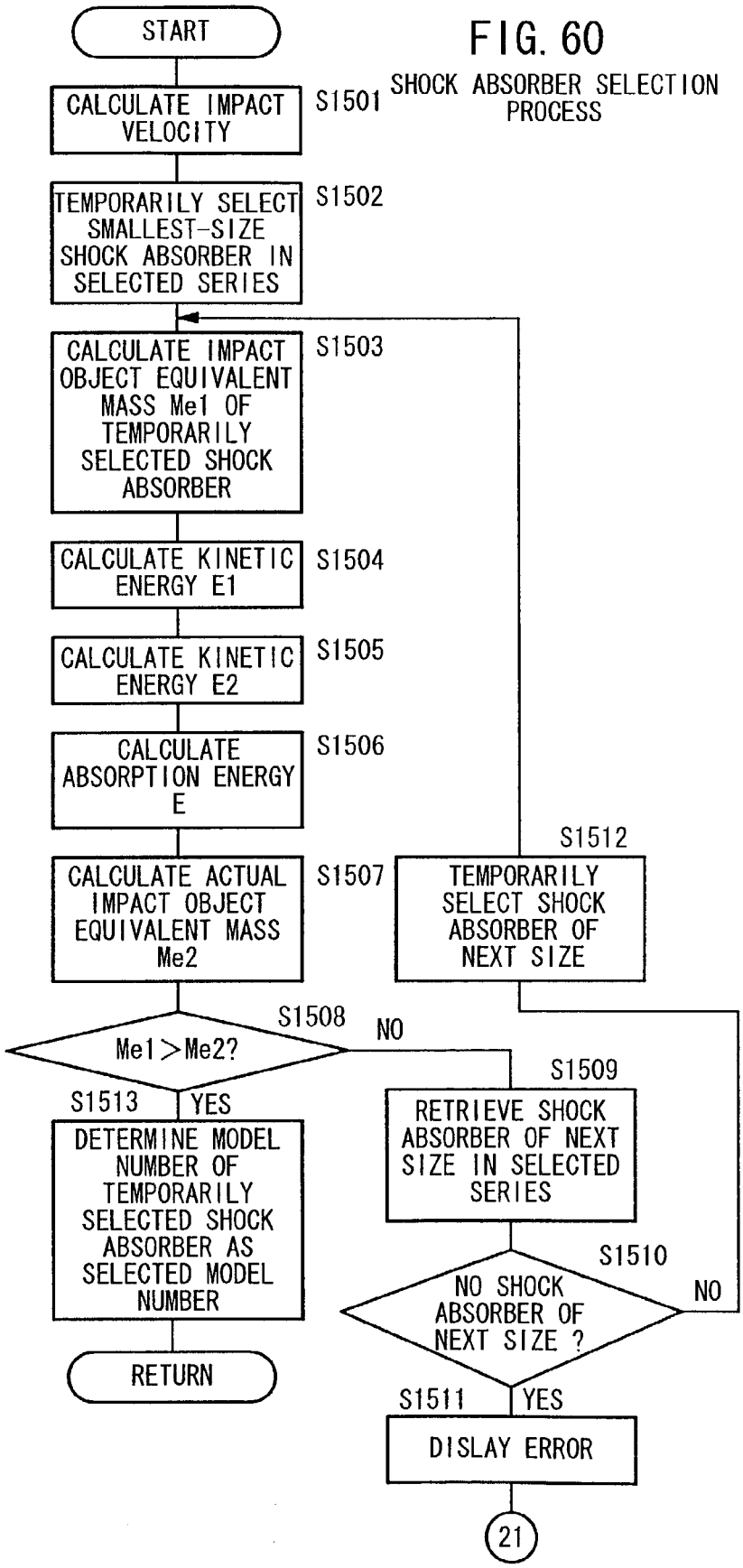
FIG. 60 is a flowchart of a processing sequence of a shock absorber selection processor.

In the processing sequence of the moment calculation processor 310, the moment calculation processor 310 displays the screen 440 shown in FIG. 43 on the display screen of the display unit 28 in step S1301 shown in FIG. 57. Then, the moment calculation processor 310 waits for an input from the user. When there is an input from the user, control goes to step S1302 in which the moment calculation processor 310 determines whether the input represents a load type change request or not based on whether load type changing button 442 is clicked or not.

If the input represents a load type change request, then control goes to step S1303 in which the load type selection processor 314 performs its processing sequence. In the processing sequence of the load type selection processor 314, the load type selection processor 314 displays the screen 450 shown in FIG. 44 on the display screen of the display unit 28 in step S1401 shown in FIG. 58. Then, in step S1402, the load type selection processor 314 selects the classification of a load type based on input data from the coordinate input unit 24 or the like. In step S1403, the load type selection processor 314 selects a rotational axis based on input data from the coordinate input unit 24 or the like.

FIG. 59 shows the classification of load types and the types (patterns) of rotational axes that can be selected in steps S1402, S1403. Calculation formulas are prepared in association with the classification of load types. Information representing these details is registered as a moment information table on a hard disk, for example. In a moment calculation process, as described later on, the classification of a load type and the type of a rotational axis which have been entered are read and used as indexes to read necessary calculation for use in calculations.

When the selection in steps S1402, S1403 is finished, the processing sequence of the load type selection processor 314 is put to an end.

Control then goes back to the main routine shown in FIG. 57. In step S1304, the moment calculation processor 310 controls the thirteenth display processor 312 to display the screen 440 shown in FIG. 43 again on the display screen of the display unit 28 in step S1304. Then, the moment calculation processor 310 waits for an input of numerical values from the user in step S1305. If there is an input of numerical values from the user, then control goes to step S1306 in which the moment calculation processor 310 calculates a moment based on the entered numerical values and corresponding calculation formulas. In step S1307, the moment calculation processor 310 displays a calculation result on the calculation result display area 448. Thereafter, the moment calculation processor 310 determines whether the calculation result is decided on or not in step S1308 based on whether an OK button 445 in the screen 440 is clicked or not. If the calculation result is not decided on, but canceled, then control goes back to step S1302 to wait for another input from the user. If the calculation result is decided on, then the processing sequence of the moment calculation processor 310 is ended.

Figure 56:
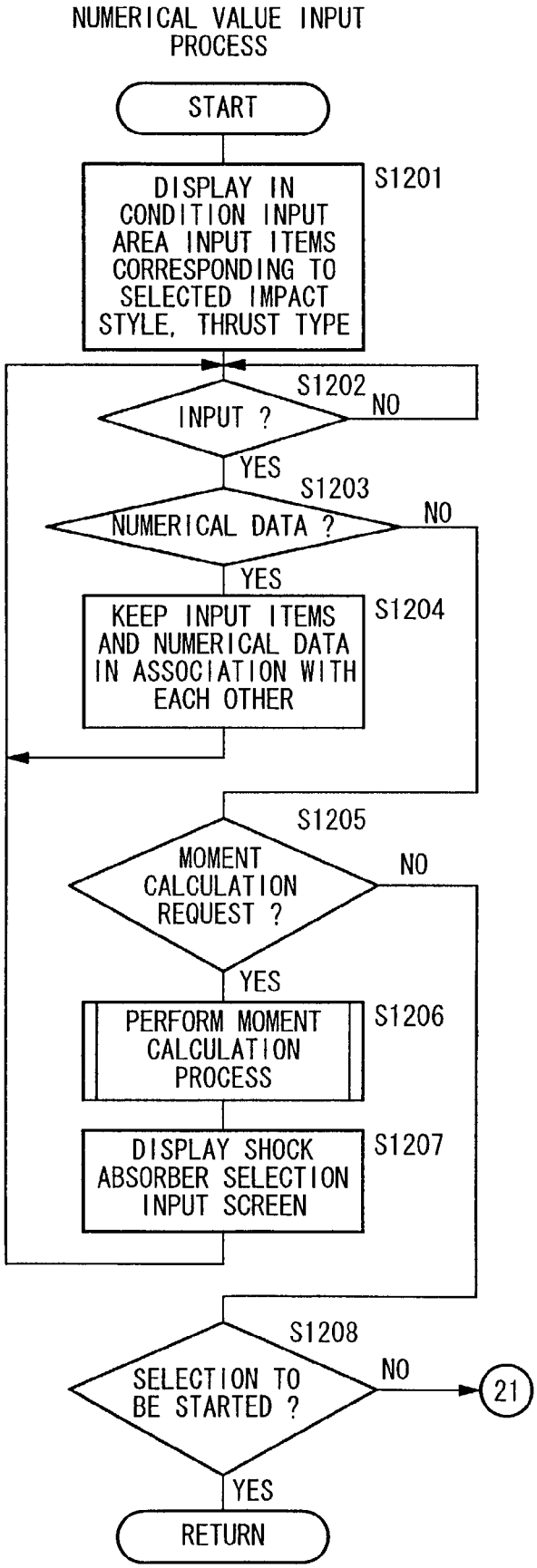
FIG. 56 is a flowchart of a processing sequence for entering numerical values in the condition setting processor.

Control then returns to the main routine shown in FIG. 56. When the moment calculation process in step S1206 is finished, control goes to step S1207 in which the condition setting processor 302 controls the eleventh display processor 306 to display the screen 402 which is being presently set on the display screen of the display unit 28. Thereafter, control goes back to step S1202 and following steps.

If the input does not represent a moment calculation request in step S1205, then the condition setting processor 302 determines, in step S1208, whether the input represents a selection start request or not based on whether the selection start button 416 is clicked or not.

If the input does not represent a selection start request in step S1207, but data indicative of a cancel, then control returns to step S1002 shown in FIG. 45, starting the condition input process again. If the input represents a selection start request, then the numerical value input processing sequence is put to an end.

Control returns to the main routine shown in FIG. 45. In step S1004, the shock absorber selection processor 304 performs its processing sequence. In the processing sequence of the shock absorber selection processor 304, the shock absorber selection processor 304 calculates an impact velocity in step S1501 shown in FIG. 60. Then, in step S1502, the shock absorber selection processor 304 temporarily selects a minimum-size shock absorber in the selected series.

In step S1503, the shock absorber selection processor 304 calculates an absorbable impact object equivalent mass Me1 of the temporarily selected shock absorber. To calculate the absorbable impact object equivalent mass Me1, the shock absorber selection processor 304 reads parameters for calculating the absorbable impact object equivalent mass Me1 of the temporarily selected shock absorber from the sixth database DB6.

In step S1504, the shock absorber selection processor 304 calculates a kinetic energy E1 based on various conditions that have been entered. In step S1505, the shock absorber selection processor 304 calculates a thrust energy E2 based on various conditions that have been entered. Thereafter, in step S1506, the shock absorber selection processor 304 adds the kinetic energy E1 and the thrust energy E2 into an absorption energy E.

In step S1507, the shock absorber selection processor 304 calculates an actual impact object equivalent mass Me2 from the calculated absorption energy E and various conditions that have been entered according to the following equation:

$$Me2=2\times E/(V^2\times N)$$

where V represents an impact velocity and N the number of shock absorbers that are used.

In step S1508, the shock absorber selection processor 304 determines whether the temporarily selected shock absorber matches the application based on whether the absorbable impact object equivalent mass Me1 of the temporarily selected shock absorber is greater than the actual impact object equivalent mass Me2.

If the absorbable impact object equivalent mass Me1 is equal to or smaller than the actual impact object equivalent mass Me2, indicating that the temporarily selected shock absorber does not match the application, then control goes to step S1509 in which the shock absorber selection processor 304 searches for a next greater shock absorber in the selected series. Thereafter, in step S1510, if no such shock absorber exists in the selected series, then control goes to step S1511 in which the shock absorber selection processor 304 displays an error message, e.g., "NO CORRESPONDING DEVICE EXISTS IN SELECTED SERIES", on the display screen of the display unit 28. Thereafter, control goes back to step S1002 shown in FIG. 45, starting the condition input processing sequence again.

If a next greater shock absorber exists in the selected series in step S1509, then control goes to step S1512 in which the shock absorber selection processor 304 temporarily selects the shock absorber. Thereafter, step S1503 and following steps are repeated.

If the temporarily selected shock absorber matches the application in step S1508, then control goes to step S1513 in which the shock absorber selection processor 304 determines the model number of the temporarily selected shock absorber as a selected model number. Then, the processing sequence of the shock absorber selection processor 304 is put to an end.

Then, control returns to the main routine shown in FIG. 45. In step S1005, the second selection processor 62 controls the twelfth display processor 308 to display the screen 420 shown in FIG. 42 on the display screen of the display unit 28. The processing sequence of the second selection processor 62 is now ended.

Subsequently, when the print button 428 is clicked, the results (the various energy values, the impact object equivalent mass, the various characteristic values) of the shock absorber selection are printed. When the save button 432 is clicked, these results (the various energy values, the impact object equivalent mass, the various characteristic values) of the shock absorber selection are saved on a hard disk or an optical disk.

A program for realizing one of the items on the menu screen 52 shown in FIG. 2, i.e., "VARIOUS SETTINGS (GENERAL-PURPOSE MASTER AND UNIT MASTER)" will be described below with reference to FIGS. 61 through 63.

Figure 61:
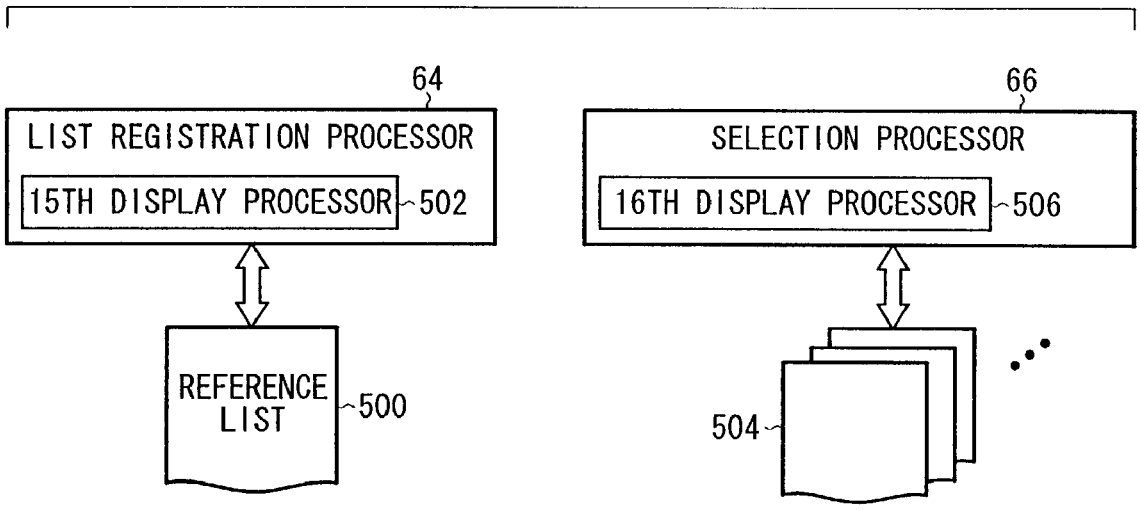
FIG. 61 is a functional block diagram of a list registration processor and a selection processor for the system of units.

As shown in FIG. 61, the general-purpose master is realized when the list registration processor 64 is activated. The list registration processor 64 has a function to register, in advance, input values that are used highly frequently in a reference list 500 which corresponds to the input items used to select a cylinder operating system and a shock absorber with the first and second selection processors 60, 62.

Figure 62:
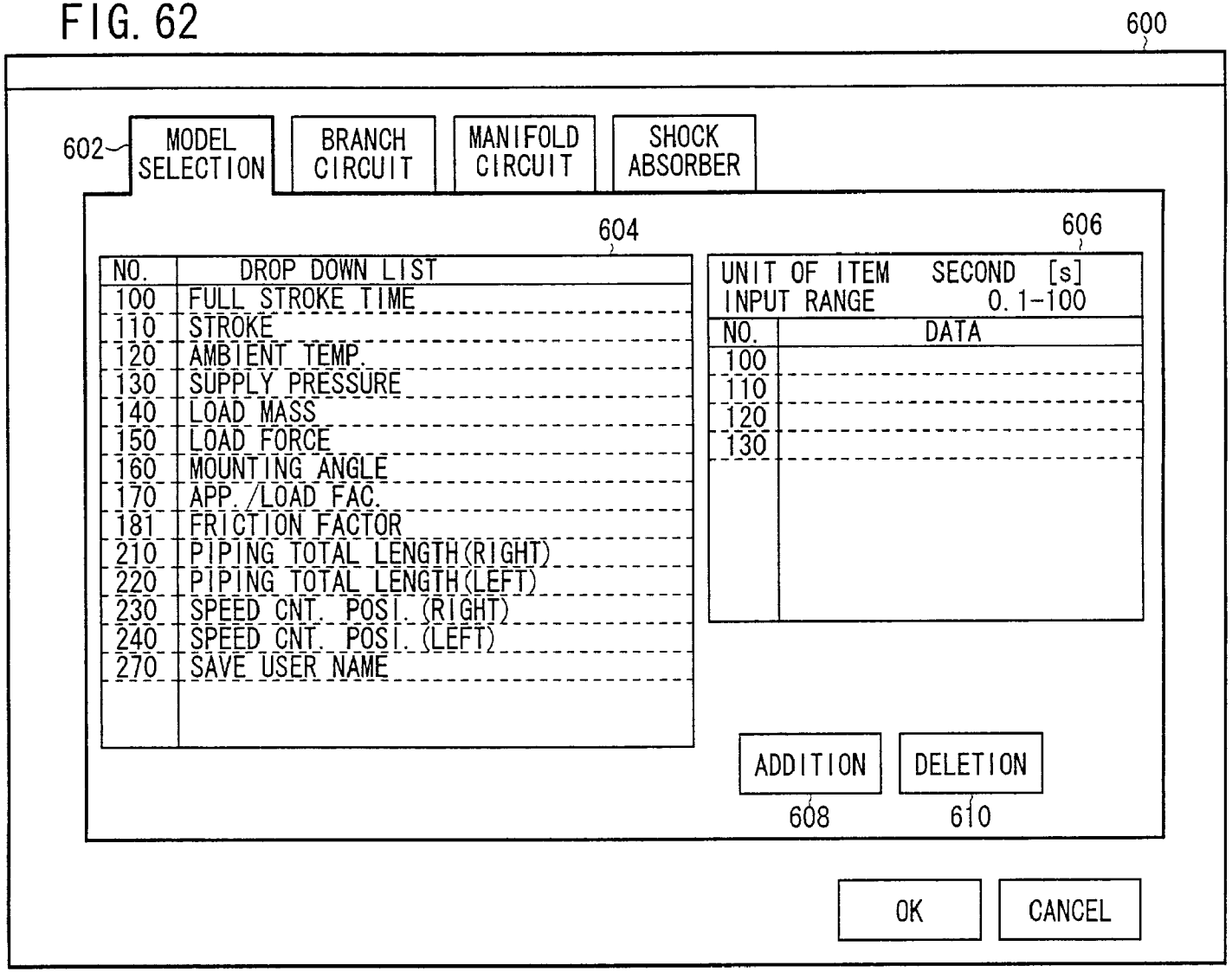
FIG. 62 is a diagram showing a displayed example of a general-purpose master screen.

The list registration processor 64 has a fifteenth display processor 502 for displaying a general-purpose master screen 600 (see FIG. 62). The screen 600 has a tag display area 602 for displaying a plurality of functions selectively with tags, an input item display area 604 for displaying a pull-down list of input items, a general-purpose data display area 606 for displaying a list of data registered in input items selected from the input item display area 604, an addition button (icon) 608 for adding general-purpose data, and a delete button (icon) 610 for deleting general-purpose data.

For editing general-purpose data, the general-purpose data is clicked and only numerical data is changed.

Use of the general-purpose master allows the reference list 500 to be used to refer to values that are used highly frequently for entering settings, so that the time required to enter data can be shortened efficiently.

The unit master is realized when the selection processor 66 shown in FIG. 61 is activated. The selection processor 66 has a function to select a list 504 of the system of units based on input data from the coordinate input unit 24 or the like, among a plurality of lists 504 for which the system of units to be used are registered in advance.

Figure 63:
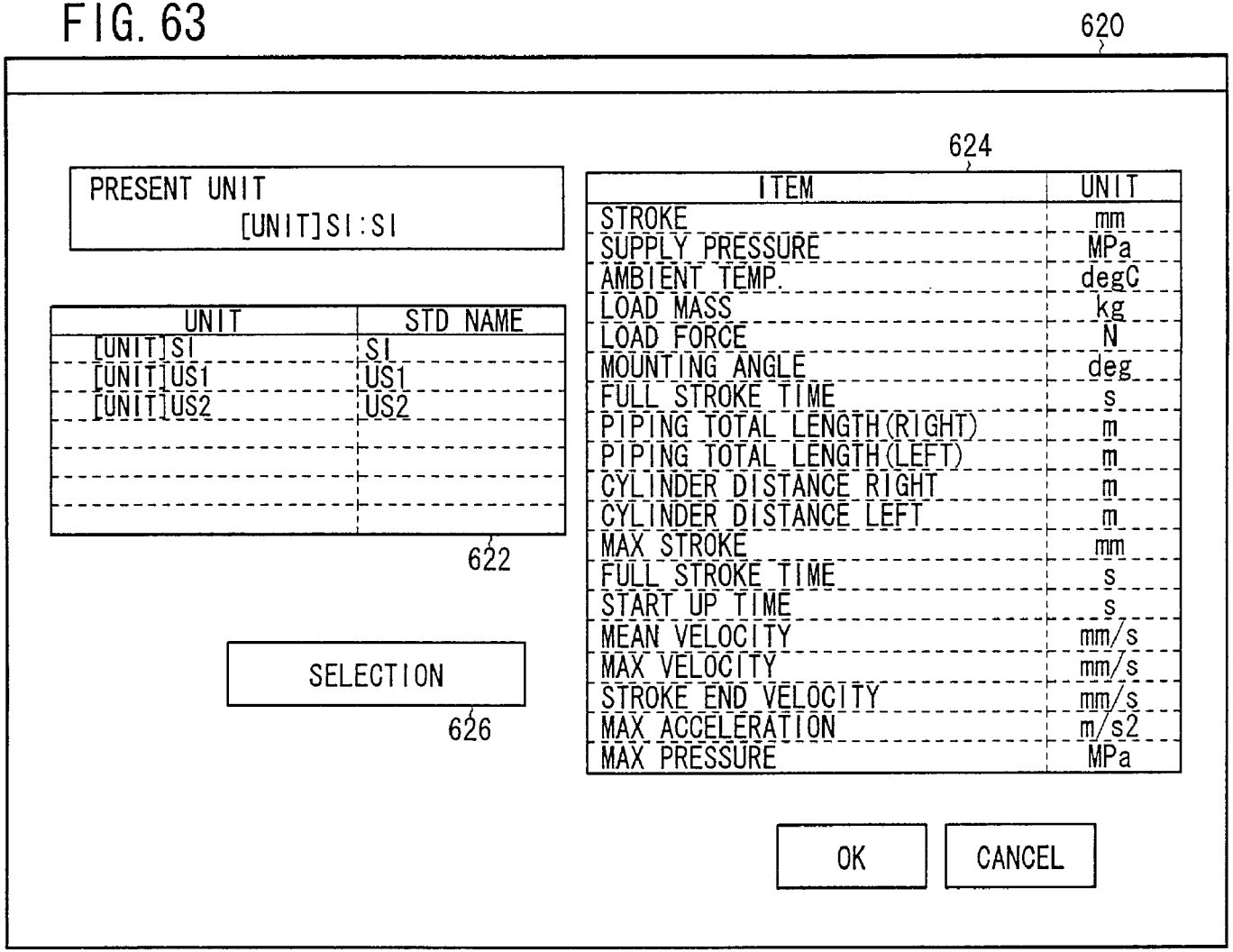
FIG. 63 is a diagram showing a displayed example of master screen for the system of units.

The selection processor 66 has a sixteenth display processor 506 for displaying a unit master screen 620 (see FIG. 63). As shown in FIG. 63, the selection processor 66 has a unit standard display area 622 for displaying a list of standards of registered units, a registered unit display area 624 for displaying a list of units registered in a unit standard, and a select button (icon) 626 for selecting a unit standard to be used among a plurality of unit standards displayed in the unit standard display area 622.

Use of the unit master allows the system of units to be selected at the time of entering data, thus permitting entered numerical values to be used as they are without the need for converting units.

The pneumatic device selecting system, the pneumatic device selecting method, the pneumatic device selecting program, and the recording medium according to the present invention provide the first selection processor 60 for selecting a cylinder operating system based on input data from the coordinate input unit 24 or the like, and the second selection processor 62 for selecting a shock absorber based on input data from the coordinate input unit 24 and/or the selected result from the first selection processor 60. Therefore, the pneumatic device selecting system, the pneumatic device selecting method, the pneumatic device selecting program, and the recording medium according to the present invention has more functions than the proposed method of selecting a pneumatic device (see Japanese laid-open patent publication No. 2000-179503), improves calculation processes, and increases the accuracy with which to select a pneumatic device.

In particular, the first selection processor 60 has the first display processor 82 for displaying, the circuit setting area 102 as a view for setting a circuit configuration, and the condition setting area 104 as a view for entering usage conditions. Therefore, the user can enter usage conditions in the condition setting area 104 while viewing a circuit configuration set in the circuit setting area 102. Therefore, the user finds it easy and efficient to make circuit settings.

The first selection processor 60 has the third display processor 86 for displaying, in graphs, characteristic values obtained by the characteristic calculation processor 74. The user can thus visually recognize characteristic values as an image, and easily make a comparison between those characteristic values and characteristic values of other settings.

The first selection processor 60 has the second display processor 84 for displaying, the pneumatic circuit, information of selected devices, entered usage conditions, and characteristic values obtained by the characteristic calculation processor 74. Since the pneumatic circuit, the information of selected devices, the entered usage conditions, and the characteristic values obtained by the characteristic calculation processor 74 are displayed as the results set by the first selection processor 60, the user can confirm the set information at a glance, and quickly verify the information for circuit design.

Particularly, the circuit setting processor 70 has the fourth display processor 88 for displaying a list of information of various devices which satisfy the usage conditions based on a request of a circuit configuration, together with a circuit configuration diagram. Usually, because a circuit designing process empirically sets circuits which satisfy usage conditions, it takes a very long period of time to achieve an optimum circuit through the circuit designing process. However, inasmuch as the circuit setting processor 70 according to the present invention automatically selects various devices which satisfy usage conditions and displays a list of those devices, the period of time required to select an optimum device is shortened because the user can select one from a list of devices while viewing a circuit configuration diagram.

The first selection processor 60 also has the sixth display processor 92 for displaying, in a sequence specified by the user, a selection screen (the circuit configuration setting screen 140) for selecting devices in relation to a pneumatic circuit and setting screens (190, 200, 210) for entering various usage conditions. Even in a setting process with complex procedures, the user can easily and efficiently perform a setting process simply by selecting items, for example, according to guidance instructions.

The device selection processor 72 has the fifth display processor 90 for displaying a list of devices related to the pneumatic circuit and satisfying usage conditions, and also displaying at least outer profile images and specifications of devices selected from the displayed list of devices.

Usually, a process of selecting a device recognizes and empirically extracts various data of various devices, and has been problematic in that it takes a long period of time to select a device. However, since the device selection processor 72 automatically selects and displays a list of devices which satisfy usage conditions, and also displays at least outer profile images and specifications of devices selected from the displayed list of devices, the time required to select devices is reduced because the user can select optimum devices from the displayed list of devices while viewing outer profile images and specifications thereof.

The various display processors described above allow the user to select various devices simply and efficiently based on a GUI (Graphical User Interface) while viewing displayed images.

The first selection processor 60 has the independent characteristic calculation processor 76 for calculating characteristics of a cylinder operating system based on a pneumatic circuit set based on input data from the coordinate input unit 24 or the like, a device selected in relation to the pneumatic circuit, and usage conditions entered through the coordinate input unit 24 or the like.

In the process of selecting devices for a cylinder operating system which satisfy entered conditions which have been set, if the usage conditions are changed or desired usage conditions are set, the set data in the process of selecting devices do not need to be reset, but the independent characteristic calculation processor 76 can independently select devices which satisfy the new usage conditions. Therefore, unnecessary operations such as resetting data may be eliminated.

The independent characteristic calculation processor 76 according to the present invention has the seventh display processor 94 for displaying, the circuit setting area 224 for setting a pneumatic circuit, the condition setting area 228 for entering selecting conditions, and the model number input area 226 for entering the model number of a device. The independent characteristic calculation processor 76 also has the eighth display processor 96 for displaying, the pneumatic circuit, information of any desired device, entered usage conditions, and obtained characteristic values. The user can simply and efficiently select various devices with the independent characteristic calculation processor 76 while viewing displayed images.

The cushion calculation processor 78 is provided for calculating an energy to be absorbed by a cylinder based on the characteristics of the cylinder operating system which has been calculated, and the cushion style and the workpiece mounting type which have been selected through the coordinate input unit 24 or the like. Thus, it is possible to judge the cushioning capability of the cylinder operating system which is constructed of the various selected devices.

The moisture condensation calculation processor 80 is provided for calculating the probability of moisture condensation produced in the cylinder operating system based on the calculated characteristics of the cylinder operating system and air humidity selected through the coordinate input unit 24 or the like. Since a countermeasure against moisture condensation can be reviewed based on the calculated results, the reliability of the selected cylinder operating system in use can be increased.

The second selection processor 62 has the series setting processor 300 for setting a series of shock absorbers based on input data from the coordinate input unit 24 or the like, the condition setting processor 302 for setting an impact style and usage conditions based on input data from the coordinate input unit 24 or the like, and the shock absorber selection processor 304 for selecting a shock absorber of optimum size from the set series of shock absorbers.

Usually, a shock absorber is empirically selected by recognizing various data of various devices, and such a process takes a very long period of time to select a shock absorber. However, the second selection processor 62 can automatically and easily select a shock absorber of minimum size which matches any desired cylinder operating system, and also a shock absorber of minimum size which matches a cylinder operating system that has been set through the first selection processor 60. Consequently, the time required to select a shock absorber is greatly reduced.

The second selection processor 62 has the moment calculation processor 310 for calculating an inertial moment of a load by selecting a certain load type and entering a mass and dimensions of the load. Therefore, a shock absorber which matches a rotational impact can be selected with accuracy.

The second selection processor 62 has the eleventh display processor 306 for displaying, the series selection display area 404 for displaying a list of series for selecting a shock absorber series, the impact style display area 406 for selecting a style in which a load impinges on a shock absorber, the thrust display area 408 for selecting a thrust type acting on a shock absorber, the cylinder model number display area 410 for selecting a type and model number of a cylinder if a thrust type is a cylinder drive mode, the condition input area 412 for entering impact conditions and shock absorber usage conditions, and the image display area 414 for displaying an image of a selected shock absorber.

The second selection processor 62 thus allows the user to enter an impact style and a thrust type easily while viewing an image of a shock absorber. The time required to enter an impact style and a thrust type is therefore reduced. Furthermore, the time required to enter an impact style and a thrust type is reduced efficiently because at least impact conditions set by the first selection processor 60 can automatically be set.

The image display area 414 includes the first area 414*a* for displaying the images of the appearances of selected shock absorbers, and the second area 414*b* for displaying an impact image in animation. Since an impact image is displayed in animation for each impact style, the user can easily recognize the impact image, finding it easy to enter items.

The second selection processor 62 has the twelfth display processor 306 for displaying, the calculation result display area 422 for displaying calculation results including an absorption energy, an impact object equivalent mass, etc., the selection result display area 424 for displaying a list of model numbers of selected shock absorbers according to a sequence of maximum absorption energies, and the specification display area 426 for displaying a mounting dimension diagram and specifications of a shock absorber selected from the list of selection results.

The second selection processor 62 thus allows the user to confirm, at a glance, the dimensions, specifications, and various characteristics of the selected shock absorber, and to easily verify the selected shock absorber.

The list registration processor 64 is provided for registering, in advance, input values that are used highly frequently in the reference list 500 which corresponds to the input items used to select a cylinder operating system and a shock absorber with the first and second selection processors 60, 62. When entering set values, etc., the reference list 500 can thus be used to refer to values that are used highly frequently. Consequently, the time required to enter data is efficiently reduced.

The selection processor 66 is provided for selecting a list 504 of the system of units based on input data from the coordinate input unit 24 or the like, among a plurality of lists 504 for which the system of units to be used are registered in advance. At the time of entering numerical values, the system of units is selected, dispensing with the need for converting units, and the numerical values that have been entered can be used as they are. Therefore, the trouble of unit conversions at the time of entering numerical value is eliminated.

In the foregoing description, the scope of a term "processor" is not limited to hardware components. The "processor" includes software components such as a program, or a part of a program.

Although a certain preferred embodiment of the present invention has been shown and described in detail, it should be understood that various changes and modifications may be made therein without departing from the scope of the appended claims.

What is claimed is:

1. A system for selecting a pneumatic device, comprising:

a computer;

a database connected to said computer and storing data of at least pneumatic devices;

an input unit connected to said computer, for entering input data based on an input action of an operator into said computer;

a display unit connected to said computer, for displaying information from said computer;

a first selection processor for selecting a cylinder operating system based on input data from said input unit;

a second selection processor for selecting a shock absorber based on input data from said input unit and/or a selection result from said first selection processor;

a circuit setting processor for setting a pneumatic circuit based on input data from said input unit;

a characteristic calculation processor for calculating characteristics of said cylinder operating system based on a device selected through said input unit and the pneumatic circuit; and a moisture condensation calculation processor for calculating the probability of moisture condensation produced in said cylinder operating system based on the characteristics of said cylinder operating system and humidity information entered through said input unit, wherein said first selection processor has a display processor for displaying, in graphs, characteristic values obtained by said characteristic calculation processor.

2. A system according to claim 1, wherein said first selection processor comprises:

a device selection processor for automatically selecting a device which is related to the pneumatic circuit and satisfies usage conditions entered through said input unit, based on information about devices registered in said database.

3. A system according to claim 2, wherein said first selection processor has a display processor for displaying a first setting area for setting a pneumatic circuit and a second setting area for entering said usage conditions.

4. A system according to claim 2, wherein said first selection processor has a display processor for displaying at least the pneumatic circuit, information of the selected device, the entered usage conditions, and characteristic values obtained by said characteristic calculation processor.

5. A system according to claim 2, wherein said circuit setting processor has a display processor for displaying a list of information related to devices which satisfy said usage conditions based on a request of a circuit configuration, together with a circuit configuration diagram.

6. A system according to claim 2, wherein said first selection processor has a display processor for displaying a selection screen for selecting devices related to said pneumatic circuit according to guidance instructions, and input screens for entering said usage conditions in a sequence specified by the operator.

7. A system according to claim 2, wherein said device selection processor has a display processor for displaying a list of devices which are related to said pneumatic circuit and satisfy said entered usage conditions, and displaying at least outer profile images and specifications of devices selected from the displayed list of devices.

8. A system according to claim 2, further comprising:

a device limitation processor for limiting devices automatically selected by said device selection processor based on input data from said input unit.

9. A system according to claim 1, wherein said first selection processor has an independent characteristic calculation processor for setting a pneumatic circuit based on input data from said input unit and calculating characteristics of said cylinder operating system based on said pneumatic circuit, a device selected in relation to the pneumatic circuit, and usage conditions entered through said input unit.

10. A system according to claim 9, wherein said usage conditions include a needle opening of an adjustable flow control equipment.

11. A system according to claim 10, wherein said independent characteristic calculation processor has a display processor for displaying a third setting area for setting said pneumatic circuit, a fourth setting area for entering said usage conditions, and a fifth setting area for entering an identification number of a device to be used.

12. A system according to claim 10, wherein said independent characteristic calculation processor has a display processor for displaying at least said pneumatic circuit, information of the selected device, the entered usage conditions, and characteristic values.

13. A system according to claim 10, wherein said independent characteristic calculation processor has a display processor for displaying a list of information related to devices which satisfy said usage conditions based on a request of a circuit configuration, together with a circuit configuration diagram.

14. A system according to claim 2, further comprising:

a cushion calculation processor for calculating an energy to be absorbed by a cylinder based on the characteristics of the cylinder operating system.

15. A system according to claim 1, wherein said second selection processor comprises:

a type setting processor for setting a type of shock absorbers based on input data from said input unit;

a condition setting processor for setting at least an impact style and usage conditions based on input data from said input unit; and a shock absorber selection processor for selecting a shock absorber of optimum size from the type of shock absorbers based on at least said impact style and said usage conditions.

16. A system according to claim 15, wherein said condition setting processor uses an impact condition determined by said first selection processor.

17. A system according to claim 1, further comprising:

a list registration processor for registering, in advance, input values that are used in a reference list which corresponds to input items used to select said cylinder operating system and said shock absorber with said first and second selection processors.

18. A system according to claim 1, further comprising:

a selection processor for selecting a list of the system of units based on input data from said input unit among a plurality of lists for which the system of units to be used are registered in advance.

19. A system for selecting a pneumatic device, comprising a computer;

an input unit connected to said computer, for entering input data based on an input action of an operator into said computer;

a display unit connected to said computer, for displaying information from said computer; and a moisture condensation calculation processor for calculating the probability of moisture condensation produced in a cylinder operating system based on characteristics of the cylinder operating system and humidity information entered through said input unit.

20. A system according to claim 19, wherein said moisture condensation calculation processor calculates the probability of moisture condensation using sizes of a cylinder and a tube of said cylinder operating system, and the humidity, temperature, and pressure of air supplied to said cylinder operating system.

21. A system according to claim 19, wherein said moisture condensation calculation processor calculates the probability of moisture condensation by calculating an amount of mist produced in said cylinder operating system and a volume ratio between said cylinder and said tube from selected devices or calculated characteristics of said cylinder operating system.

22. A system according to claim 21, wherein said moisture condensation calculation processor judges that no moisture condensation occurs in said cylinder operating system if the volume of the air in the cylinder as converted under atmospheric pressure≧an internal volume of a tube×a calculated amount of mist.

23. A system according to claim 19, further comprising:

a display processor for displaying at least a humidity selection area for selecting an air humidity based on input data from said input unit, and an area for displaying the value of the probability of moisture condensation.

24. A system for selecting a pneumatic device, comprising:

a computer;

a database connected to said computer and storing data of at least pneumatic devices;

an input unit connected to said computer, for entering input data based on an input action of an operator into said computer;

a display unit connected to said computer, for displaying information from said computer;

a type setting processor for setting a type of shock absorbers based on input data from said input unit;

a condition setting processor for setting at least an impact style and usage conditions based on input data from said input unit;

a shock absorber selection processor for selecting a shock absorber of optimum size from the type of shock absorbers based on at least said impact style and said usage conditions; and a display processor for displaying a condition setting area for setting at least the impact style and the usage conditions, and an image display area for displaying an image of a selected shock absorber, wherein said image display area comprises a first area for displaying an image of an appearance of the selected shock absorbers, and a second area for displaying an impact image in animation.

25. A system according to claim 24, wherein said condition setting processor uses an impact condition determined by selecting devices of a cylinder operating system.

26. A system according to claim 24, wherein said condition setting processor has a moment calculation processor for calculating an inertial moment based on input data from said input unit if the impact style is a rotational impact mode.

27. A system according to claim 26, wherein said moment calculation processor has a load type selection processor for selecting a load type based on input data from said input unit.

28. A system according to claim 27, wherein said load type selection processor has a display processor for displaying a list of load types and a setting area for selecting a rotational axis.

29. A system according to claim 24, further comprising:

a display processor for displaying an area for displaying calculation results including an absorption energy and an impact object equivalent mass, an area for displaying a list of model numbers of selected shock absorbers according to a sequence of maximum absorption energies, and an area for displaying a dimension diagram and specifications of a shock absorber selected from the list of model numbers.

30. A system according to claim 24, further comprising:

a list registration processor for registering, in advance, input values that are used in a reference hat which corresponds to input items used to select said shock absorber.

31. A system according to claim 24, further comprising:

the system of units selection processor for selecting a list of the system of units based on input data from said input unit among a plurality of lists for which the system of units to be used are registered in advance.

32. A method of selecting a pneumatic device, comprising the steps of:

selecting a cylinder operating system based on input data from an input unit connected to a computer;

selecting a shock absorber based on input data from said input unit and/or the selected cylinder operating system;

setting a pneumatic circuit based on input data from said input unit;

calculating characteristics of said cylinder operating system based on a device selected through said input unit and the pneumatic circuit;

displaying, in graphs, characteristic values obtained by said characteristic calculation processor;

entering humidity information into a computer through an input unit; and calculating the probability of moisture condensation produced in said cylinder operating system based on the characteristics of said cylinder operating system and the moisture information.

33. A method of selecting a pneumatic device, comprising the steps of:

selecting a cylinder operating system;

entering humidity information into a computer through an input unit; and calculating the probability of moisture condensation produced in said cylinder operating system based on characteristics of said cylinder operating system and the moisture information.

34. A method of selecting a shock absorber, comprising the steps of:

setting a type of shock absorbers based on input data from an input unit connected to a computer;

setting at least an impact style and usage conditions based on input data from said input unit;

selecting a shock absorber of optimum size from said type of shock absorbers based on said impact style and usage conditions; and displaying a condition setting area for setting at least the impact style and the usage conditions, and an image display area for displaying an image of a selected shock absorber, wherein said image display area comprises a first area for displaying an image of an appearance of the selected shock absorbers, and a second area for displaying an impact image in animation.

35. A recording medium readable by a computer and storing a program used in a pneumatic device selection system having a computer, a database connected to said computer and storing data of at least pneumatic devices, an input unit connected to said computer, for entering input data based on an input action of an operator into said computer, and a display unit connected to said computer, for displaying information from said computer, said program comprising:

a first selection processor for selecting a cylinder operating system based on input data from said input unit;

a second selection processor for selecting a shock absorber based on input data from said input unit and/or a selection result from said first selection processor;

a circuit setting processor for setting a pneumatic circuit based on input data from said input unit;

a characteristic calculation processor for calculating characteristics of said cylinder operating system based on a device selected through said input unit and the pneumatic circuit; and a moisture condensation calculation processor for calculating the probability of moisture condensation produced in said cylinder operating system based on the characteristics of said cylinder operating system and humidity information entered through said input unit, wherein said first selection processor has a display processor for displaying, in graphs, characteristic values obtained by said characteristic calculation processor.

36. A recording medium readable by a computer and storing a program used in a pneumatic device selection system having a computer, an input unit connected to said computer, for entering input data based on an input action of an operator into said computer, and a display unit connected to said computer, for displaying information from said computer, said program comprising:

means for calculating the probability of moisture condensation produced in a selected cylinder operating system based on characteristics of the selected cylinder operating system and humidity information entered through said input unit.

37. A recording medium readable by a computer and storing a program used in a pneumatic device selection system having a computer, a database connected to said computer and storing data of at least pneumatic devices, an input unit connected to said computer, for entering input data based on an input action of an operator into said computer, a display unit connected to said computer, for displaying information from said computer, said program comprising:

means for setting a type of shock absorbers based on input data from said input unit;

means for setting at least an impact style and usage conditions based on input data from said input unit;

means for selecting a shock absorber of optimum size from the type of shock absorbers based on at least said impact style and said usage conditions; and a display processor for displaying a condition setting area for setting at least the impact style and the usage conditions, and an image display area for displaying an image of a selected shock absorber, wherein said image display area comprises a first area for displaying an image of an appearance of the selected shock absorbers, and a second area for displaying an impact image in animation.

* * * * *